US007497486B1

(12) United States Patent
Davis et al.

(10) Patent No.: US 7,497,486 B1
(45) Date of Patent: Mar. 3, 2009

(54) MULTIFUNCTION MORTISE LOCK

(75) Inventors: Jamie H. Davis, Noblesville, IN (US); David E. Compeau, Oxford, MI (US); Chad A. Hickman, Plainfield, IN (US)

(73) Assignee: Stanley Security Solutions, Inc., Indianapolis, IN (US)

( * ) Notice: Subject to any disclaimer, the term of this patent is extended or adjusted under 35 U.S.C. 154(b) by 0 days.

(21) Appl. No.: 11/228,094

(22) Filed: Sep. 16, 2005

Related U.S. Application Data

(60) Provisional application No. 60/610,639, filed on Sep. 16, 2004, provisional application No. 60/622,253, filed on Oct. 26, 2004.

(51) Int. Cl.
*E05C 1/00* (2006.01)

(52) U.S. Cl. ..... 292/32; 292/169.14; 70/107

(58) Field of Classification Search ..... None
See application file for complete search history.

(56) References Cited

U.S. PATENT DOCUMENTS

| | | | | |
|---|---|---|---|---|
| 3,159,993 | A | 12/1964 | Crepinsek | |
| 3,361,462 | A * | 1/1968 | Foster | 292/165 |
| 3,672,714 | A * | 6/1972 | Schultz | 292/34 |
| 4,583,382 | A * | 4/1986 | Hull | 70/107 |
| 4,589,691 | A | 5/1986 | Foshee et al. | |
| 4,641,866 | A | 2/1987 | Haeck et al. | |
| 4,674,776 | A | 6/1987 | James | |
| 4,695,082 | A | 9/1987 | Marks | |
| 4,696,174 | A | 9/1987 | Marks | |
| 4,920,773 | A | 5/1990 | Surko, Jr. | |
| 5,474,348 | A | 12/1995 | Palmer et al. | |
| 5,640,863 | A | 6/1997 | Frolov | |
| 5,678,870 | A | 10/1997 | Pelletier | |
| 5,813,255 | A | 9/1998 | Tell, III et al. | |
| 6,349,982 | B2 | 2/2002 | Fayngersh et al. | |
| 6,393,878 | B1 * | 5/2002 | Fayngersh et al. | 70/107 |
| 6,543,264 | B2 | 4/2003 | Frolov | |
| 6,619,705 | B2 | 9/2003 | Dalsing | |
| 6,669,249 | B1 | 12/2003 | Huang et al. | |
| 2003/0019256 | A1 | 1/2003 | Frolov | |
| 2003/0127864 | A1 | 7/2003 | Dalsing | |
| 2005/0212301 | A1 * | 9/2005 | Huang | 292/169.17 |

FOREIGN PATENT DOCUMENTS

| | | |
|---|---|---|
| EP | 0 410 122 | 10/1993 |
| EP | 0 496 076 | 8/1994 |
| EP | 0 682 167 | 2/1998 |
| GB | 2 182 708 | 5/1987 |
| GB | 2 378 216 | 2/2003 |

OTHER PUBLICATIONS

Best Access Systems and Avalon Group, Inc., H Series Service Manual; Jul. 6, 2002; United States of America.
Best Access Systems and Avalon Group, Inc., H Series Heavy Duty Motrise Locks; 2004; United States of America.

* cited by examiner

*Primary Examiner*—Patricia L Engle
*Assistant Examiner*—Kristina R Fulton
(74) *Attorney, Agent, or Firm*—Baker & Daniels LLP

(57) ABSTRACT

A mortise lock is disclosed for securing a door. The mortise lock includes a chassis, a latch bolt, and at least one handle. The lock has a plurality of functional states, including a state in which input to a handle is prevented from retracting the latch bolt.

23 Claims, 61 Drawing Sheets

MULTIFUNCTION MORTISE LOCK

RELATED APPLICATIONS

This application claims priority to U.S. Provisional Patent Application Ser. No. 60,610,639, filed Sep. 16, 2004, to Hickman et al., titled "Mortise Lock," and U.S. Provisional Patent Application Ser. No. 60/622,253, filed Oct. 26, 2004, to Hickman et al., titled "Lock Strike," the disclosures of which are each expressly incorporated by reference herein. The disclosures of U.S. patent application Ser. No. 11/228,756, filed herewith, to Hickman et al., titled "Universal Strike for a Lock"; U.S. patent application Ser.l No. 11/228,801, filed herewith, to Hickman et al., titled "Mortise Lock with Lockable Handles"; and U.S. patent application Ser. No. 11/228,802, filed herewith, to Davis et al., titled "Method for Configuring a Mortise Lock" are expressly incorporated by reference herein.

BACKGROUND AND SUMMARY OF THE INVENTION

The present invention relates to locks. More particularly, the present invention relates to mortise locks.

Typically, mortise locks are provided to secure a door from opening. Some mortise locks are provided with key cores to block unauthorized persons from opening the door and others are not provided with key cores. Some mortise locks include latch bolts, auxiliary bolts, and/or deadbolts.

According to one aspect of the present invention, a mortise lock is provided that allows enabling and disabling of the handles. According to another aspect of the present disclosure, a mortise lock is provided with several selectable functions. According to another aspect of the present invention, a strike plate is provided for mortise locks having different functions. According to another aspect of the present invention, a method for configuring the functionality of a mortise lock is provided.

According to another aspect of the present invention, a mortise lock is provided for a door including a chassis, a latch bolt supported by the chassis to move relative to the chassis between a latched position and an unlatched position, a first door handle, a first hub coupled to the first door handle, a second door handle, a second hub coupled to the second door handle, a shuttle supported by the chassis to move between an enabled position and a disabled position, and first toggle supported by the shuttle. The first toggle is moveable relative to the shuttle between a first position engaging the first hub to block an input from the first door handle from moving the latch bolt to the unlatched position and a second position permitting the input to the first door handle to move the latch bolt to the unlatched position. The mortise lock further includes a second toggle supported by the shuttle. The second toggle is moveable relative to the shuttle between a first position engaging the second hub to block an input from the second door handle from moving the latch bolt to the unlatched position and a second position permitting the input to the second door handle to move the latch bolt to the unlatched position, the first and second toggles being spaced apart from the first and second hubs when in the first position and the shuttle is in the disabled position. The mortise lock further includes a control member supported by the chassis and moveable between a first position in contact with the shuttle holding the shuttle in the disabled position, a second position in contact with the shuttle holding the shuttle in the enabled position, and a third position. The mortise lock further includes a shuttle toggle supported by the chassis and moveable relative to the chassis when the control member is in the third position. The shuttle toggle is moveable between a first position in contact with the shuttle holding the shuttle in the enabled position and a second position holding the shuttle in the disabled position.

According to another aspect of the present disclosure, a mortise lock is provided for a door including a chassis having a front end accessible through an end of the door when the mortise lock is installed on the door, a latch bolt supported by the chassis to move relative to the chassis between a latched position and an unlatched position, a first door handle, a second door handle, and means for changing the state of the mortise lock between at least two states selected from a plurality of states including a first state in which at least one of the first and second door handles are locked and unlocked by an input through the front or back of the door, a second state in which at least one of the first and second door handles are locked and unlocked through the front end of the chassis, a third state in which at least one of the first and second door handles are always locked after the lock is installed, and a fourth state in which the first and second door handles are always unlocked after the lock is installed.

According to another aspect of the present disclosure, a mortise lock is provided for a door including a chassis having a front end accessible through an end of the door when the mortise lock is installed on the door, a latch bolt supported by the chassis to move relative to the chassis between a latched position and an unlatched position, a first door handle, a second door handle, and means for configuring the lock between at least two functions selected from a plurality of functions including an office function, a storeroom function, a classroom function, a passage function, a privacy function, and an exit function.

According to another aspect of the present invention, a mortise lock is provided for a door including a chassis having a face accessible through the door when the mortise lock is installed on the door, a latch bolt supported by the chassis to move relative to the chassis between a latched position and an unlatched position, a first door handle, a second door handle, at least one shuttle moveable between first and second positions, and an interactive member moveable relative to the shuttle between a block state blocking an input to the first door handle from moving the latch bolt to the unlatched position and an unblock state permitting the input to the first door handle to move the latch bolt to the unlatched position. The shuttle is moveable relative to the chassis to move the interactive member between the block state and the unblock state. The door is able to be opened through an input to the second door handle when the interactive member is in the block state.

Additional features of the present invention will become apparent to those skilled in the art upon consideration of the following detailed description of the presently perceived best mode of carrying out the invention.

BRIEF DESCRIPTION OF THE DRAWINGS

A detailed description particularly refers to the accompanying figures in which.

BRIEF DESCRIPTION OF THE APPENDICES

Attached Appendix A includes additional details of the mortise locks described herein and is incorporated by reference herein. Attached Appendix B includes additional details of the mortise locks described herein and is incorporated by reference herein.

DETAILED DESCRIPTION OF THE DRAWINGS

Figure 38:
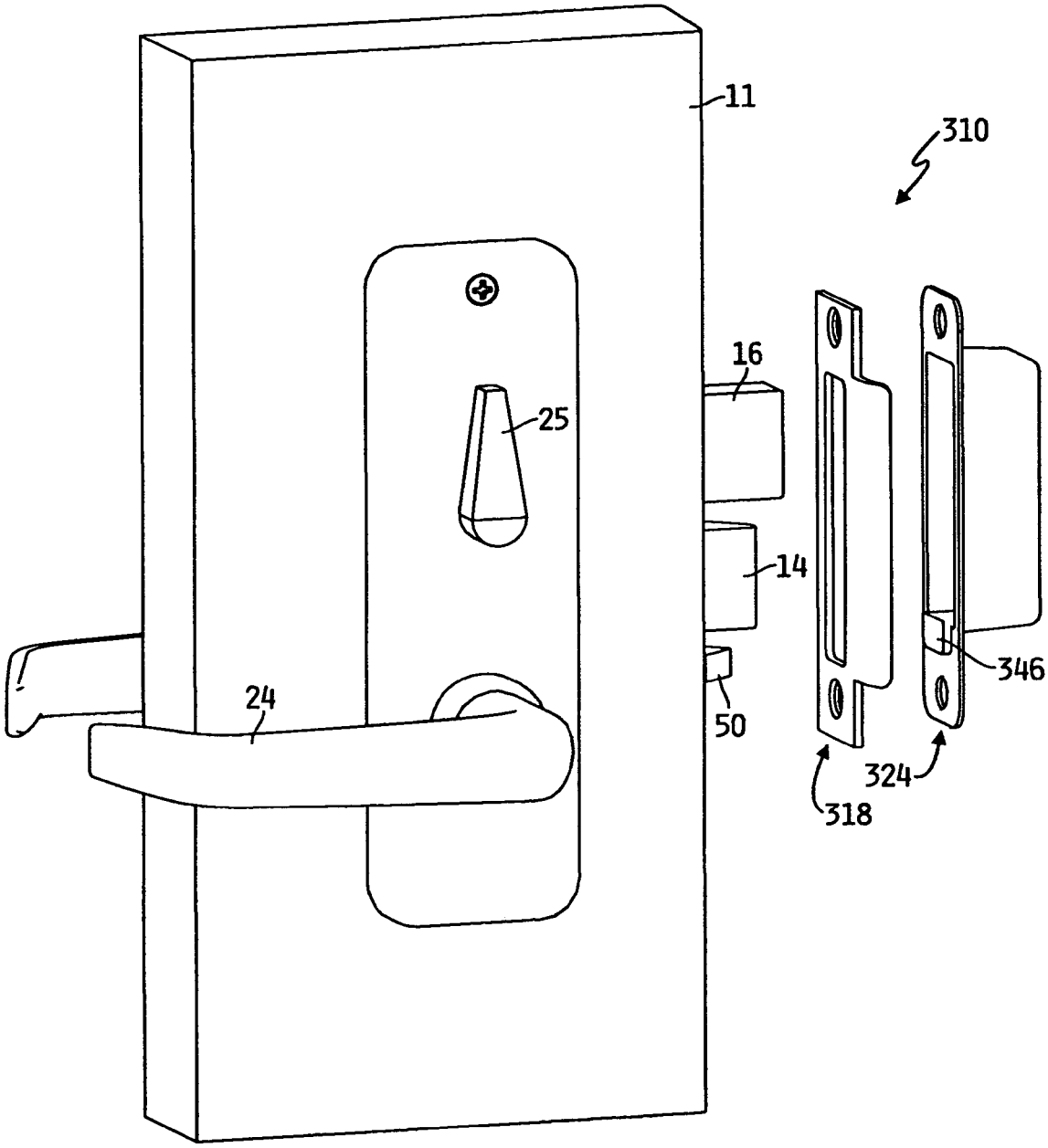
FIG. 38 is a view similar to FIG. 37 showing the handing of the latch bolt reversed and the strike plate flipped to match the handing of the latch bolt.
Figure 39:
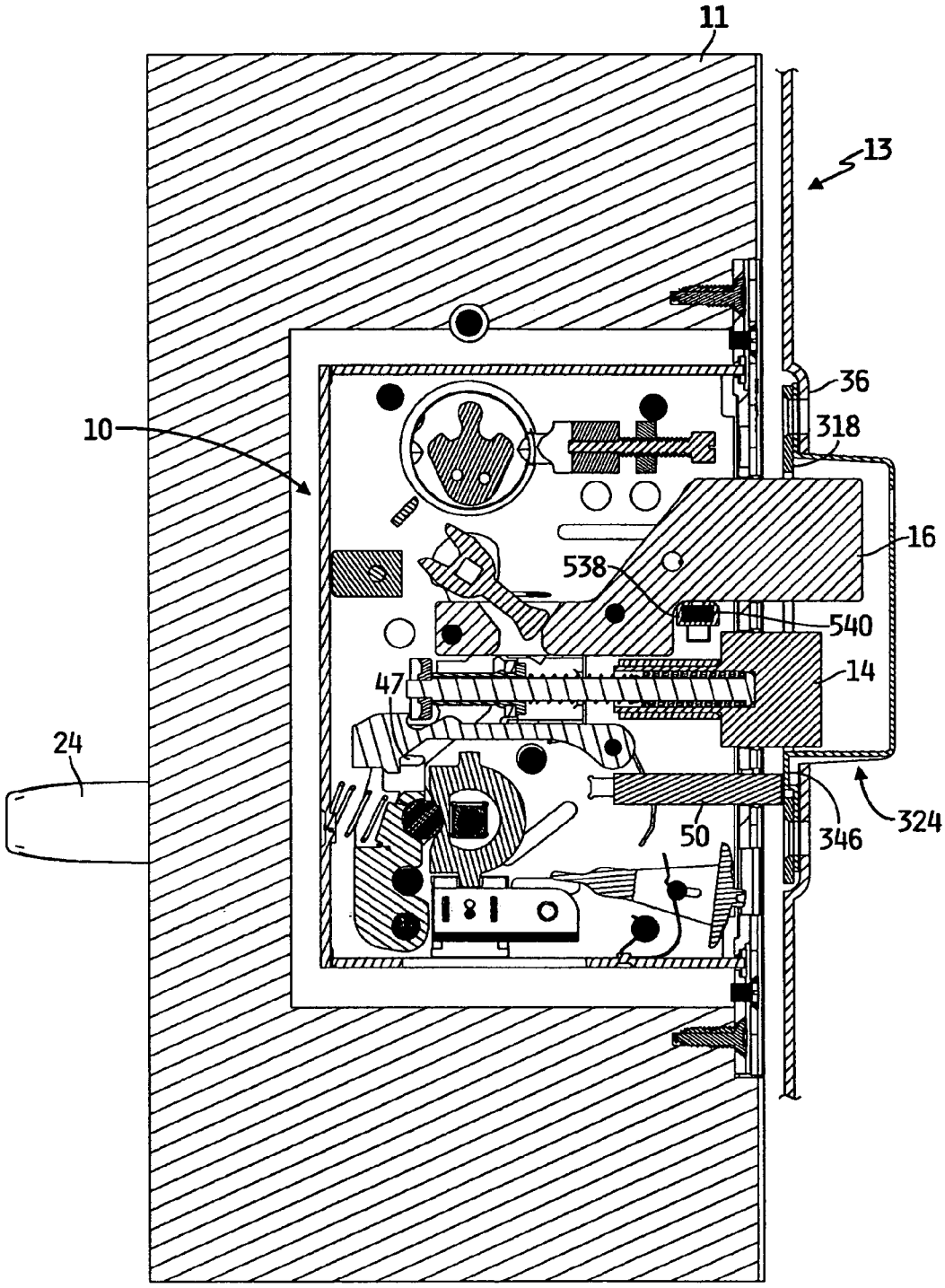
FIG. 39 is a cross-sectional view of the lock of FIG. 1 showing the deadbolt and latch bolt positioned in the strike place and strike box and the auxiliary bolt contacting the strike plate and the plug portion of the strike box.

According to the present disclosure, a mortise lock 10 is provide for blocking movement of a building door 11 (see FIG. 38) relative to a door frame 13 (see FIG. 39). Lock 10 includes a chassis or housing 12 normally positioned in door 11, a latch bolt 14 that extends from chassis 12 to interact with door frame 13, and a deadbolt 16 that also extends from chassis 12 to interact with door frame 13. According to alternative embodiments of the present disclosure, lock 10 is used in other applications known to those of ordinary skill in the art in need of access control, such automotive doors or trunks.

Figure 28:
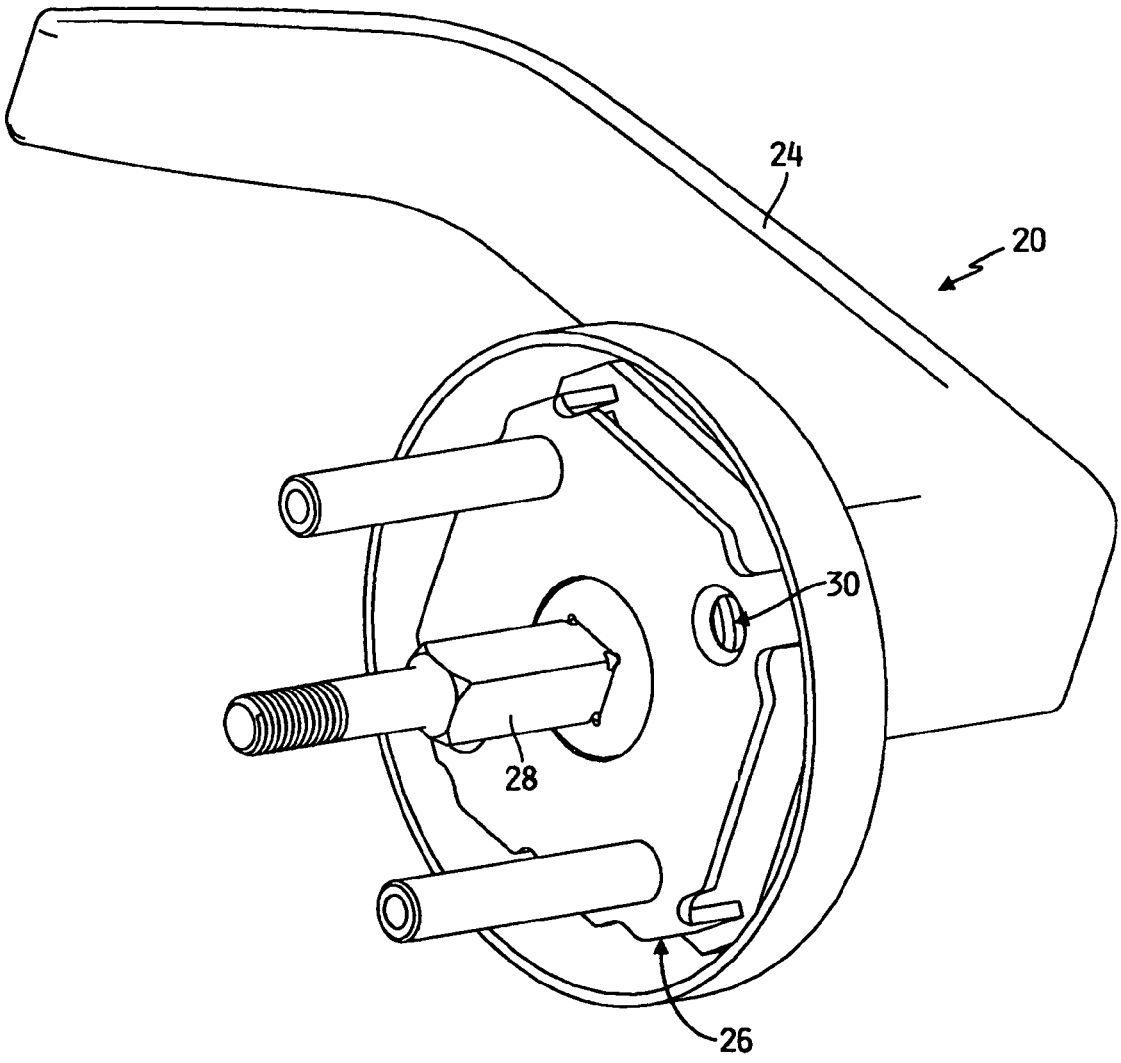
FIG. 28 is a perspective view of an outside handle assembly for use with the locks of FIGS. 1 and 19.
Figure 29:
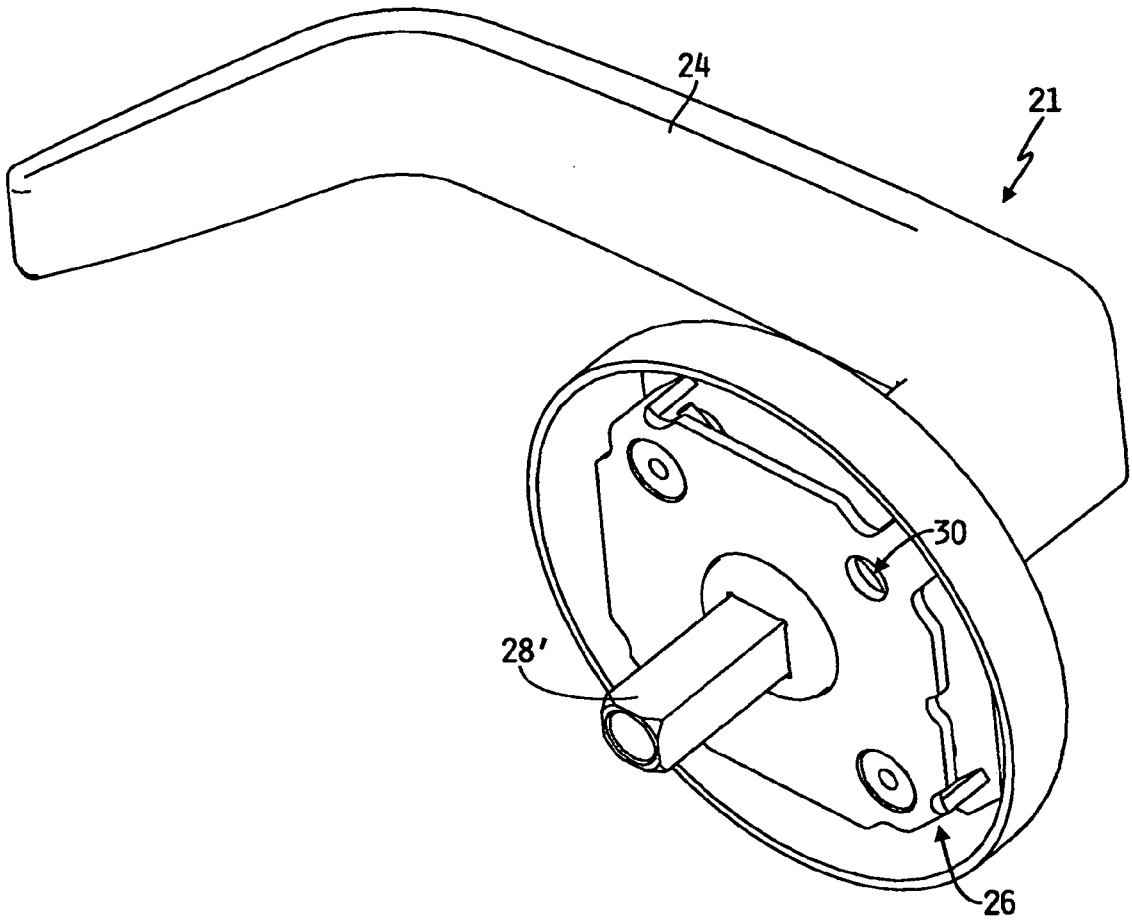
FIG. 29 is a perspective view of in inside handle assembly for use with the locks of FIGS. 1 and 19.
Figure 30:
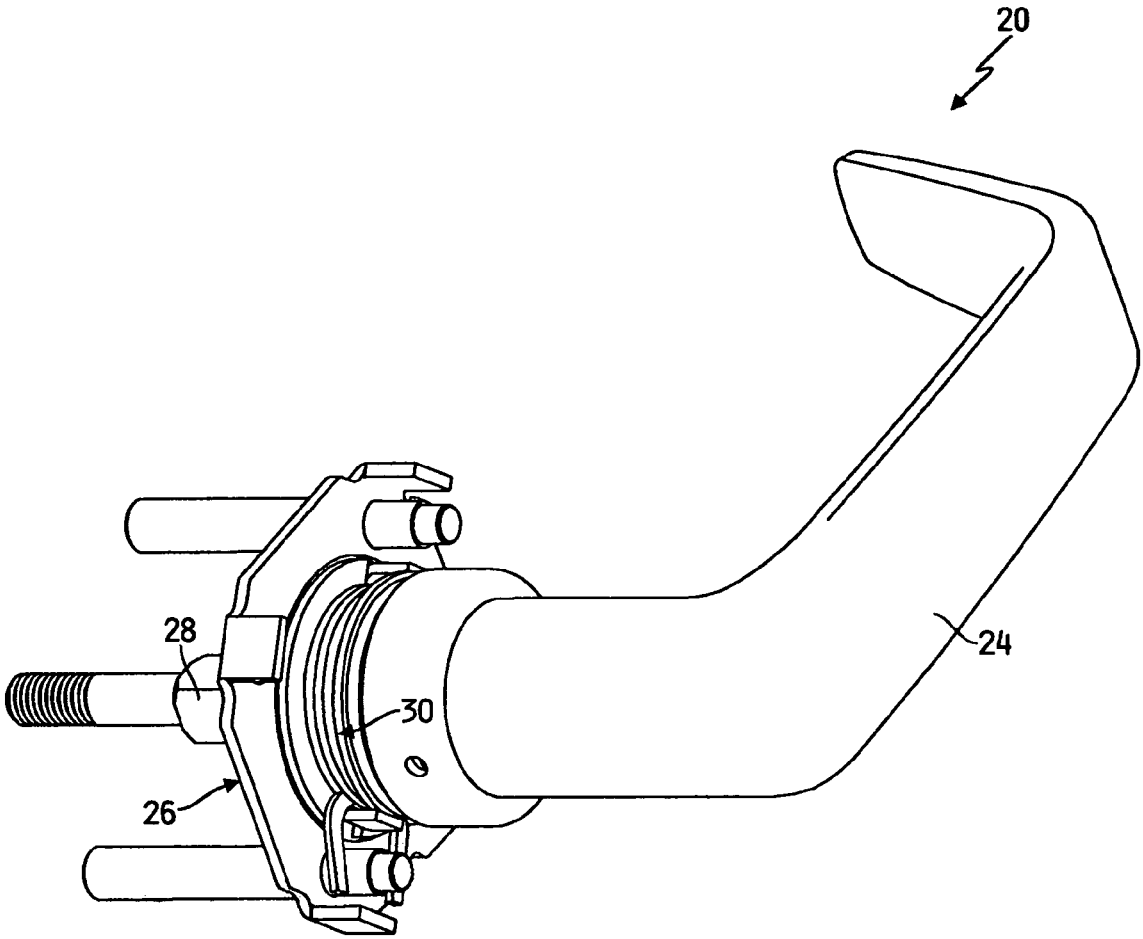
FIG. 30 is a perspective view of the handle assembly of FIG. 28 showing a return spring.

Depending on the setup of lock 10, a user can operate latch bolt 14 using a key and core assembly 18, a first or outside handle assembly 20 (shown in FIGS. 28 and 30), or a second or inside handle assembly 21 (shown in FIG. 29) that is similar to first handle assembly 20. Additional details of a suitable key and core assemblies is provided in U.S. Pat. Nos. 5,272,895, filed May 29, 1992; 4,444,034, filed Jul. 16, 1981, and 4,424,693, filed Nov. 5, 1980, the entire disclosures of which are expressly incorporated by reference herein.

First and second handle assemblies 20, 21 include handles 24, handle supports 26, spindles 28, 28', and return springs 30. As handle 24 rotates, one end of return spring 30 rotates, the other end remains stationary, and spindle 28, 28', unless blocked by another portion of lock 10, causes latch bolt 14 to be retracted. Retraction of latch bolt 14 permits door 11 in which mortise lock 10 is mounted to be opened.

Return spring 30 maintains handle 24 in its horizontal, neutral position when it is not being rotated by an input from a user. Return spring 30 acts on handle 24 to rotate it to its original, horizontal position. Second handle assembly 21 operates in a manner similar to first handle assembly 20.

Chassis 12 includes a case body 32, a cover 34 that mounts to case body 32, an armored front 36 mounted to case body 32, a representative face plate 38 mounted to armored front 36. As discussed further herein, other face plates may be provided with lock 10 or the other locks described herein depending on the desired functionality of the lock. Most of the other components of lock 10 are housed within chassis 12.

Figure 9:
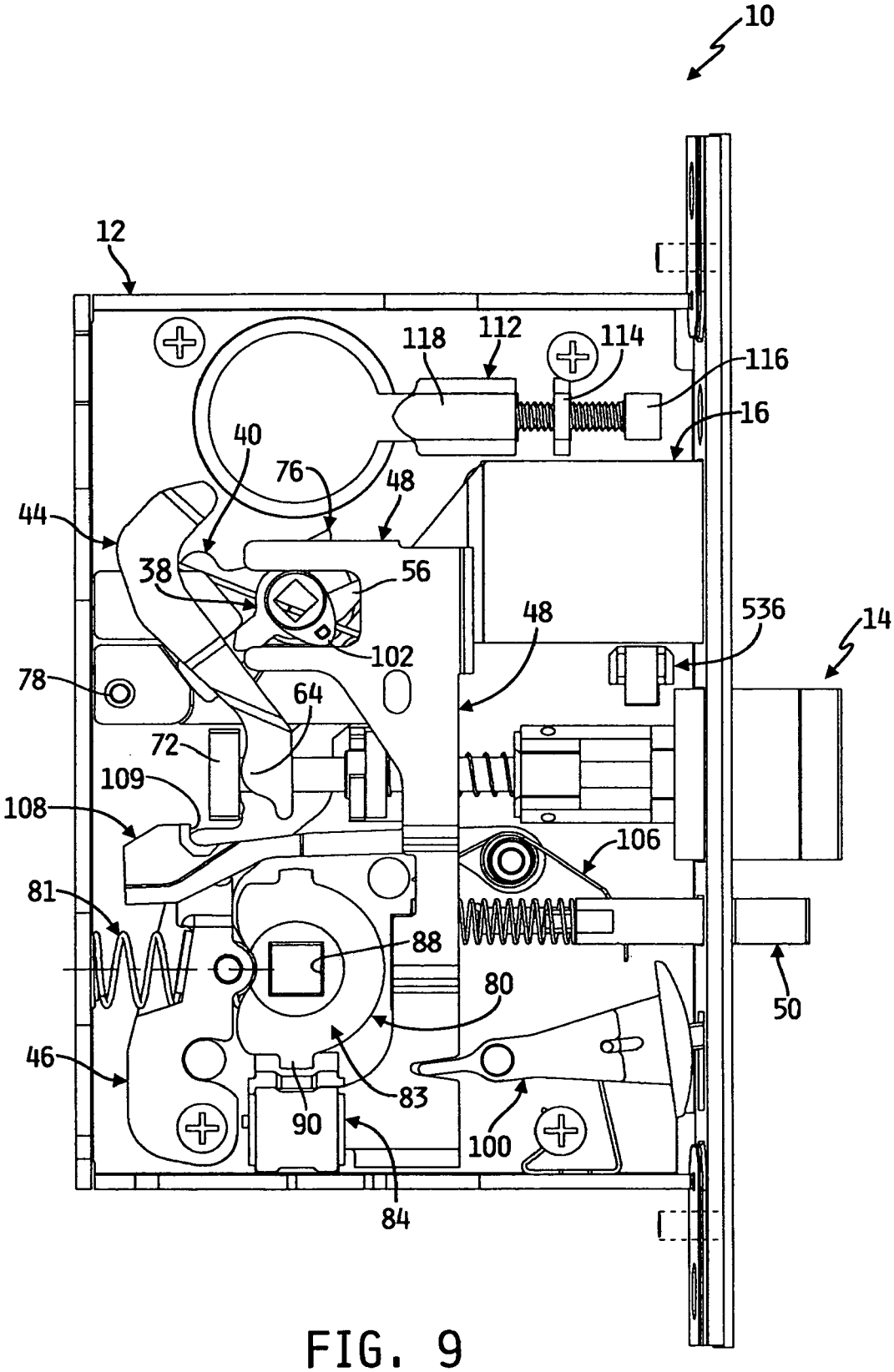
FIG. 9 is an end view of the lock of FIG. 1 showing the deadbolt retracted into the case.
Figure 10A:
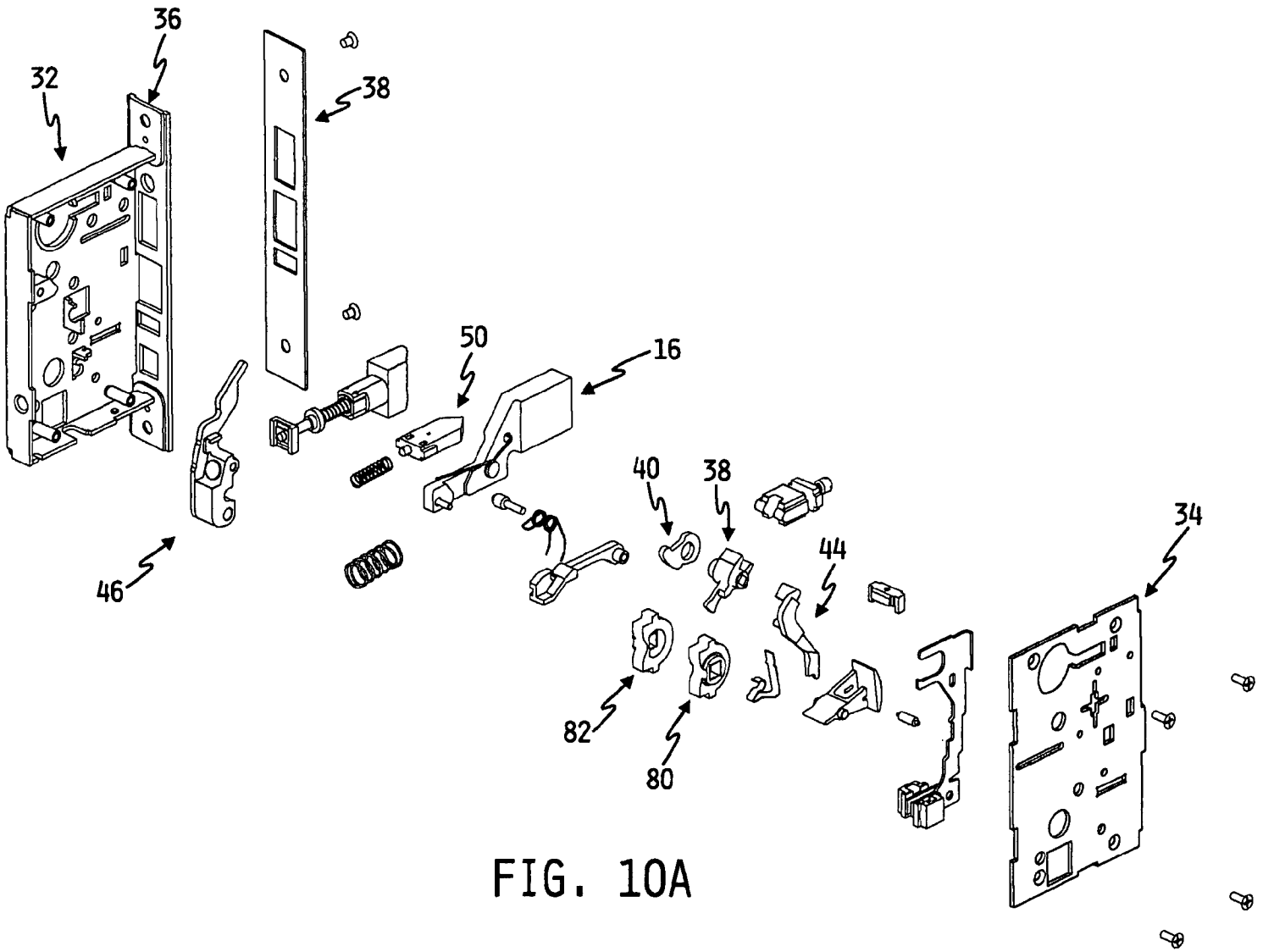
FIG. 10*a* is an exploded assembly view of the lock of FIG. 1.
Figure 10B:
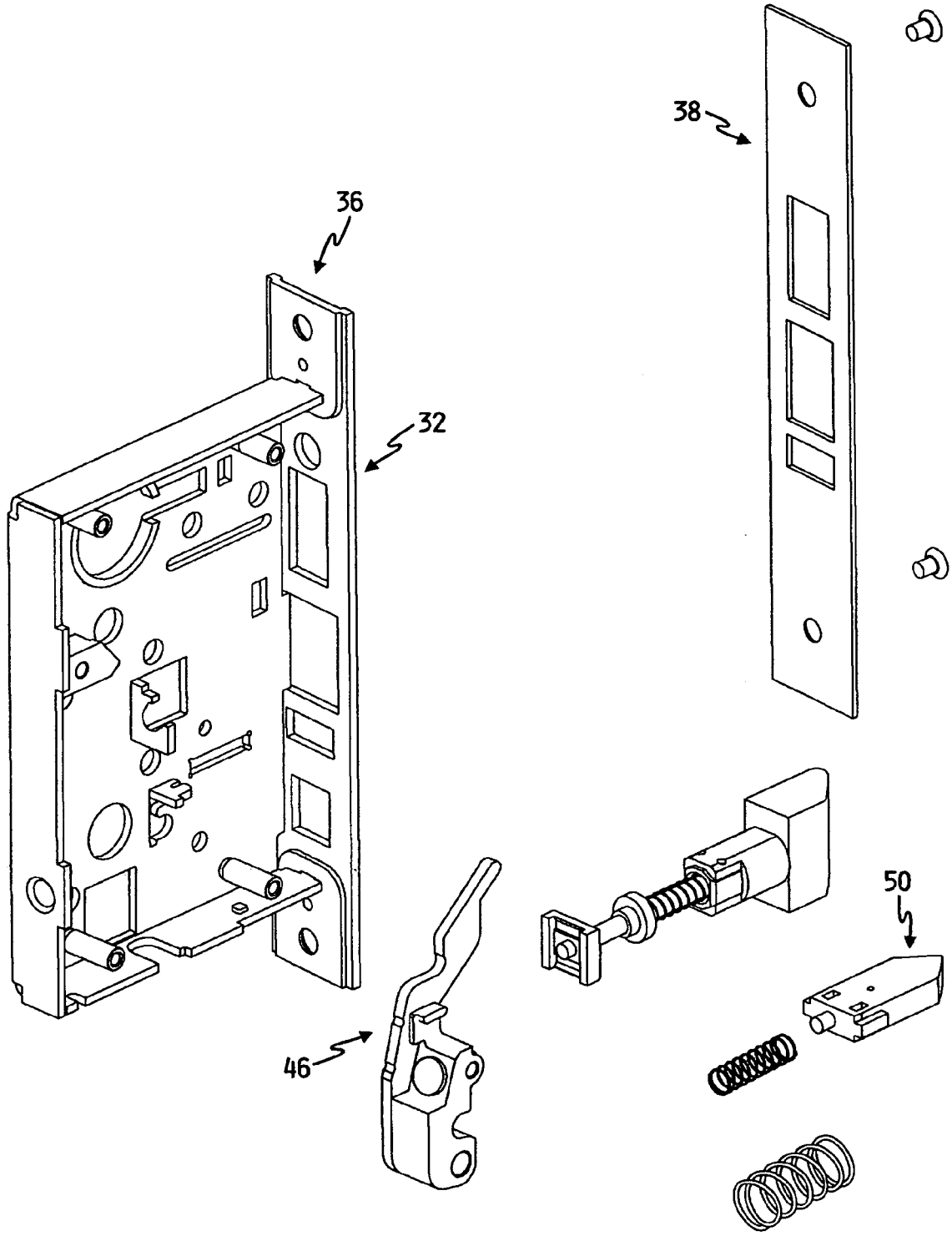
FIG. 10*b* is an enlarged view of a left portion of FIG. 10*a;*
Figure 10C:
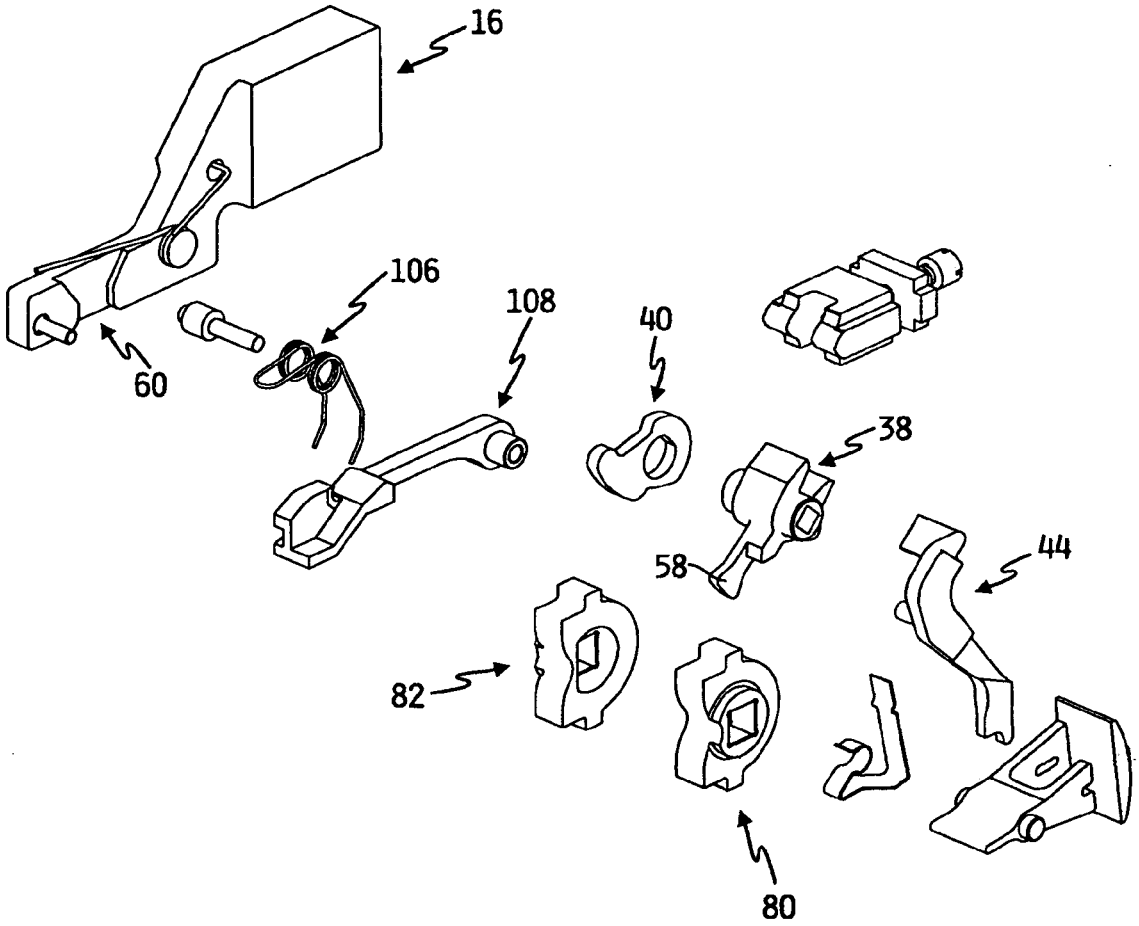
FIG. 10*c* is an enlarged view of a middle portion of FIG. 10*a;*
Figure 10D:
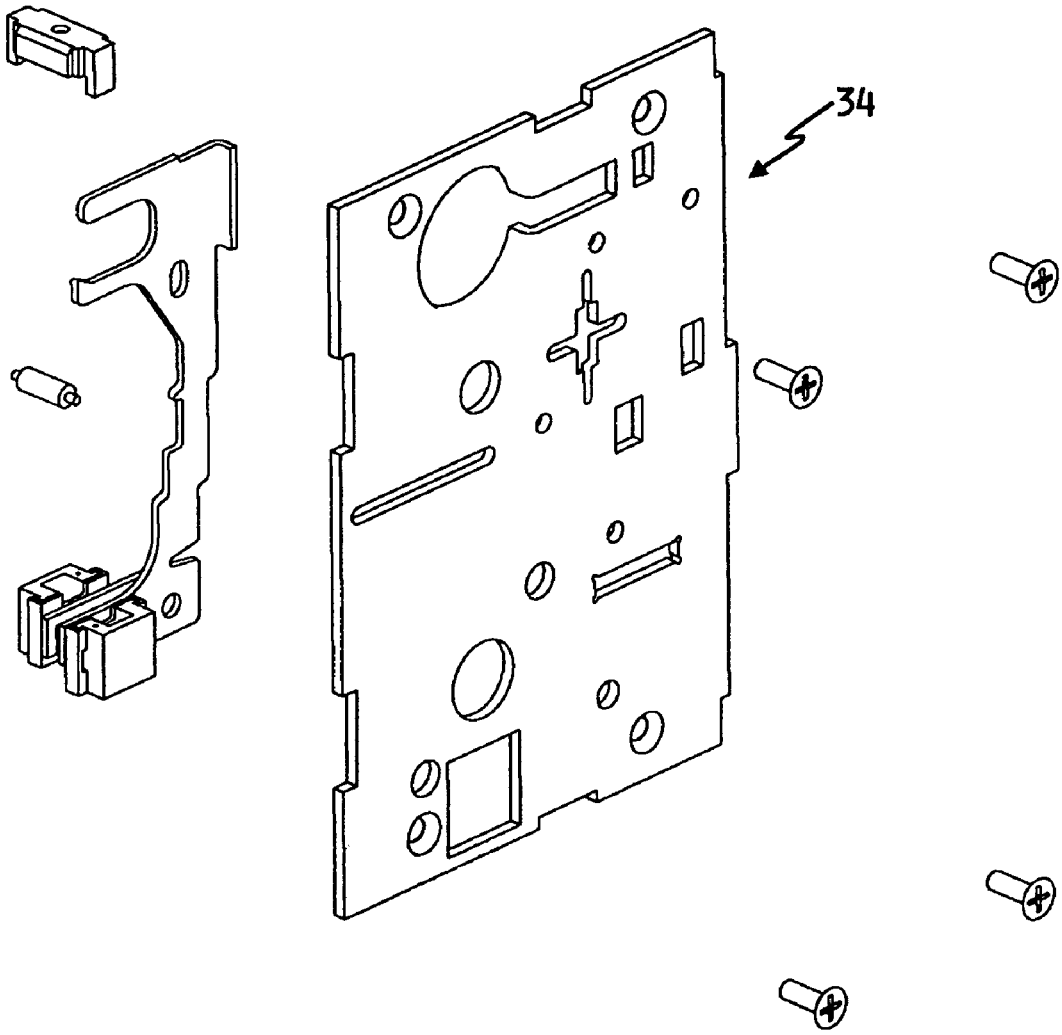
FIG. 10*d* is an enlarged view of a right portion of FIG. 10*a;*
Figure 11:
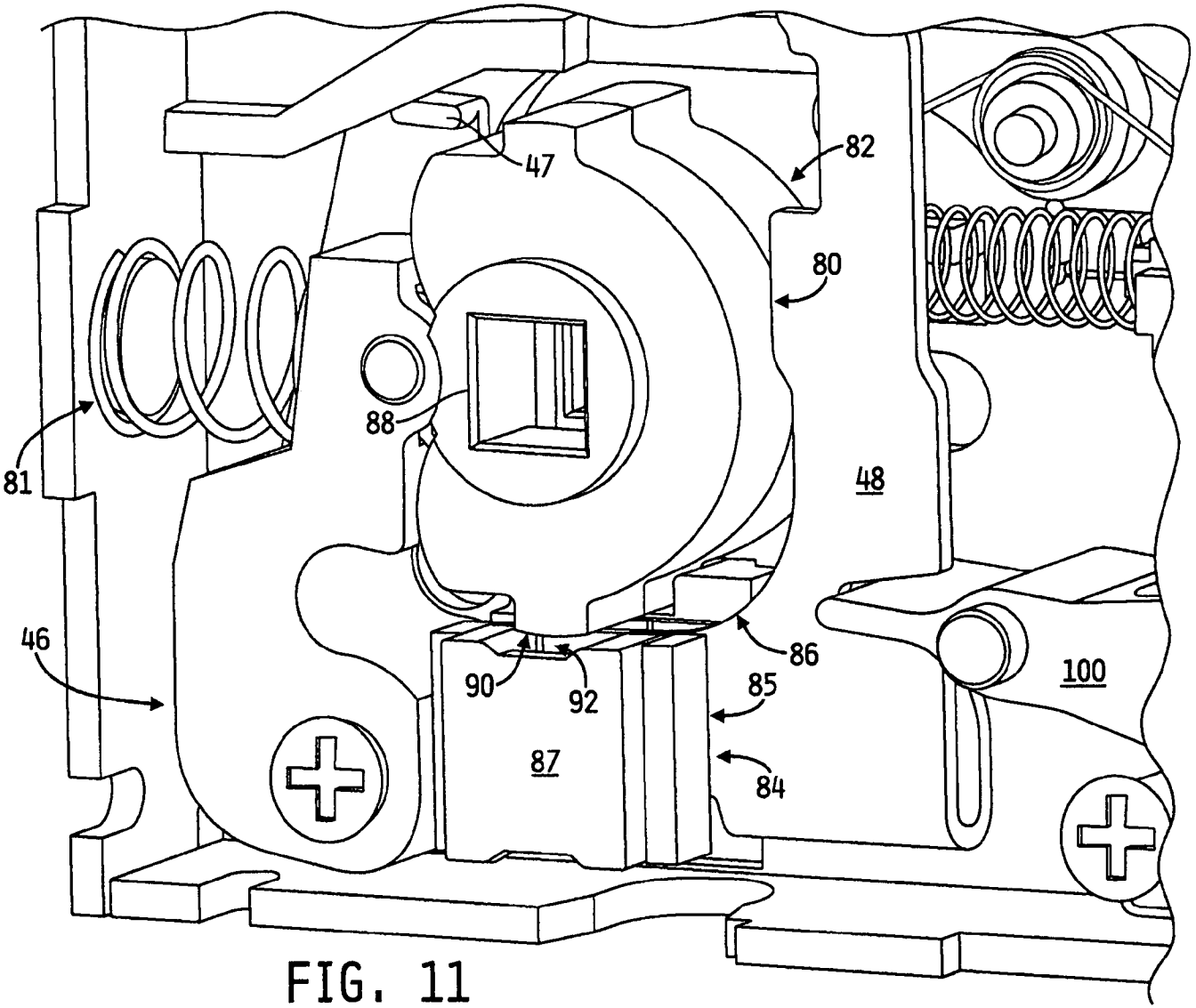
FIG. 11 is an enlarged view of a lower left-hand portion of FIG. 1 showing the lock including a first or back toggle in a raised position and a second or front toggle in a lowered position.
Figure 12:
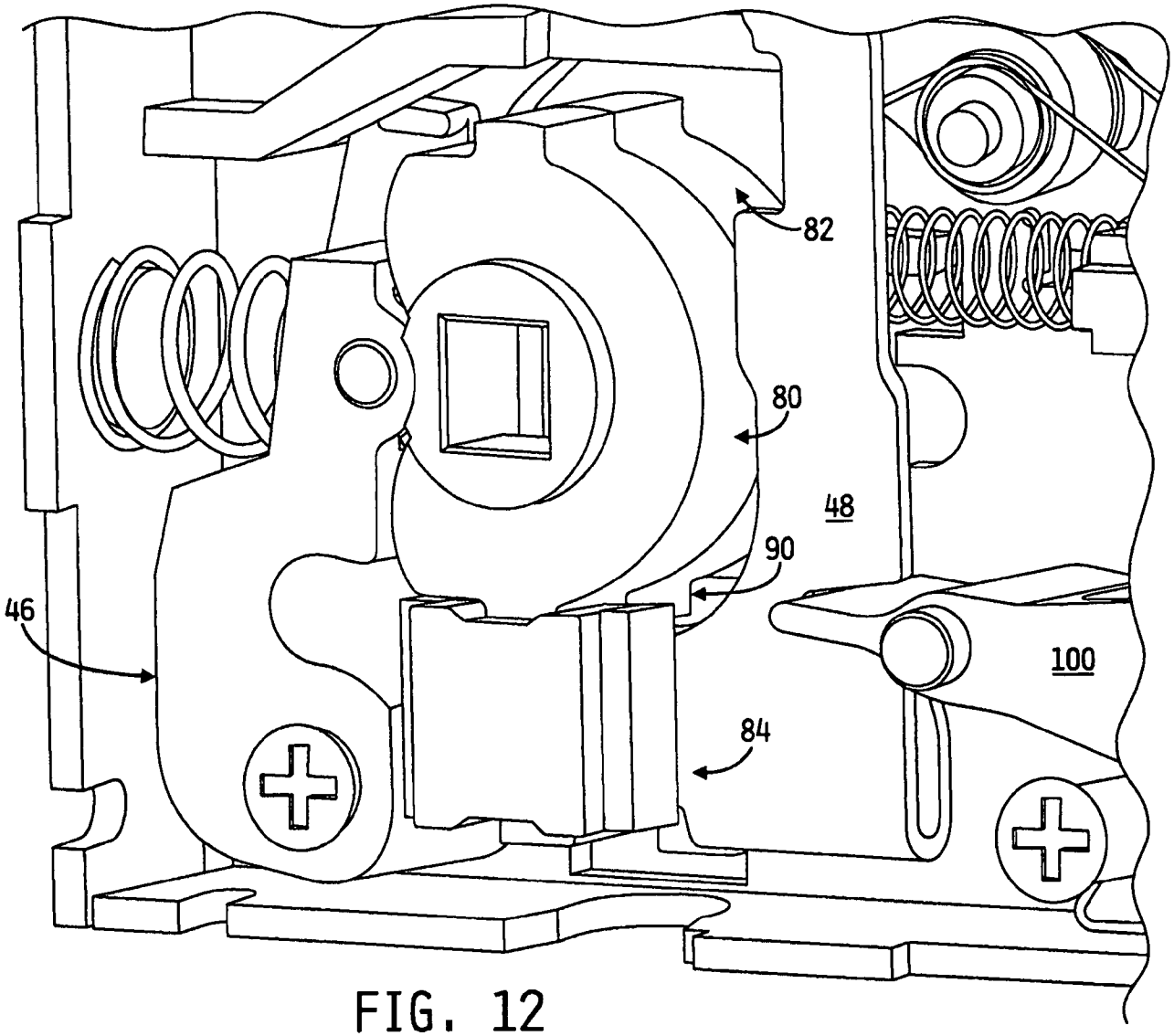
FIG. 12 is a view similar to FIG. 11 showing the first toggle in a lowered position and the second toggle in a raised position.
Figure 13:
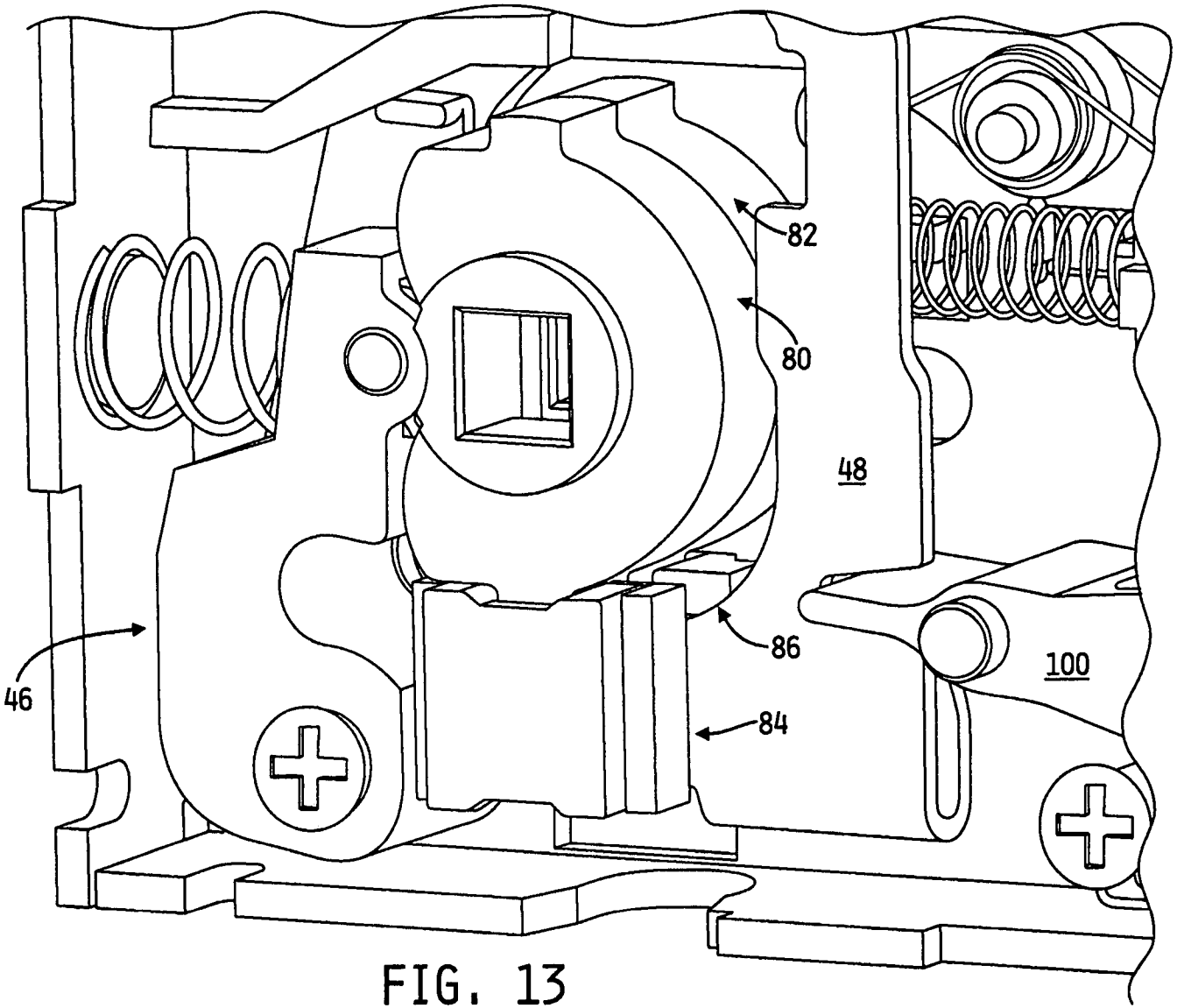
FIG. 13 is a view similar to FIG. 11 showing the first and second toggles in the raised position.
Figure 14:
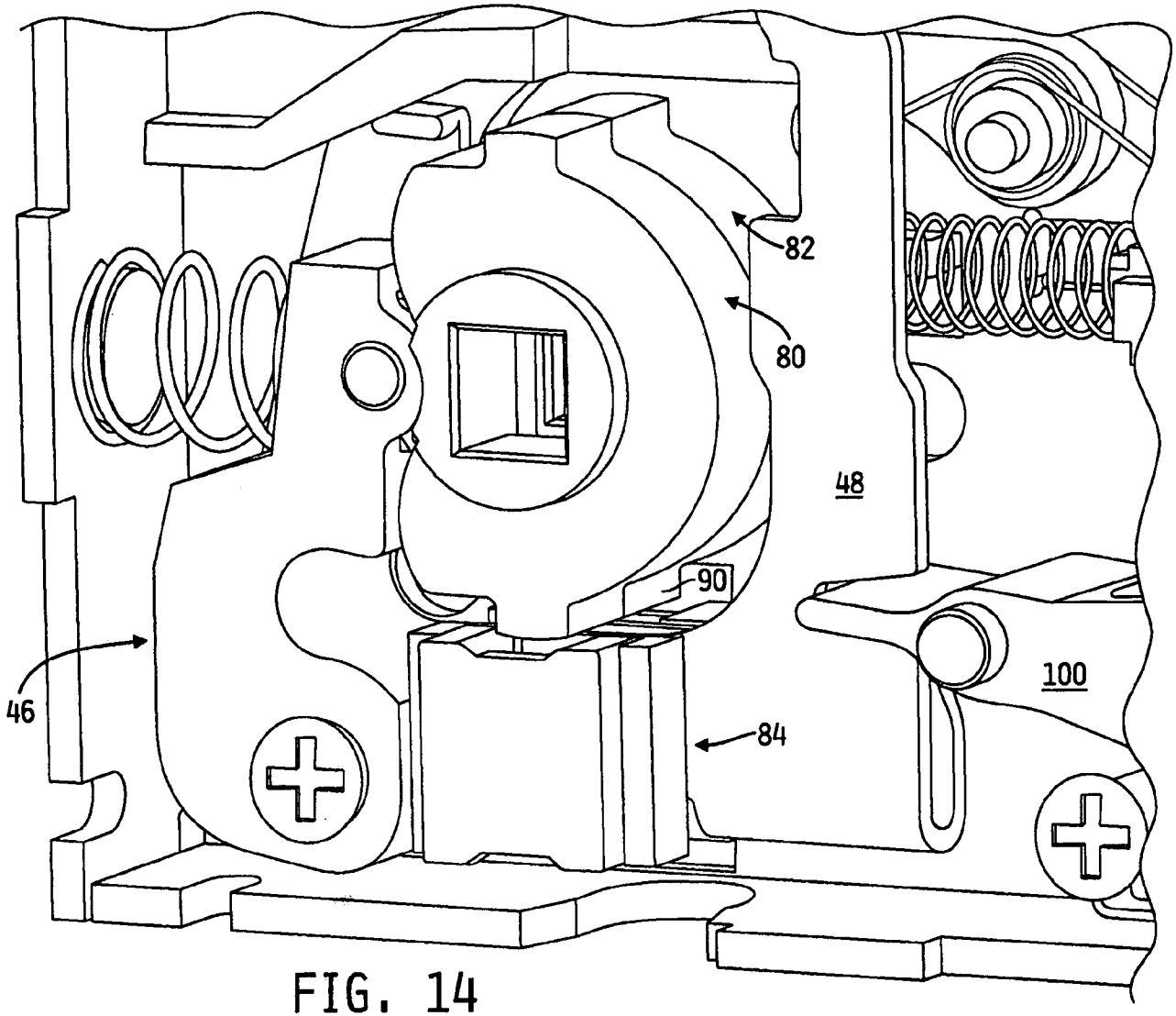
FIG. 14 is a view similar to FIG. 11 showing the first and second toggles in the lowered position.

As shown in FIG. 9, lock 10 further includes a turn knob hub/control member 38 that rotates within chassis 12, a turn knob stamping 40 keyed to turn knob hub 38 to rotate therewith, deadbolt 16 that slides in and out of chassis 12, a key release lever 44 that rotates within chassis 12, a handle release lever or link 46 that rotates within chassis 12, a shuttle or locking lever 48 that slides in chassis 12, and an auxiliary bolt 50 that slides within chassis 12.

Figure 1:
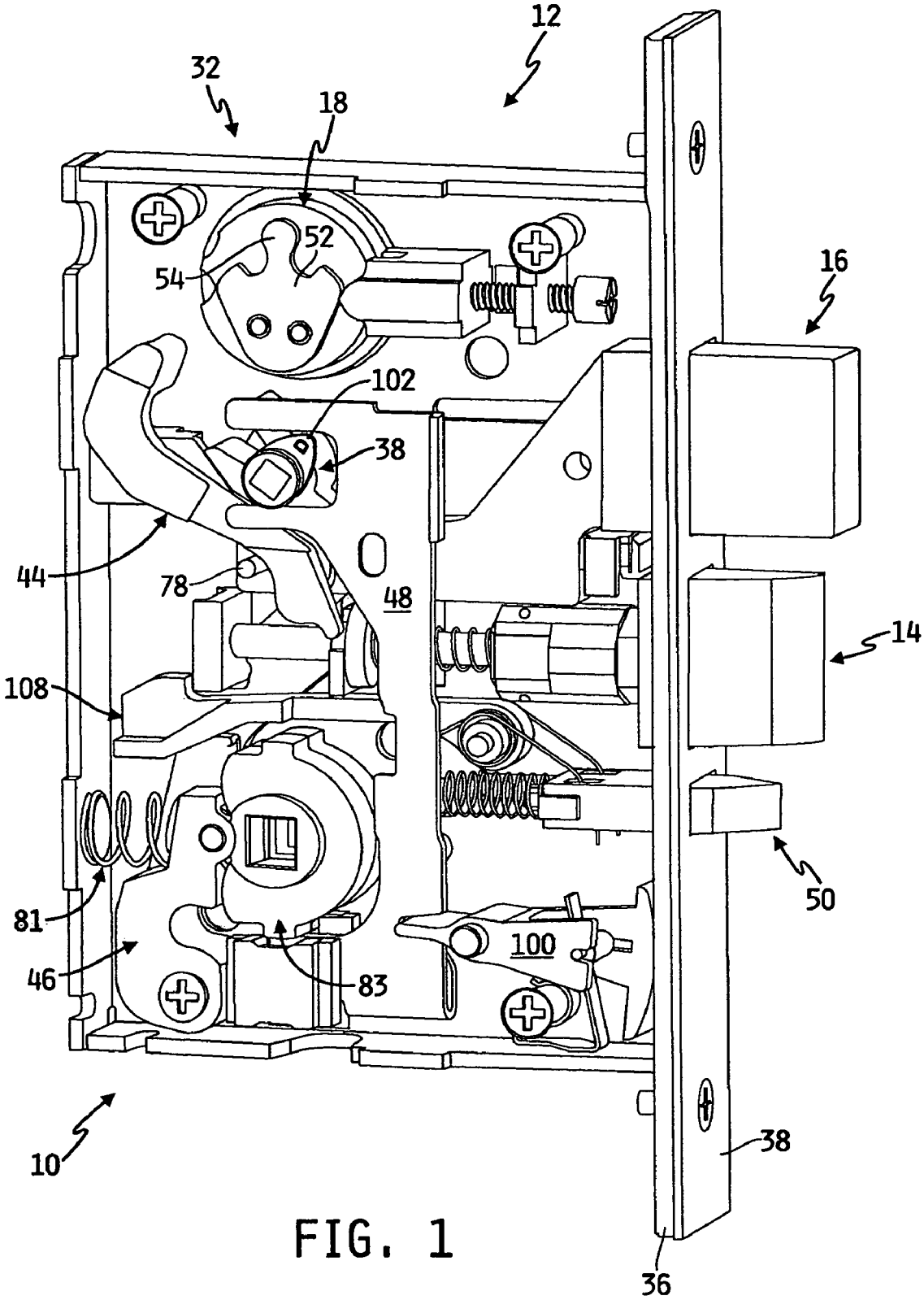
FIG. 1 is perspective view of a mortise lock showing the lock including a case, a deadbolt extending from the case, a latch bolt extending from the case, an auxiliary bolt extending from the case, and numerous internal components positioned in the case.
Figure 8:
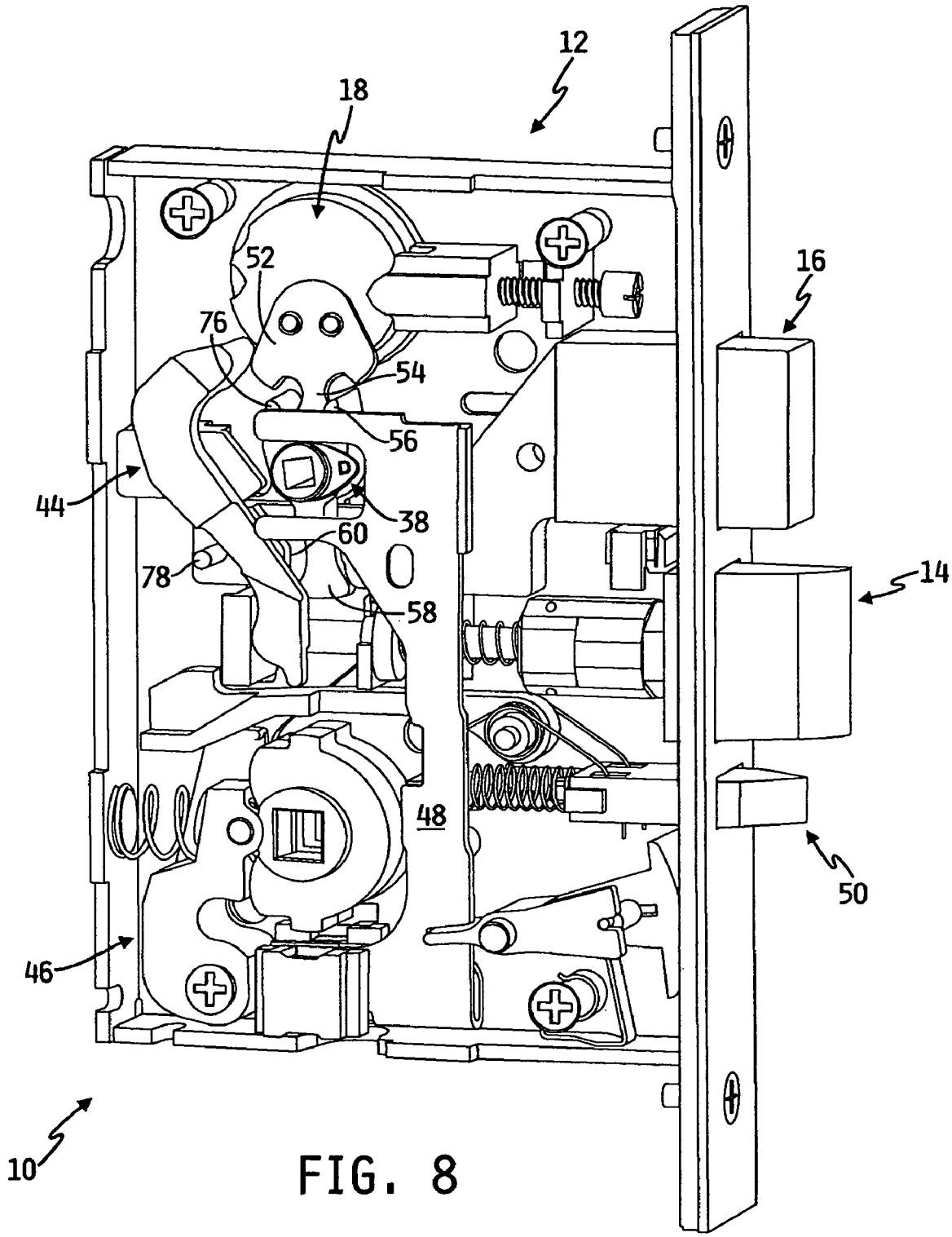
FIG. 8 is a view similar to FIG. 1 showing the latch bolt extending from the case and the deadbolt partially extending from the case.

As shown in FIG. 1, key and core assembly 18 further includes a cam 52 that rotates when a key is rotated in key and core assembly 18. When locked as shown in FIG. 1, a middle lobe 54 of cam 52 is in a vertical orientation. During unlocking, cam 52 rotates in a counter-clockwise direction as shown in FIG. 8, middle lobe 54 clears key release lever 44 and catches a right "ear" 56 of turn knob hub 38. Further rotation of cam 52 causes turn knob hub 38 to rotate clockwise to the position shown in FIG. 5. A lower arm 58 (see FIG. 8) of turn knob hub 38 is positioned in a slot 60 formed in deadbolt 16. During clockwise rotation of turn knob hub 38, lower arm 58 pushes deadbolt 16 to the left and retracts deadbolt 16 into chassis 12. As a result of the movement of deadbolt 16, a pin 78 on deadbolt 16 no longer holds key release lever 44 in the position shown in FIG. 1. Because pin 78 no longer blocks rotation of key release lever 44, gravity rotates key release lever 44 in a clockwise direction to the position shown in FIG. 5. Also if gravity does not move key release lever 44, a second lower arm 62 of turn knob hub 38 will contact key release lever 44 and causes it to rotate clockwise to the position shown in FIG. 5.

The user continues to rotate the key so that cam 52 rotates another revolution in a counter-clockwise direction. During this revolution, middle lobe 54 of cam 52 now catches key release lever 44 because of the previous rotation of key release lever 44 caused by turn knob hub 38. Continued rotation of cam 52 by the user causes a lower arm 64 of key release lever 44 to pull latch bolt 14 to the left and retracts latch bolt 14 into chassis 12. Middle lobe 54 of cam 52 does not clear key release lever 44 when latch bolt 14 is retracted.

Lock 10 may take on many different functions such as inner and outer door handle being locked at all times, unlocked at all times, or locked by key; use on a left-side or right-side opening door; and access or non-access through armored front 36 to a shuttle toggle lever 100 that can place mortise lock 10 in its unlocked or locked position.

Figure 15:
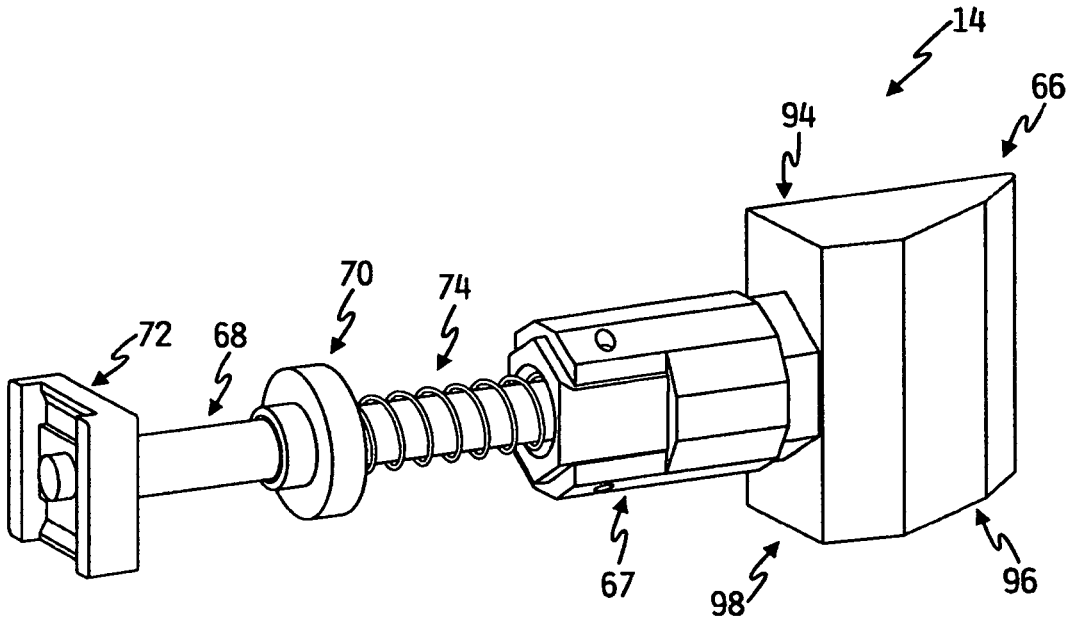
FIG. 15 is a perspective view of the latch bolt.
Figure 16:
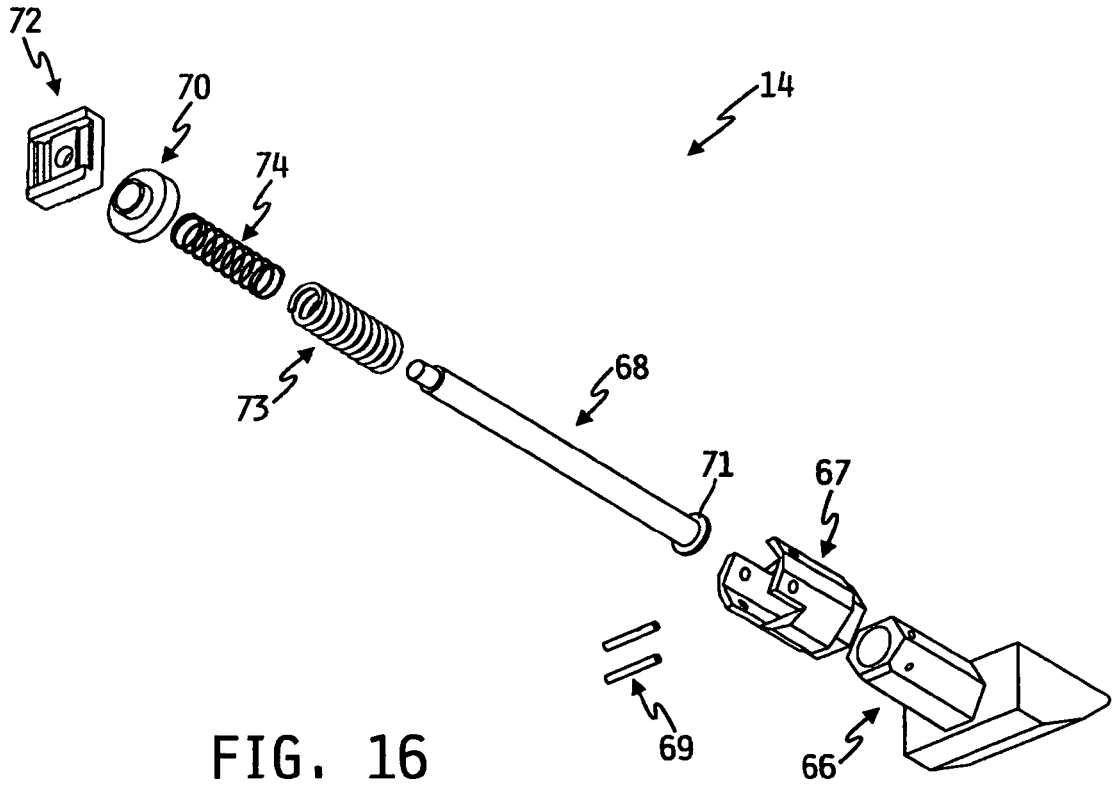
FIG. 16 is an exploded assembly view of the latch bolt.

The function of mortise lock 10 being used on a left-side or right-side opening door (doors that are hinged on left or right sides and swing in certain directions) is accomplished in two ways. The first way mortise lock 10 can accommodate left and right-handed doors is through its latch bolt 14 shown in FIGS. 15 and 16. Latch bolt assembly 14 includes metal latch bolt body 66, a plastic sleeve 67, connecting pins 69 coupling sleeve 67 to body 66, rod 68, spring support 70 coupled to rod 68, lever block 72 coupled to rod 68, spring 74 positioned around rod 68 and having one end connected to spring support 70 and another end positioned adjacent connecting pins 69, and spring 73 positioned around rod 68 between a head 71 of rod 68 and pins 69. Latch bolt body 66 includes a cavity that receives rod 68 and springs 74, 73 so that latch bolt body 66 can slide on rod 68. Spring 74 biases latch bolt 14 toward spring support 70. Preferably, sleeve 67 is made of DELRIN-brand plastic with a TEFLON-brand coating to reduce friction. According to alternative embodiments of the present disclosure, the latch bolt body is made of other materials known to those of ordinary skill in the art such as other plastics, steel, other metals, and other materials known to those of ordinary skill in the art. According to other alternative embodiments, other friction-reducing materials are provided such as dry graphite, molydag, PTFE, and other lubricates to coat the latch bolt body.

When a user releases the key, spring 74 urges latch bolt 14 back out of case body 32 and rotates key release lever 44 in a counter-clock wise direction. To throw deadbolt 16, cam 52 is rotated in a clockwise direction until it catches a left "ear" 76 of turn knob hub 38. This causes turn knob hub 38 to rotate counter-clockwise and lower arm 58 of turn knob hub 38 urges deadbolt 16 to the right to extend from case body 32 as shown in FIG. 1. A pin 78 on deadbolt 16 catches key release lever 44 and rotates it counter-clockwise so that middle lobe 54 of cam 52 does not catch key release lever 44 upon continued rotation of cam 52 in the clock-wise direction. In addition to exemplary latch bolt 14, other latch bolts known to those of ordinary skill in the art may be used with the locks disclosed herein including non-reversible latch bolts.

Figure 6:
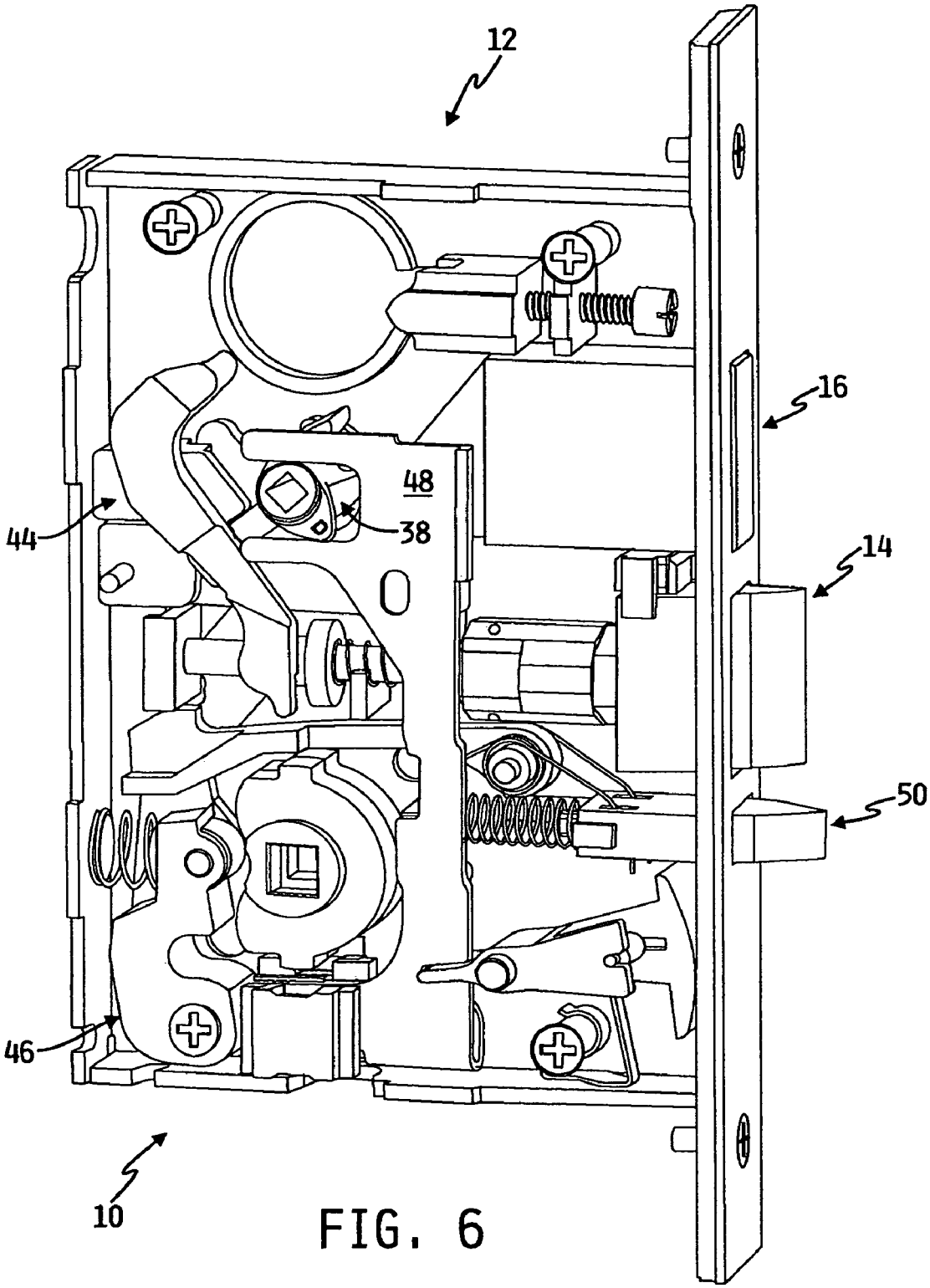
FIG. 6 is a view similar to FIG. 1 showing the latch bolt partially retracted into the case.
Figure 7:
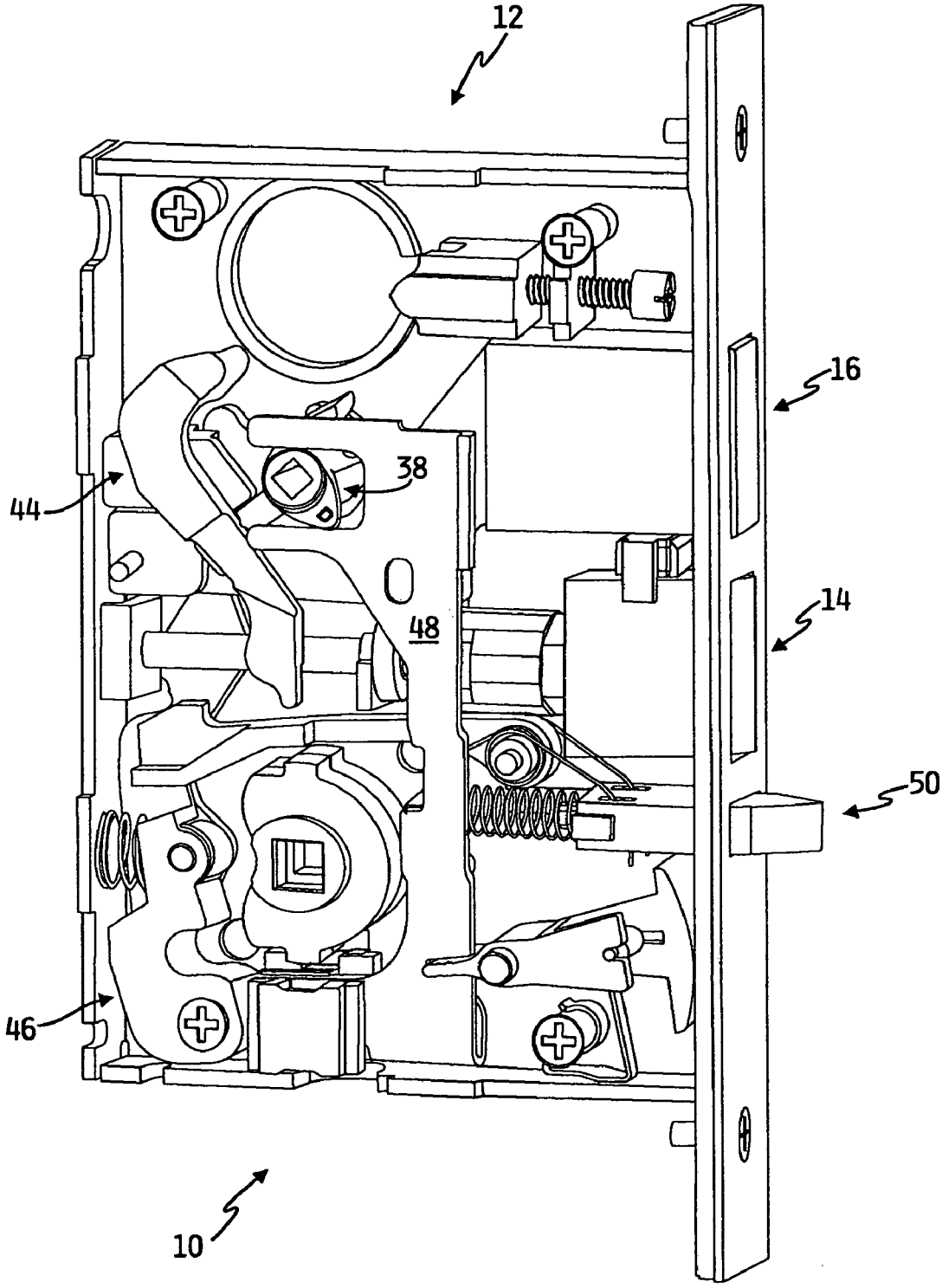
FIG. 7 is a view similar to FIG. 1 showing the latch bolt retracted into the case.

The function of the inner and outer door handles 24 being locked at all times, unlocked at all times, or locked by key is controlled by a split hub 83 including hubs 80, 82 and a pair of interactive members or toggles 84, 86 shown in FIGS. 11-14. Each hub 80, 82 includes a square-shaped opening 88 and lugs 90. Spindles 28, 28' of handle assembly 20, 21 are positioned in square-shaped openings 88 so that when spindles 28, 28' rotate, hub 80, 82 in which it is positioned may also be rotated. Rotation of either hub 80, 82 by either the inner or outer handle 24, causes handle release lever 46 to rotate in a counter-clockwise direction against the bias of spring 81 as shown in FIGS. 6 and 7. (Note that hubs 80, 82 are not shown rotated in either the clockwise or counter-clockwise direction in FIGS. 6 and 7 to show a roller on handle release lever 46, but normally will be rotated clockwise or counter-clockwise to push on the roller). Handle release lever 46 contacts lever block 72 and pulls latch bolt 14 to the left into chassis 12. When handle 24 is released, spring 81 and spring 30 rotates handle release lever 46 clockwise and spring 74 urges latch bolt 14 to the right to extend from chassis 12. According to alternative embodiments of the present disclosure, other configurations of handle release levers or links are provided to transfer inputs from hub 83 to latch bolt 14 including a link that slides along a linear path, separate links for each hub 80, 82 or any other known configurations for transferring inputs to latch bolt 14.

The exemplary hub 83 of the present disclosure rotates relative to chassis 12 to receive and transfer rotational inputs from handles 24. According to alternative embodiments of the present disclosure, other hub configurations are provided that move linearly or otherwise to accept inputs from handles 24, other handle configurations known to those of ordinary skill in the art, and other types of user inputs.

Whether hubs 80, 82 may be rotated by spindle 28 is dictated by whether the respective lugs 90 of hub 80, 82 is positioned in a cavity 92 formed in the respective toggles 84, 86. As shown in FIGS. 11-14, a lug 90 of a respective hub 80, 82 may be positioned in a cavity of toggles 84, 86, and when so positioned, the respective hub 80, 82 is not permitted to rotate.

Figure 2:
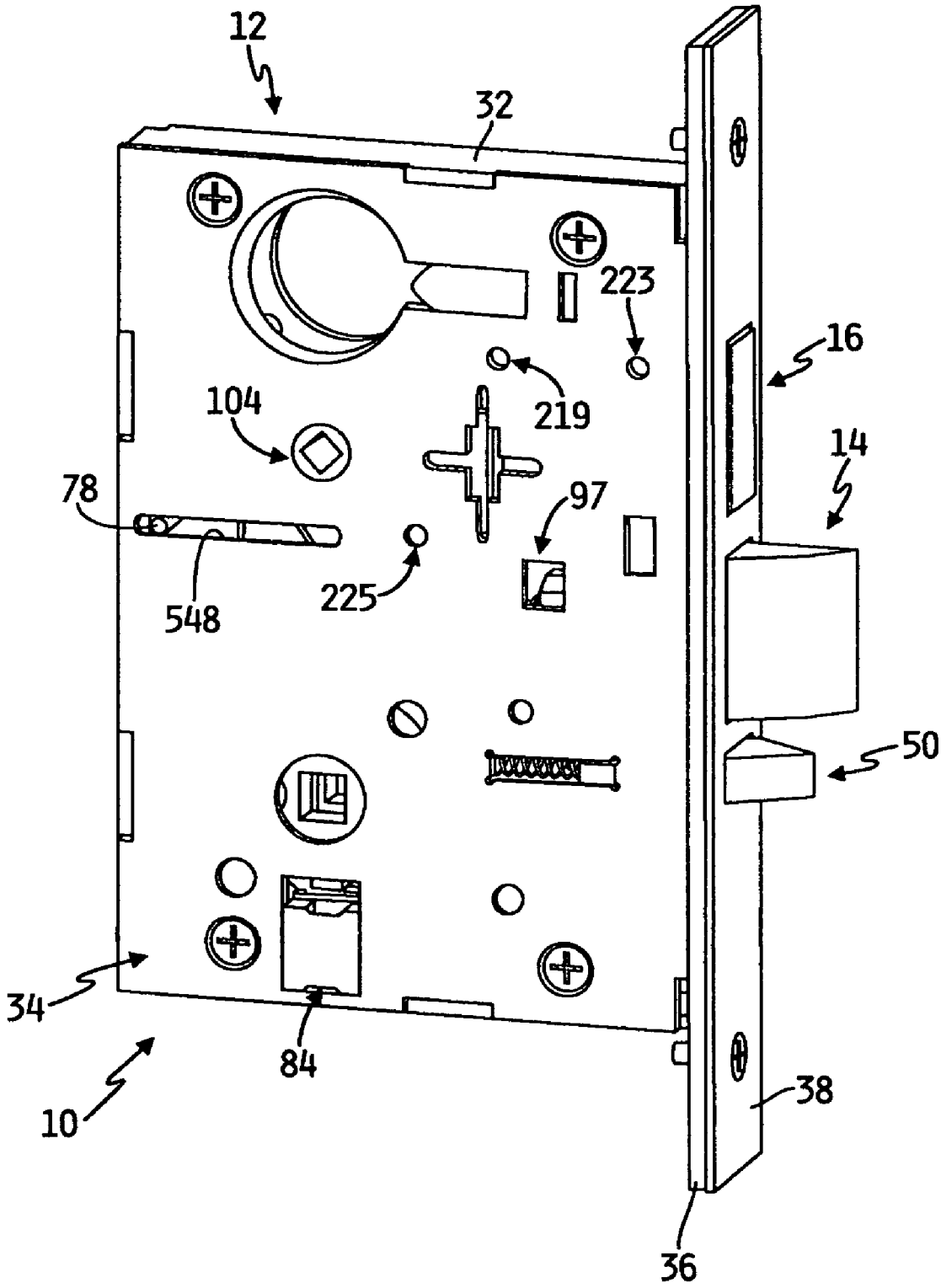
FIG. 2 is a view similar to FIG. 1 showing a cover positioned on the case to cover the internal components.
Figure 3:
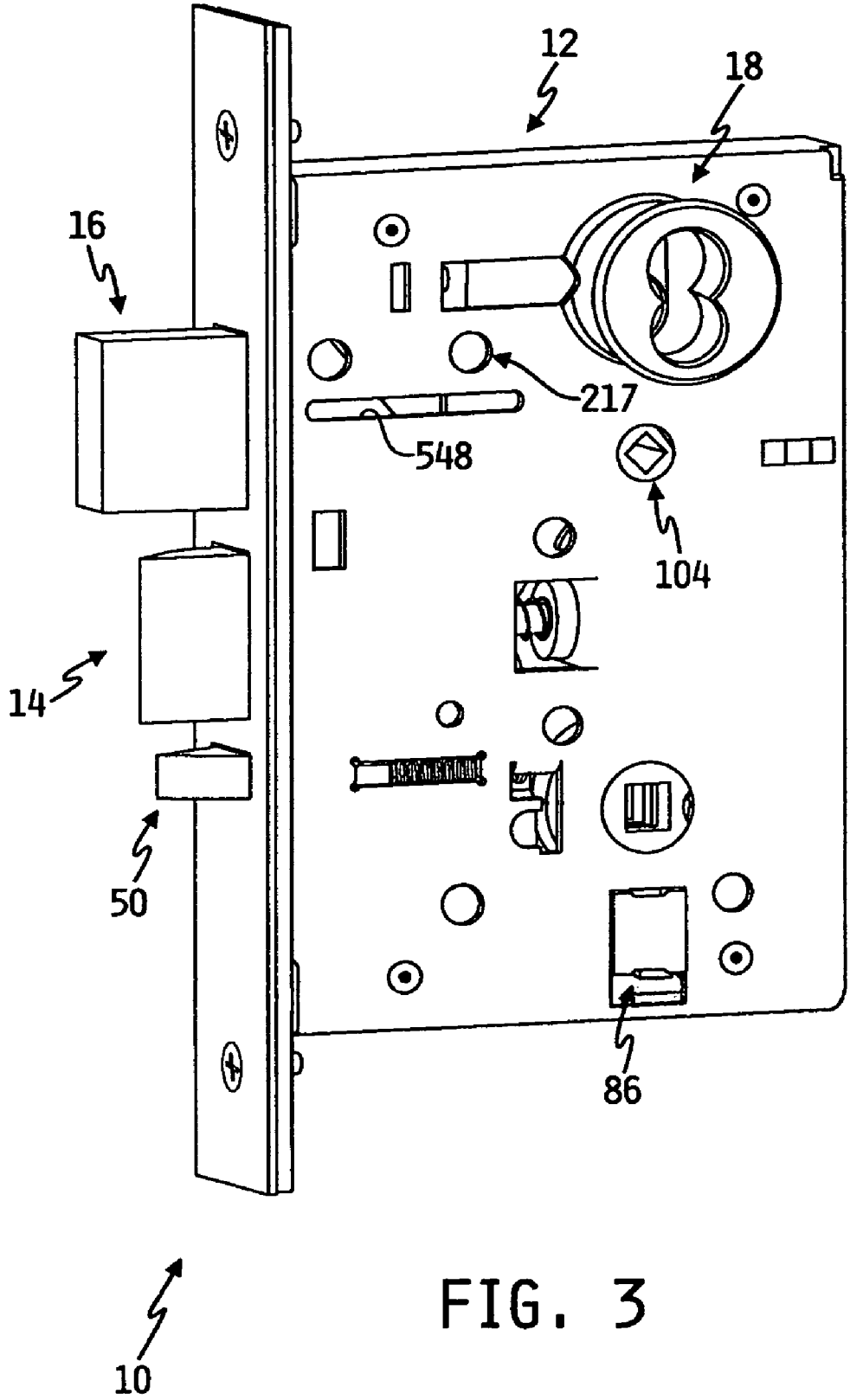
FIG. 3 is a perspective view of a back side of the lock of FIG. 1.
Figure 4:
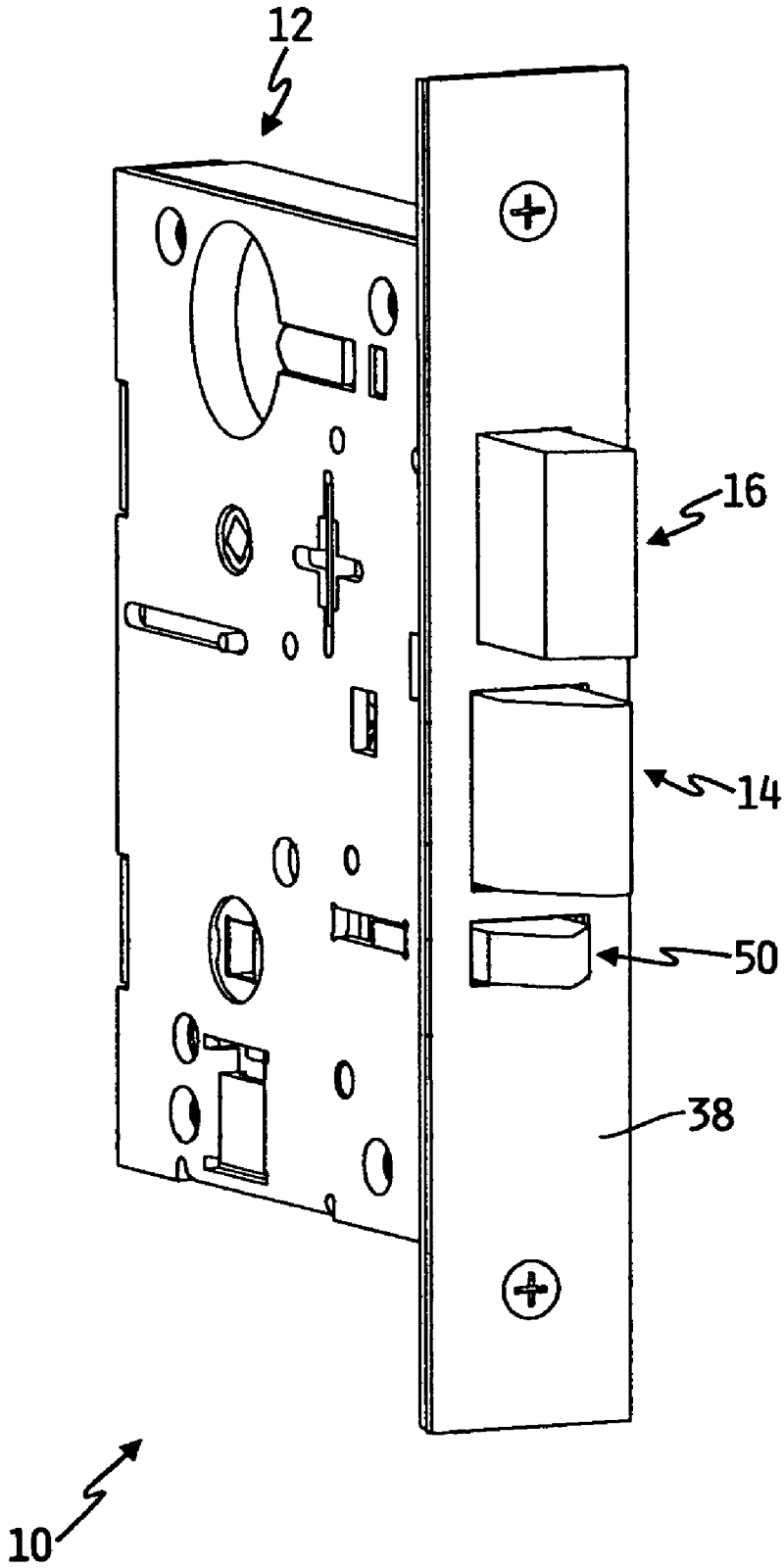
FIG. 4 is a perspective view of the front of the lock of FIG. 1.

As shown in FIGS. 2 and 3, toggles 84, 86 are accessible from outside cover 34 and case body 32, respectively. By sliding toggles 84, 86 up and down locking lever 48 from outside cover 34 and case body 32, a user may change the position of toggles 84, 86, and thus, the function of whether inner and outer handles 24 are locked or unlocked by a key or toggle lever 100. The adjustment of toggles 84, 86 can be accomplished without removing cover 34 from case body 32.

Exemplary shuttle or locking lever 48 is a single component that slides within chassis 12. According to alternative embodiments, other shuttle configurations are provided for changing the position of toggles 84, 86 including a shuttle for each toggle 84, 86 or a shuttle(s) that rotate(s) or otherwise moves relative to chassis 12.

Figure 17:
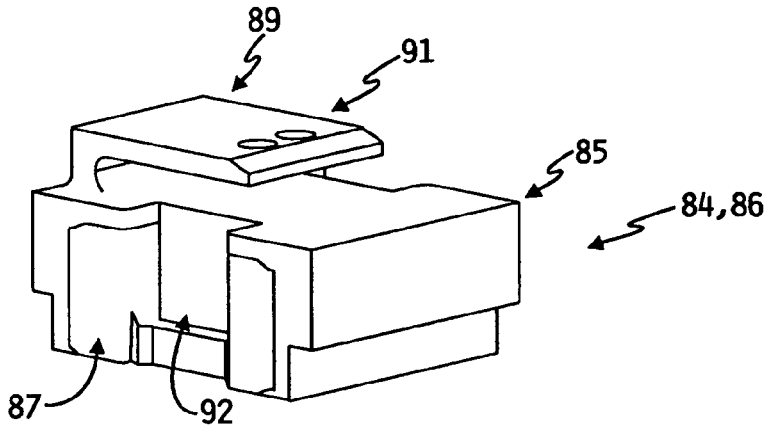
FIG. 17 is a perspective view of one of the first and second toggles of the lock of FIG. 1.
Figure 18:
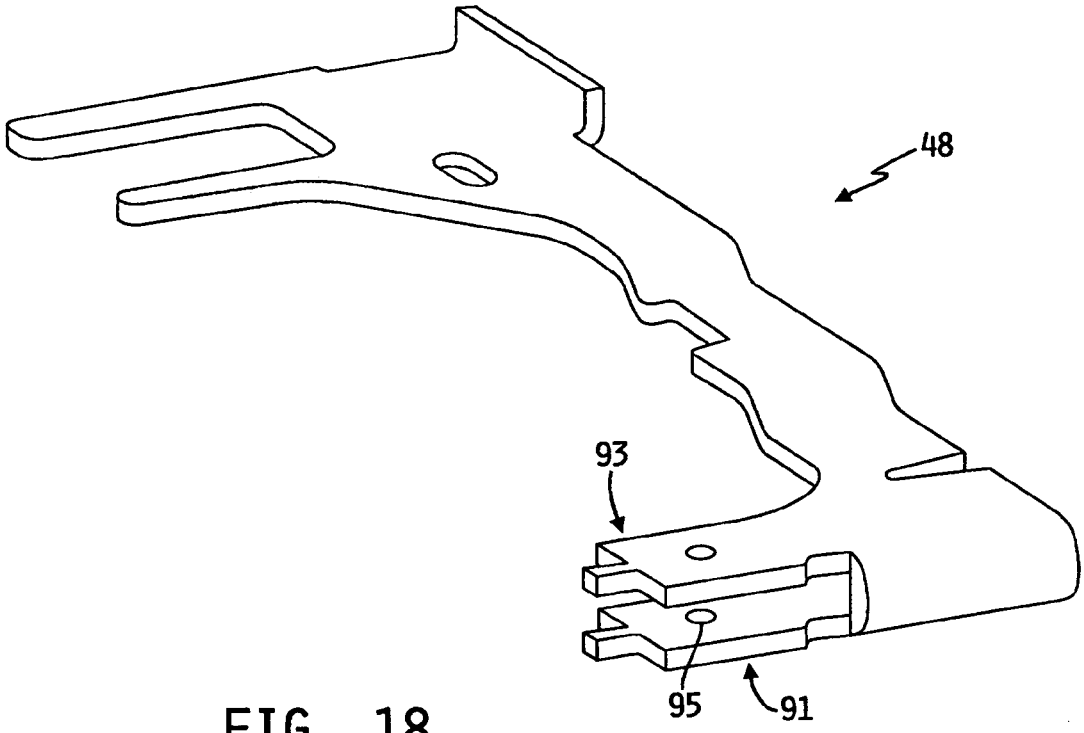
FIG. 18 is a perspective view of a locking lever of FIG. 1.

As shown in FIG. 17, toggles 84, 86 include a plastic body 85 and a metal insert 87 molded into body 85. Body 85 includes a clip 89 having a pair of apertures 91. As shown in FIG. 18, locking lever 48 includes a pair of lower arms 91, 93 that have inwardly facing dimples 95. During adjustment of the position of toggles 84, 86 up and down on arms 91, 93, dimples 95 move into either aperture 91 so that toggles 84, 86 have distinct raised and lowered positions on locking lever 48. According to alternative embodiments of the present disclosure, other locations and configurations of toggles or interactive members are provided that block or prevent the transfer of inputs from handles 24 to latch bolt 14 including positioning the toggles in other locations within chassis 12 to block movement of components other than hubs 80, 82 or disengaging components to prevent the transfer of inputs from one component to another so that even if one component moves, such as handles 24, hubs 80, 82, another component does not move, such as handle release lever 46 or latch bolt 14.

The direction a door opens dictates the orientation of latch bolt 14 within case body 32. The orientation at issue is that of a vertical face 94 and an opposing, inclined face 96 of latch bolt 14. For door 11 to close properly, inclined face 96 (as opposed to vertical face 94) of latch bolt 14 must engage the door jam so that the interaction between the door jam and inclined face 64 move latch bolt 14 to its retracted position. The orientation of the vertical and inclined faces 94, 96 can be adjusted by inserting a screw driver or similar tool into an opening 97 (see FIG. 2) in case body 32 or cover 34, using the tool to move latch bolt 14 against the bias of spring 73 until a rear surface 98 of latch bolt 14 is clear of armored front 36 (the face plate 38 is not mounted to armored front 36 when the orientation of latch bolt 14 is changed), rotating the latch bolt 14 180° to the proper orientation, and then removing the tool so that latch bolt 14 may retract into case body 32. This adjustment can also be made without removing cover 34 from case body 32.

The second way that mortise lock 10 is adjusted to be used on right-hand or left-hand doors is use of toggles 84, 86 to dictate whether the inner or outer handles 24 can be locked or unlocked. For example, often, inner handles 24 must be incapable of being locked and outer handles 24 capable of being locked. Moreover, in this example, assume that a mortise lock 10 is moved from a right-hand opening door to a left-hand opening door. In this situation, hub 80, 82 that was the inner hub is now the outer hub and hub 80, 82 that was the outer hub is now the inner hub. Thus, in this example, toggles 84, 86 are adjusted to change the functions of the respective hub 80, 82 to match the user's requirements for the inner and outer handles 24.

Figure 5:
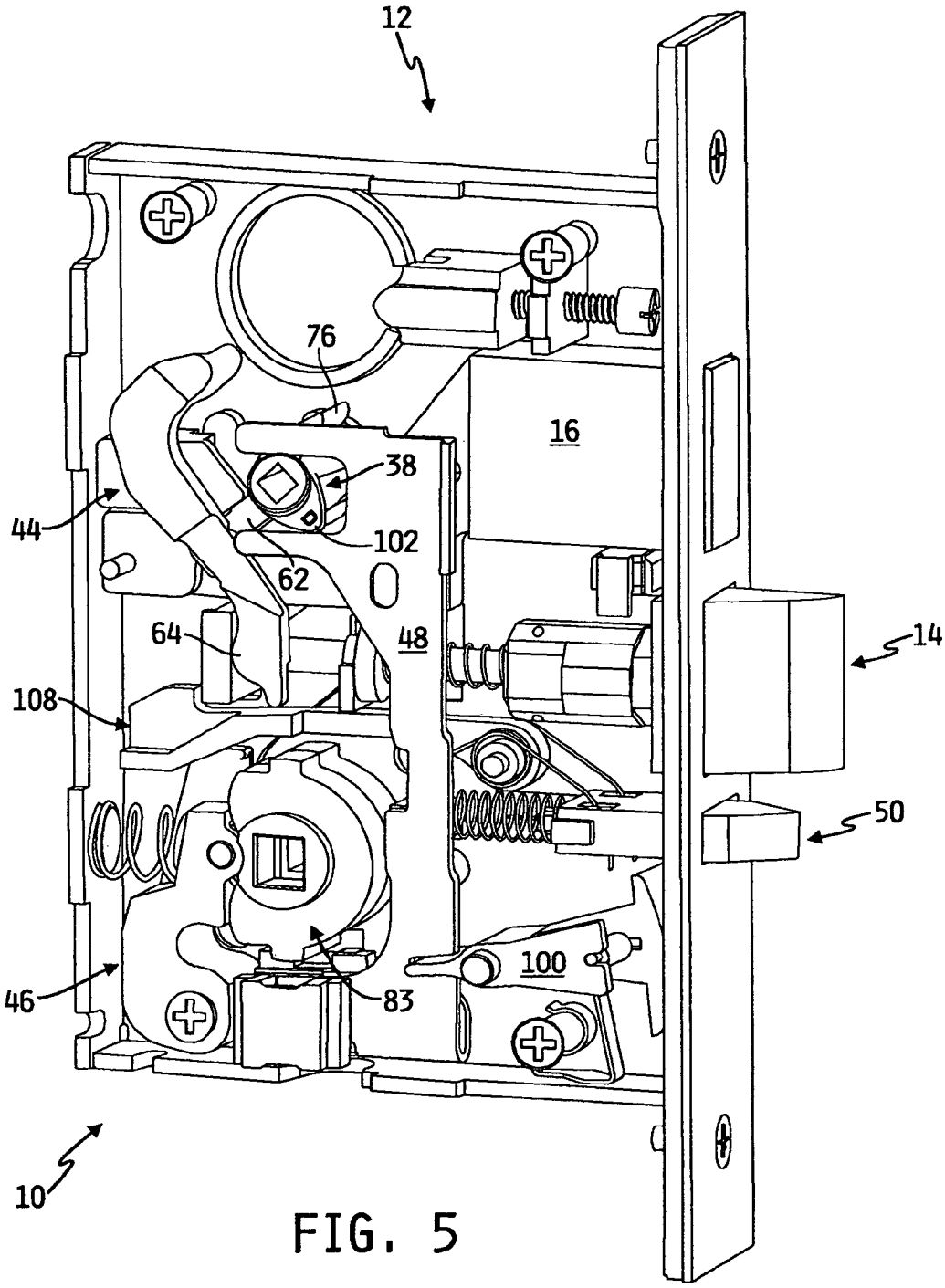
FIG. 5 is a view similar to FIG. 1 showing the deadbolt retracted into the case.

As shown in FIGS. 1 and 5, locking lever 48 may be actuated by a user through key and core assembly 18 and turn knob hub 38. As shown in FIG. 1, turn knob hub 38 includes a cam 102. When deadbolt 16 is thrown to the extended position by turn knob hub 38, cam 102 pushes locking lever 48 up as shown in FIG. 1. Depending on the position of toggles 84, 86 on locking lever 48, they may block movement of hubs 80, 82 as discussed above. When deadbolt 16 is retracted by turn knob hub 38, cam 102 pushes locking lever 48 down (as shown in FIG. 5) so that toggles 84, 86 (regardless of their position on locking lever 48), no longer block movement of handles 24.

Figure 21:
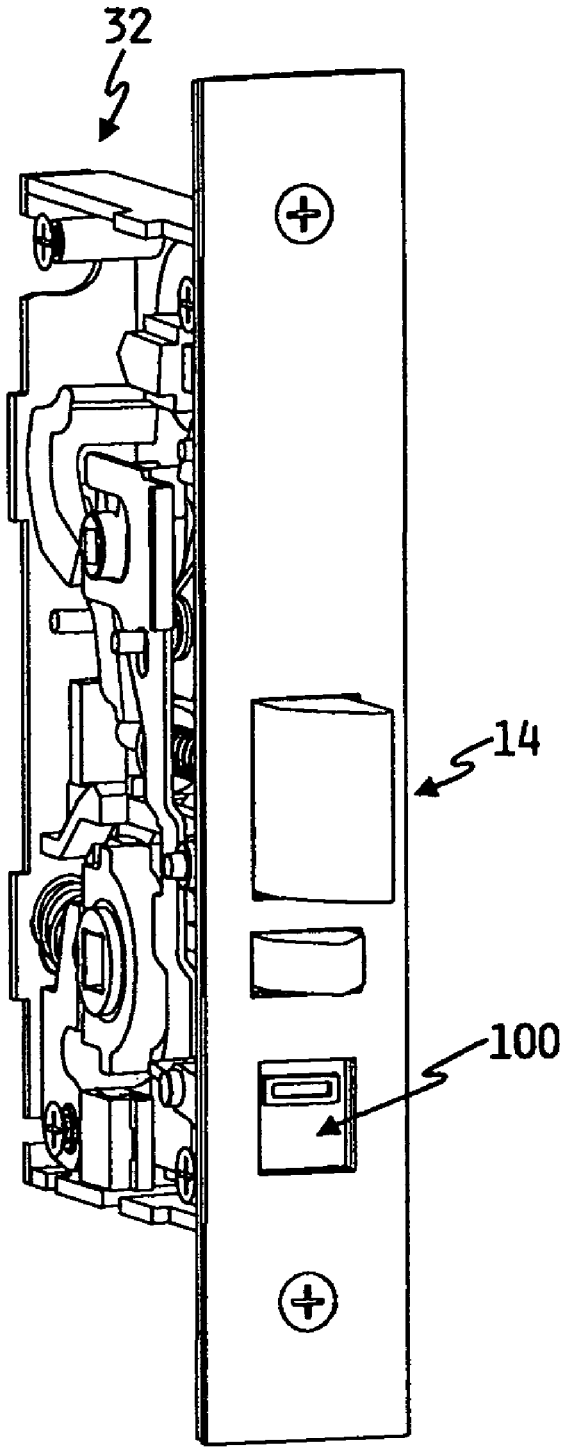
FIG. 21 is a perspective view of the front of the lock of FIG. 19 showing a face plate providing access to a toggle lever.

According to an alternative embodiment, another faceplate is provided that provides access to toggle lever or toggle 100 to move locking lever 48 up and down without using key and core assembly 18. An example of a faceplate that provides access to toggle lever 100 is shown in FIG. 21. (Note that an opening for deadbolt 16 will also be provided as necessary). When a user pushes up on toggle lever 100, locking lever 48 is pushed down. Regardless of the position of toggles 84, 86 on locking lever 48, they will not block movement of hubs 80, 82 so that both inner and outer handles 24 may be used to move latch bolt 14. When a user pushes down on toggle lever 100, locking lever 48 is pushed up. Depending on the position of toggles 84, 86 on locking lever 48, they may or may not block movement of hubs 80, 82 so either or both of inner and outer handles 24 are not enabled.

When access is provided to toggle lever 100, turn knob hub 38 does not include cam 102 so that movement of turn knob hub 38 during retraction and extension of deadbolt 16 does not move locking lever 48 and the cam 102 does not block movement of locking lever 48. Indicia are provided on the face of toggle lever 100 that can be seen by a user through the access aperture provided on the faceplate. An "open" lock indicia showing a padlock with an open shank (see FIG. 21) is visible when toggle lever 100 is rotated up and a "closed" lock indicia showing a padlock with a locked or closed shank is visible when toggle lever 100 is rotated down. Exemplary toggle lever 100 pivots within chassis 12. According to alternative embodiments of the present disclosure, the toggle lever slides linearly or otherwise moves in chassis 12 to adjust the position of shuttle or locking lever 48. Exemplary shuttle or locking lever 48 slides linearly within chassis 12. According to alternative embodiments, the shuttle pivots relative to chassis 12. Additionally, multiple shuttles or locking levers may be provided operated by multiple toggle levers accessible through the chassis front, with a key, and/or a turn knob 25.

Lock 10 further includes auxiliary bolt 50 that prevents latch bolt 14 from being forced or pushed in when door 11 is closed. When door 11 is closed, auxiliary bolt 50 is forced inward. This movement winds springs 106 coupled to auxiliary bolt 50. Springs 106 then rotate a deadlocking lever 108 clockwise and a hook 109 on deadlocking lever 108 blocks movement of lever block 72 to the left so that latch bolt 14 cannot be forced or pushed into case body 32.

When a user opens door 11 with a key, deadlocking lever 108 is rotated counter-clockwise by lower arm 64 of key release lever 44 so that deadlocking lever 108 is no longer blocking latch bolt 14. Similarly, when handle release lever 46 is rotated by a handle 24, deadlocking lever 108 is moved out of the way of latch bolt 14 by a lug or ramp 47 on handle release lever 46 that pushes down on a corresponding lug or ramp (not shown) on the back of deadlocking lever 108. In addition to exemplary auxiliary bolt 50, other auxiliary bolts known to those of ordinary skill in the art may also be used with the locks disclosed herein.

Mortise lock 10 may also include thumb turn cylinders (not shown) in place of key cylinders that are positioned in an opening 110 in case body 32 and cover 34. That is, depending on its required function, mortise lock 10 may include two key cylinders, two thumb turn cylinders, or a key cylinder and thumb turn cylinder.

The cylinders are secured or held in place by a cylinder retainer 112 that includes a mounting plate 114, a screw 116 that extends through mounting plate 114, and a contact member 118 mounted on screw 116. Contact member 118 includes a V-shape, with the line of the V-shape engaging the cylinders. The head of screw 116 is accessible through a hole in the armored front 36 so that a user may adjust the position of contact member 118 relative to the cylinders, and thus, the amount of force exerted by contact member 118 on the cylinders. This single screw 116 is adjusted to fix the position of two cylinders in mortise lock 10.

Figure 22:
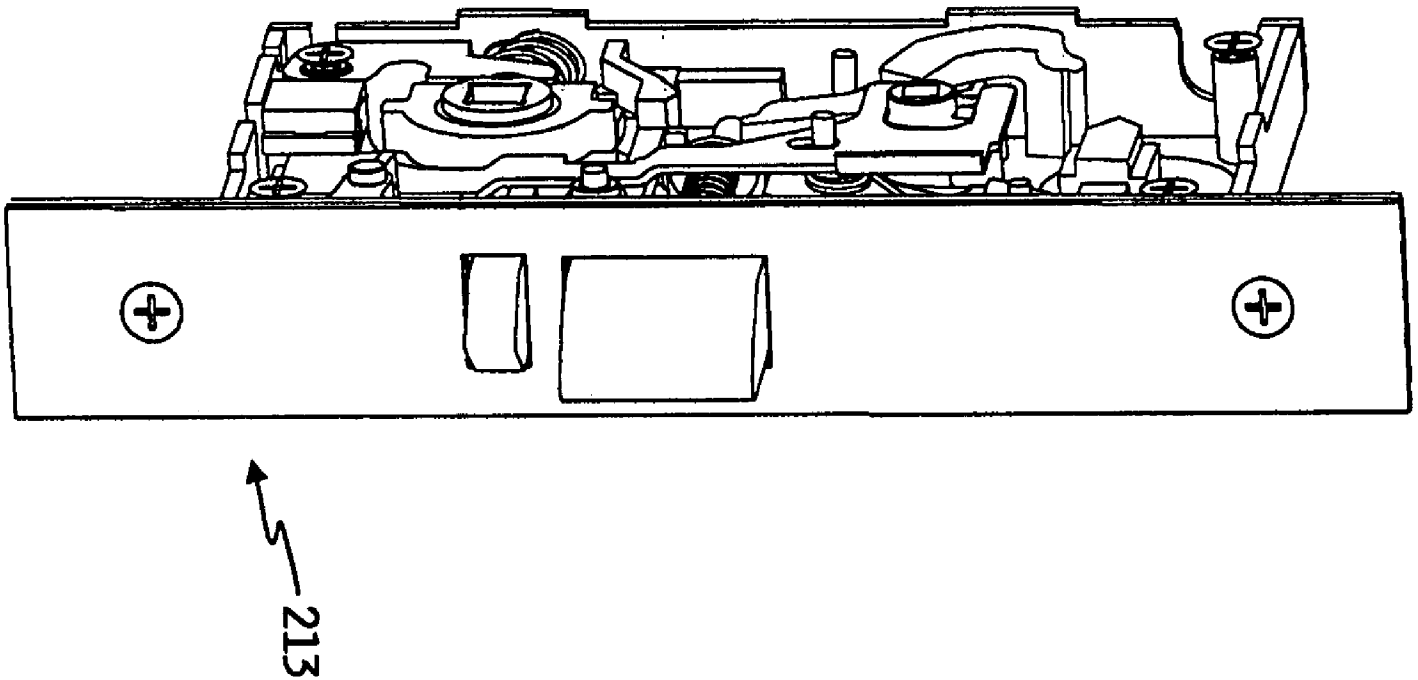
FIG. 22 is a view similar to FIG. 21 showing a face plate blocking access to the toggle lever.
Figure 23:
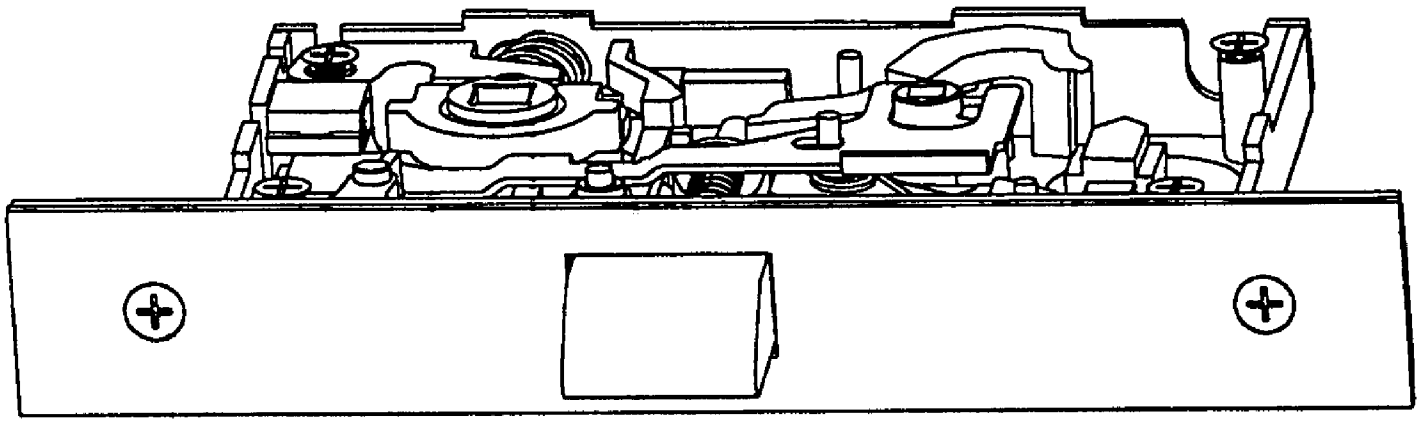
FIG. 23 is a view similar to FIG. 21 showing a face plate for a mortise lock not providing an auxiliary bolt and blocking access to the toggle lever.

Another lock 210 is shown in FIGS. 19-27*d*. Lock 210 is similar to lock 10 and includes many similar or identical components. Some components of lock 210 that are similar or identical to components of lock 10 use identical reference numbers. Depending on the particular door in a building, either lock 10 or lock 210 may be provided. For example, if the particular door needs a deadbolt function, lock 10 is provided rather than lock 210. If the particular door does not need an auxiliary bolt function, then a faceplate as shown in FIG. 23 is provided so that auxiliary bolt 50 does not extend through the faceplate. If access to toggle lever 100 is not needed, a faceplate blocking access to toggle lever 100 is provided as shown in FIGS. 1, 22, and 23.

Like lock 10, lock 210 can be adjusted into many different configurations or functions including but not limited to an office function (ANSI F04), a storeroom function (ANSI F07), a classroom function (ANSI F05), a passage function (ANSI F01), a privacy function (ANSI F22), and an exit function (ANSI F31). Each of these functions is defined by ANSI standards (shown in parenthesis) for the defined operation of a mortise lock.

In one configuration of lock 210, it performs the "office" function in which latch bolt 14 is retracted by either of handles 24 unless one of handles 24 is locked through the operation of an accessible toggle, such as toggle lever 100, a key operates to unlatch latch bolt 14, and no functional deadbolt is provided. In another configuration of lock 210, it performs the "storeroom" or service function in which latch bolt 14 is retracted by an inside handle 24 or a key, the outside handle 24 is locked at all times, and there is no functional deadbolt. In another configuration of lock 210, it performs the "classroom" function in which latch bolt 14 is retracted by either of handles 24 unless outside handles 24 is locked through operation of an key, the inside handle 24 is always unlocked, and there is no deadbolt. In another configuration of lock 210, it performs the "passage" function in which each handle 24 is always unlocked and there is no deadbolt. In another configuration of lock 210, it performs a "privacy" function in which latch bolt 14 is retracted by inside handle 24 or an outside handle 24 when an inside turn knob 25 unlocks outside handle 24 and there is no deadbolt. In another configuration of lock 210, it performs an "exit" function in which inside handle 24 is always unlocked and outside handle 24 is always locked, there is no deadbolt, and there is no key and core assembly 18.

In lock 210, the preferred method for changing the configuration of lock 210 is through controlling the adjustment of shuttle or locking lever 48. According to a first configuration or state of lock 210 to perform the classroom function, the position of locking lever 48 is controlled by a user using key and core assembly 18. According to a second configuration or state of lock 210 to perform the storeroom function, the position of locking lever 48 is fixed in the raised position. According to a third configuration or state of lock 210 to perform the passage function, the position of locking lever 48 is fixed in the lowered position. According to a fourth configuration or state to perform the office function, the position of locking lever 48 is controlled by toggle lever 100. The configuration of lock 210 providing the privacy function is similar to the configuration of the classroom function, but an inside lever or knob 25 is provided to control the position of locking lever 48. The configuration of lock 210 providing the exit function is similar to the configuration for the storeroom function, but no key and core assembly 18 is provided.

Figure 19:
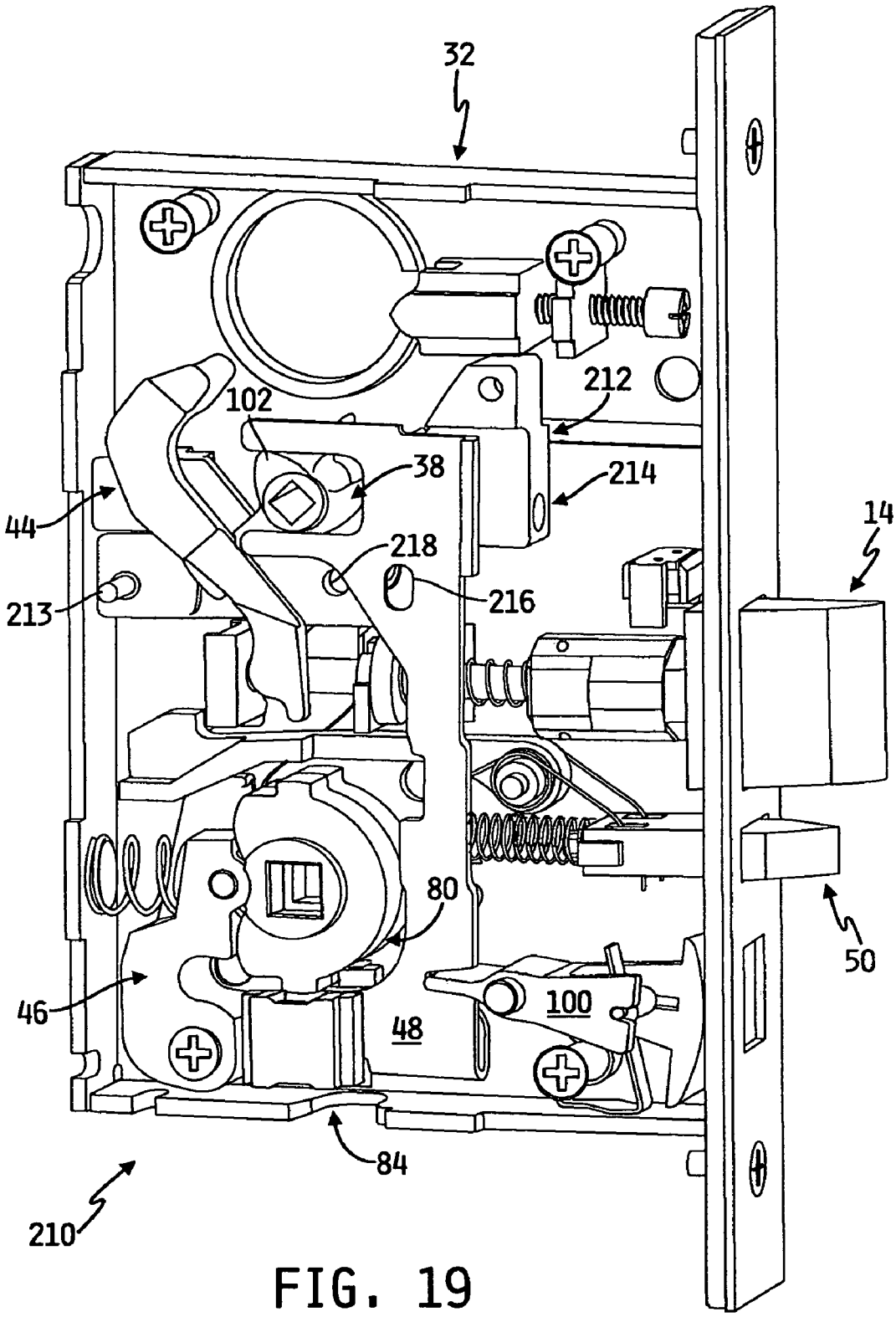
FIG. 19 is perspective view of another mortise lock showing the lock including a case, a latch bolt extending from the case, an auxiliary bolt extending from the case, and numerous internal components positioned in the case.
Figure 20:
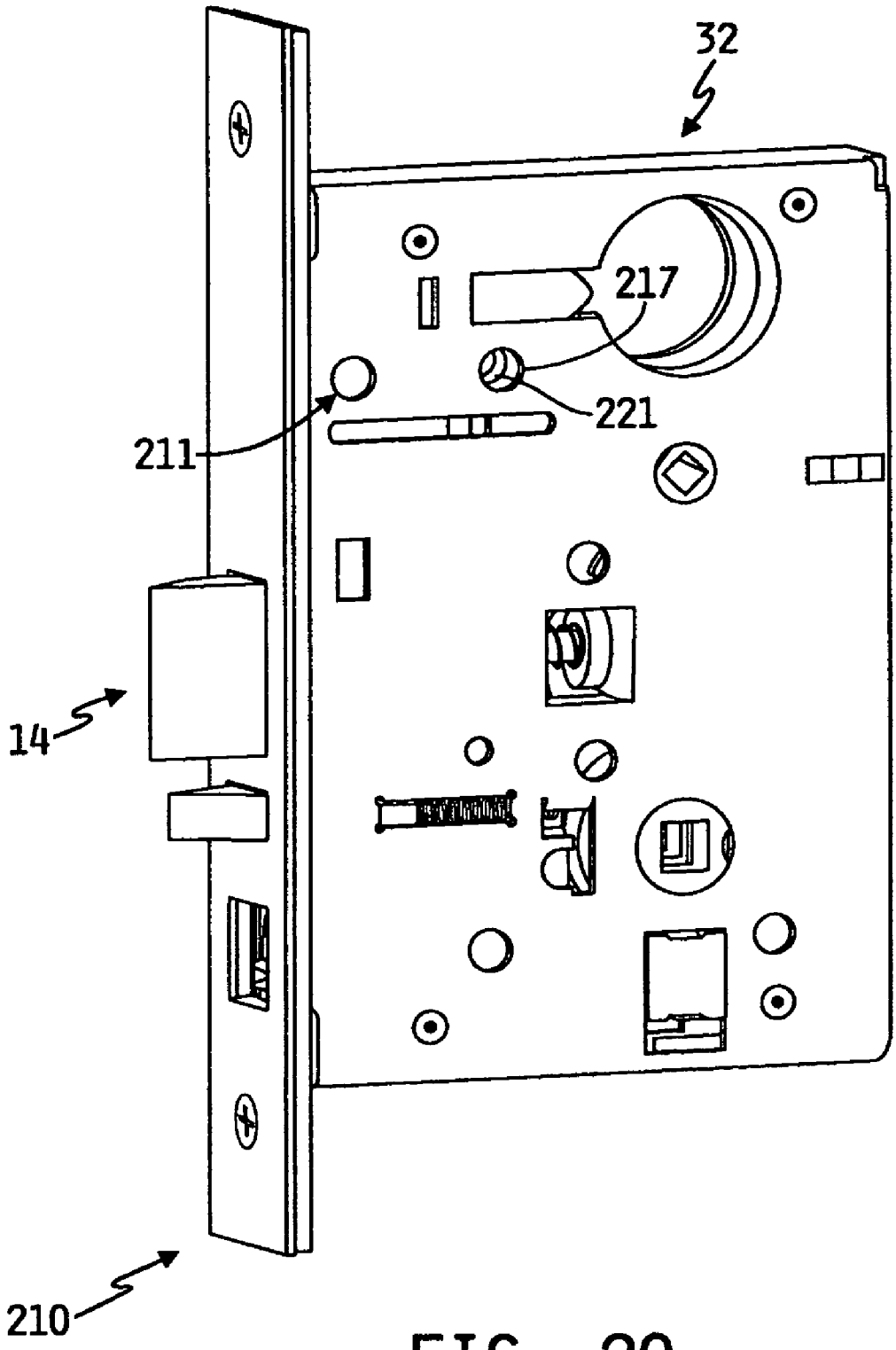
FIG. 20 is a perspective view of a back side of the lock of FIG. 19.

Unlike lock 10, lock 210 does not include a deadbolt, but includes a shuttle 212 that slides in case body 32. When the first configuration is selected to perform the classroom function, a screw 214 is stored in shuttle 212 and does not limit movement of shuttle 212. Initially, lock 210 is in a "locked" position with shuttle 212 in a left-most position and key release lever 44 in a clockwise position as shown in FIG. 19. Screw 214 is accessible through aperture 57 (shown in FIG. 27*b*) in chassis 12 through which the deadbolt would otherwise extend.

When the user rotates a key and cam 52 counter-clockwise, middle cam 54 engages key release lever 44 to retract latch bolt 14 and permit opening of door 11. Because locking lever 48 is in the raised position, handles 24 are enabled or disabled depending on the position of toggles 84, 86 on locking lever 48. Thus, depending on the position of toggles 84, 86, inner and/or outer handle 24 may be used to retract latch bolt 14. Cam 102 (on the opposite side of turn knob hub 38 than for lock 10) on turn knob hub 38 blocks use of toggle lever 100 from adjusting the position of locking lever 48.

To move lock 210 to the "unlocked" position, a user uses key and core assembly 18 to rotate cam 52 in a clockwise direction. Cam 52 engages the left ear of turn knob hub 38. This rotates turn knob hub 38 in a counter-clockwise direction to the position shown in FIG. 24. During this rotation, turn knob hub 38 pushes shuttle 212 to the right and a pin 213 on shuttle 212 rotates key release lever 44 clockwise so that it can no longer be caught by cam 52. Also during this rotation, cam 102 of turn knob hub 38 pushes locking lever 48 down (as shown in FIG. 24) and disengages toggles 84, 86 from lugs 90 so that handles 24 can rotate hubs 80, 82 regardless of the position of toggles 84, 86 on locking lever 48.

To re-lock lock 210, the user rotates the key in the opposite direction so that cam 52 rotates turn knob hub 38 clockwise. Cam 102 of turn knob hub 38 pushes locking lever 48 up and engages toggles 84, 86 with lugs 90 to block rotation of hubs 80, 82 if toggles 84, 86 are in the selected positions. Turn knob hub 38 also rotates key release lever 44 clockwise to the position shown in FIG. 19 so that it can be caught by cam 52 to retract latch bolt 14 with a key. To provide the privacy function, screw 214 remains stored in shuttle 212 and a turn knob 25 is provided on the inside of door 11 that rotates knob hub 38. Knob 25 may be provided with lock 210 with or without a key and core assembly 18 that also operates latch bolt 14.

Figure 27A:
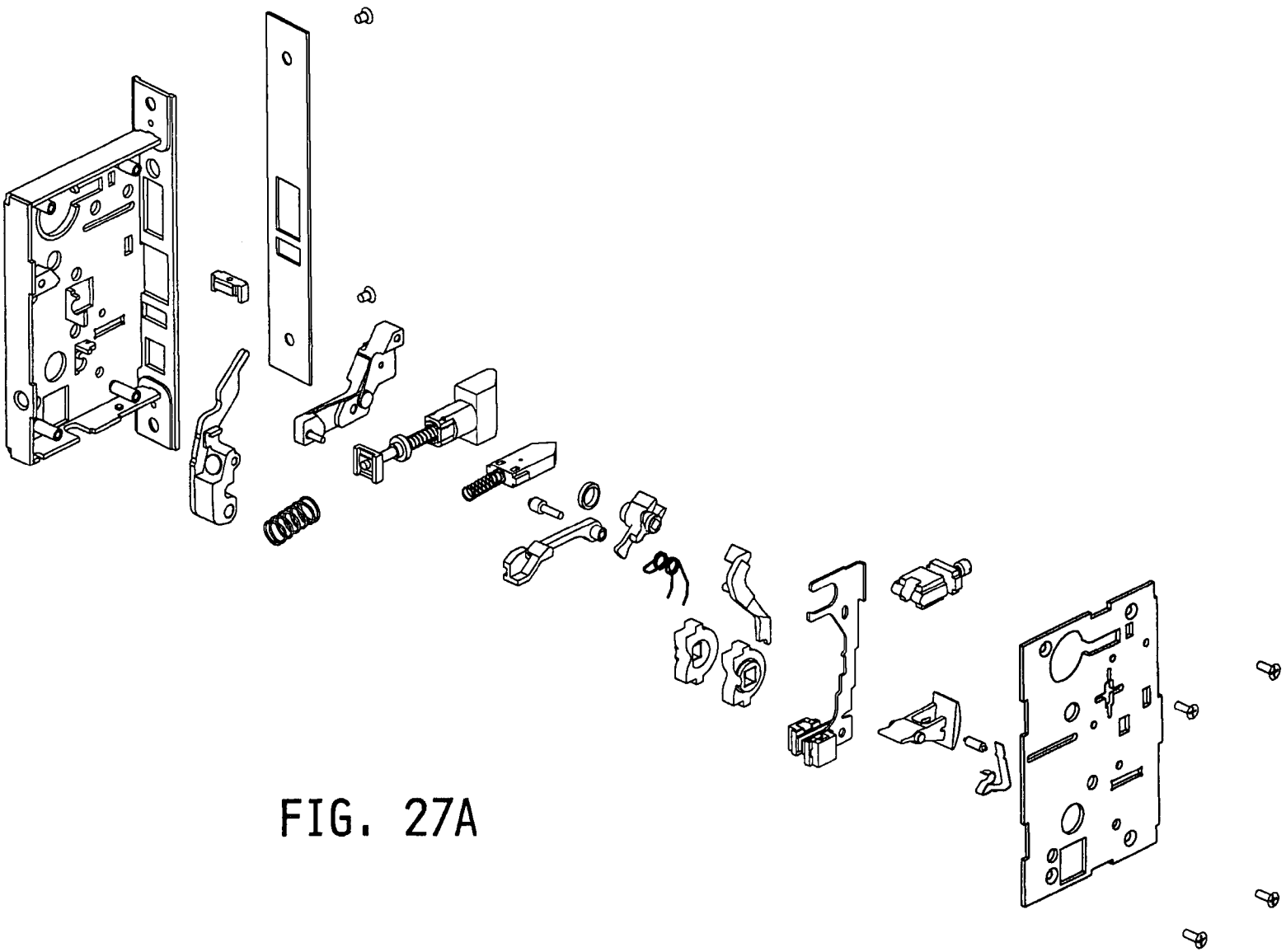
FIG. 27*a* is an exploded assembly view of the lock of FIG. 19.
Figure 27B:
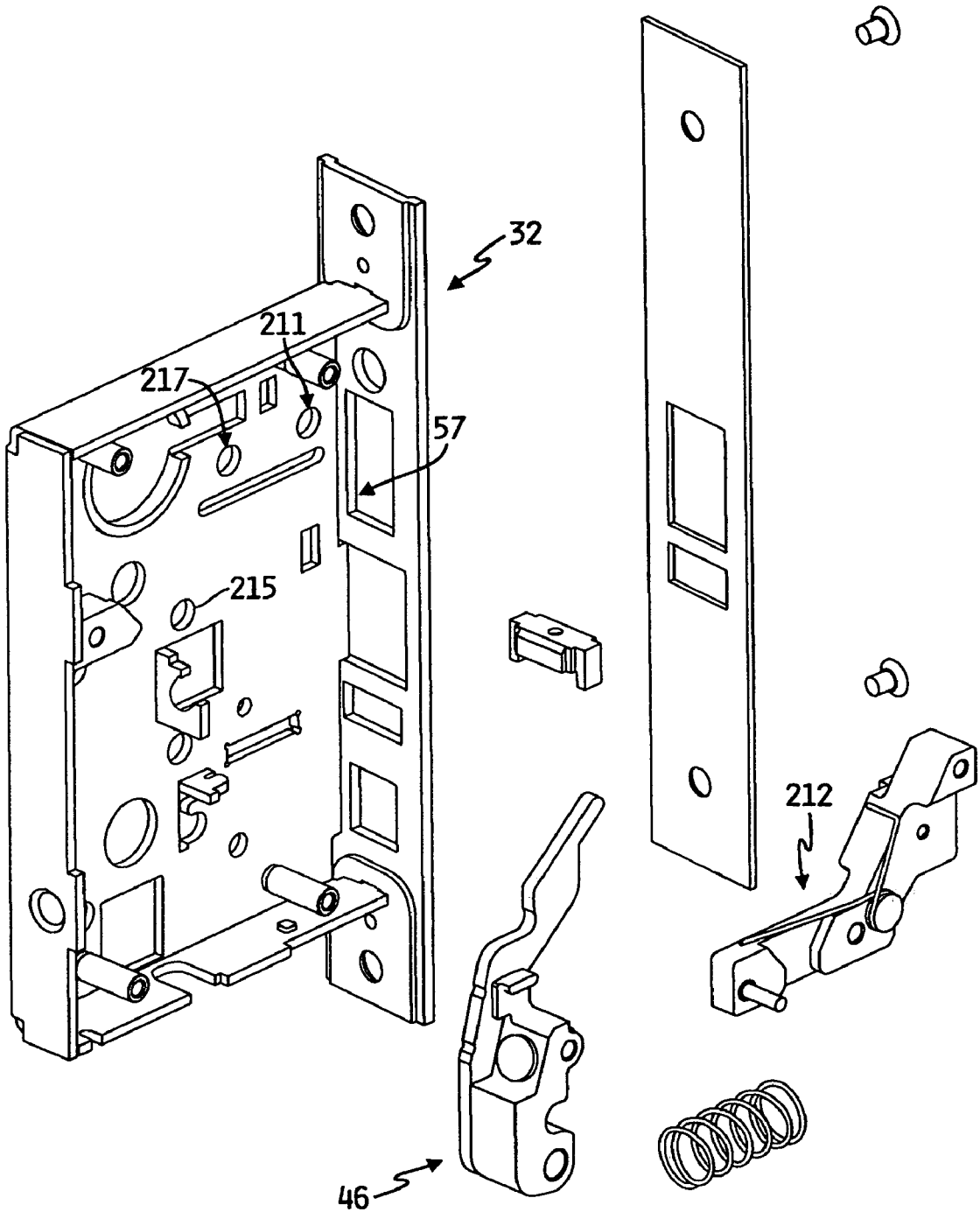
FIG. 27*b* is an enlarged view of a left portion of FIG. 27*a;*
Figure 27C:
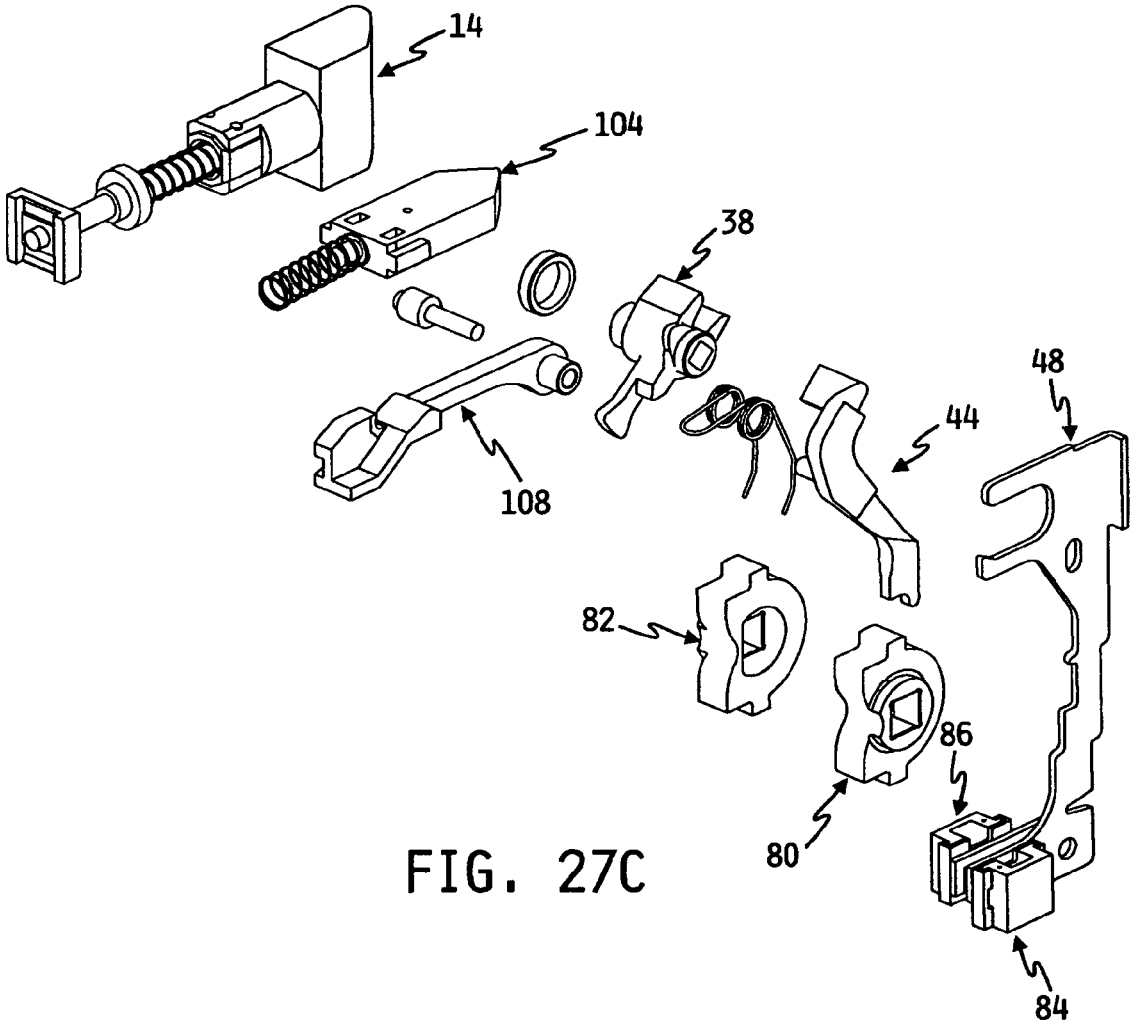
FIG. 27*c* is an enlarged view of a middle portion of FIG. 27*a;*
Figure 27D:
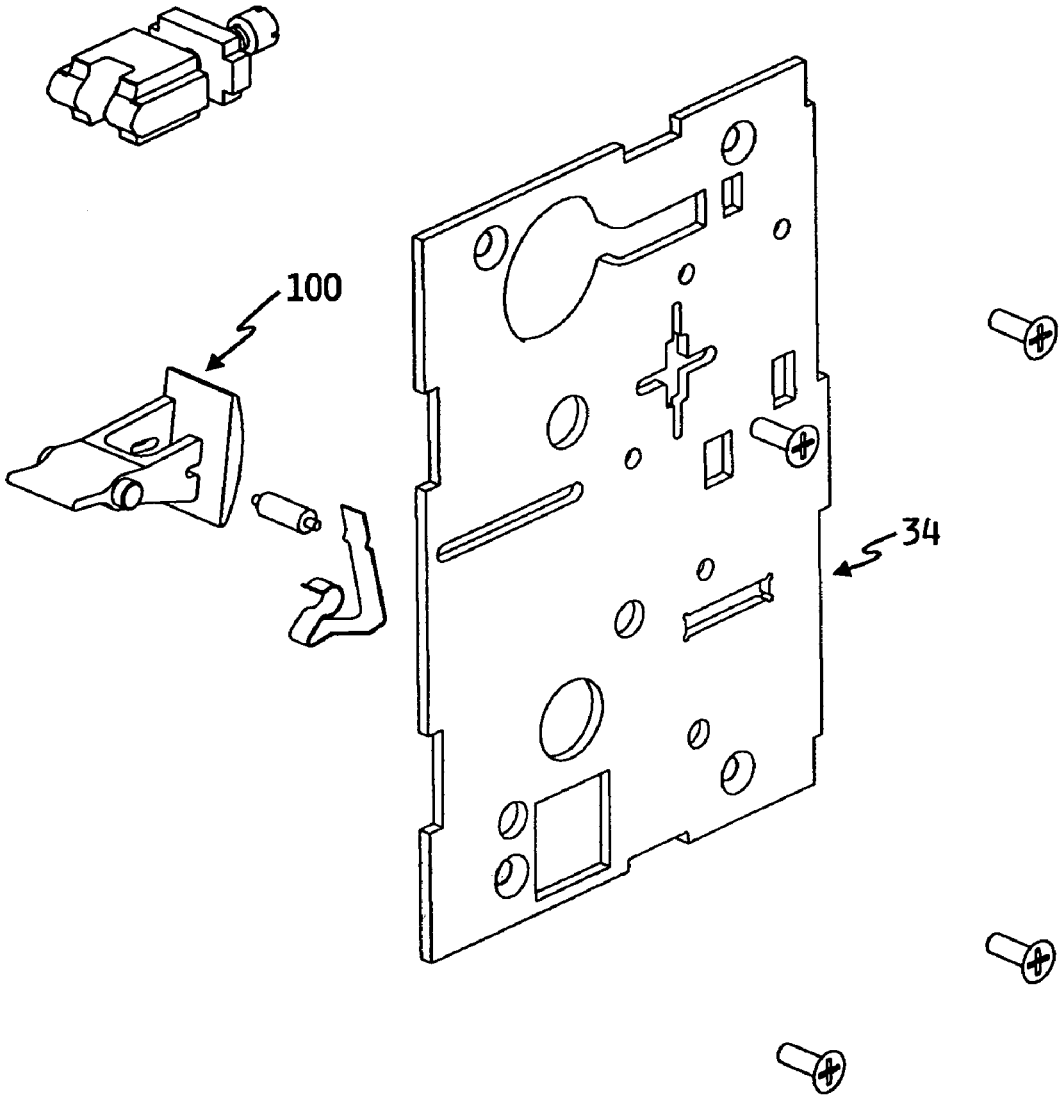
FIG. 27*d* is an enlarged view of a right portion of FIG. 27*a;*

When in the second configuration to perform the storeroom function, screw 214 is placed in aperture 221 (see FIG. 26) of shuttle 212 through a first apertures 217, 219 in cover plate 34 (see FIGS. 27*b* and 2) that is aligned with aperture 221 when shuttle 212 is in the left most position shown in FIG. 19. Screw 214 is threaded into aperture 221 by inserting it through first aperture 217 in case 32 until the bottom end of screw 214 extends through first aperture 219. When in this position, screw 214 blocks movement of shuttle 212. Screw 214 is threaded into aperture 221 through first aperture 217 in chassis 12 as shown in FIG. 27*b*. Because shuttle 212 is fixed, turn knob hub 38 will not rotate and cam 102 of turn knob hub 38 holds locking lever 48 in the raised position shown in FIG. 19. Toggles 84, 86 control use of handles 24 to retract latch bolt 14 and toggle lever 100 is blocked from moving locking lever 48 up and down. Typically, a face plate 213, as shown in FIG. 22, is provided that blocks access to toggle lever 100. An outside key and core assembly 18 is provided to permit moving latch bolt 14 to the unlatched position. To provide the exit function, screw 214 is placed in the same position as for the storeroom function. However, no key and core assembly 18 is provided.

Figure 24:
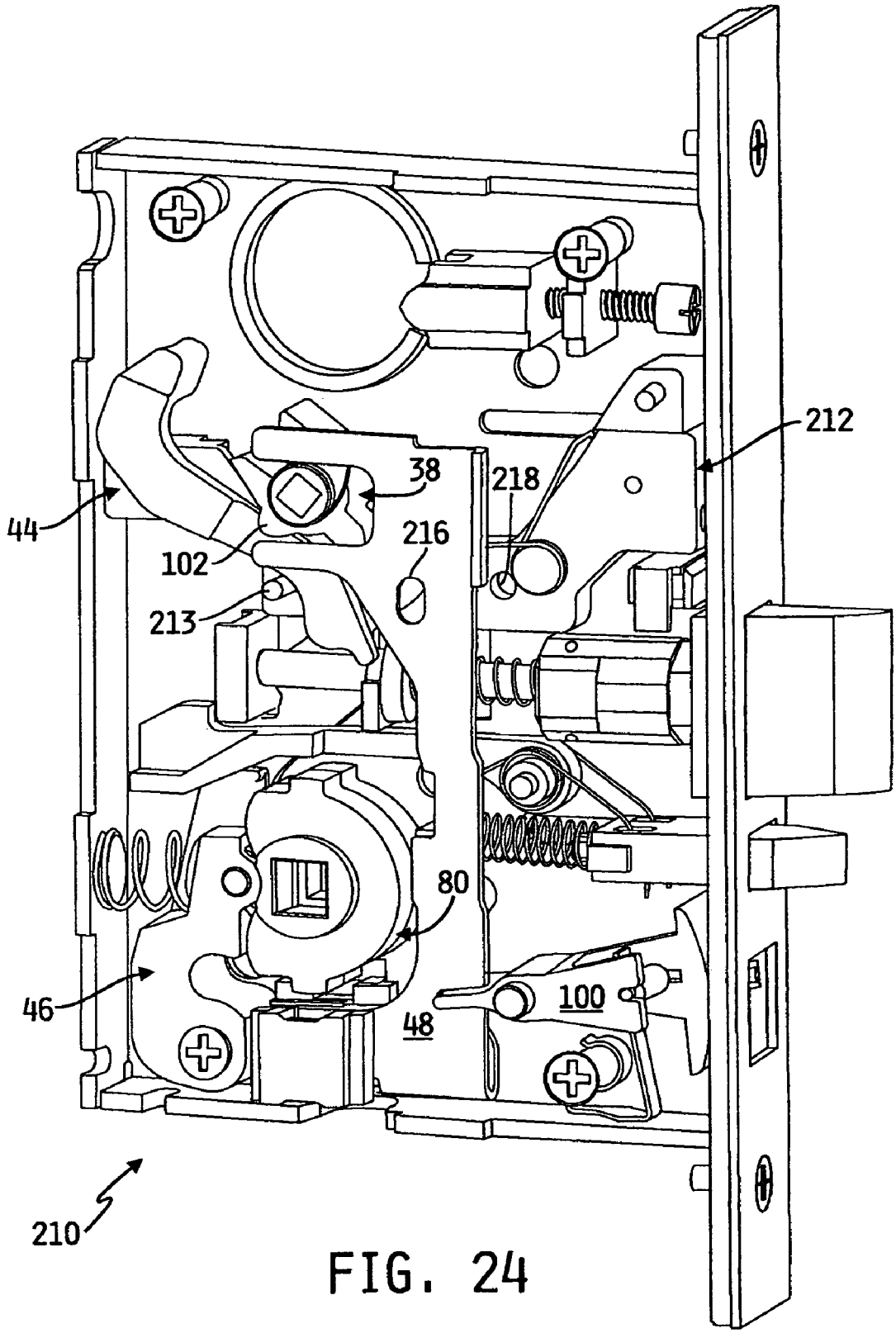
FIG. 24 is a view similar to FIG. 19 showing a shuttle of the lock moved to a right-most position.

When in the third configuration to provide the passage function, screw 214 is placed in aperture 221 of shuttle 212 through second apertures 211, 223 in chassis 12 (see FIGS. 2 and 19) that are aligned with aperture 221 when shuttle 212 is in the right most position shown in FIG. 24. Screw 214 is threaded into aperture 221 by inserting it through second aperture 211 in case 32 until the bottom end of screw 214 extends through second aperture 223. When in this position, screw 214 blocks movement of shuttle 212. Because shuttle 212 is fixed, turn knob hub 38 will not rotate and cam 102 of turn knob hub 38 holds locking lever 48 in the lowered position shown in FIG. 24. Regardless of the position of toggles 84, 86 on locking lever 48, both handles 24 can be used to retract latch bolt 14. Typically, a face plate 213, as shown in FIG. 22, is provided that blocks access to toggle lever 100.

Figure 25:
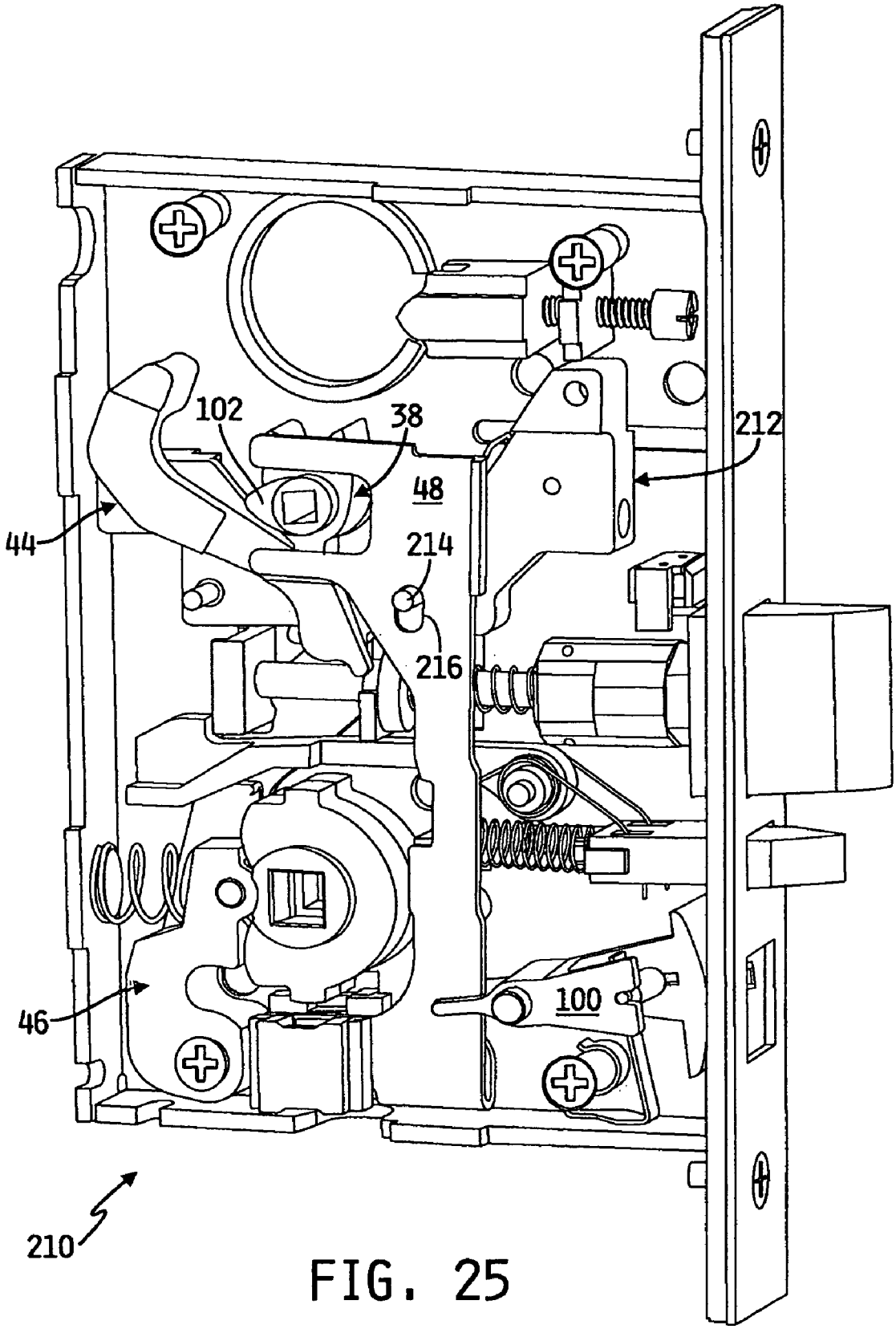
FIG. 25 is a view similar to FIG. 19 showing the shuttle in an intermediate position.
Figure 26:
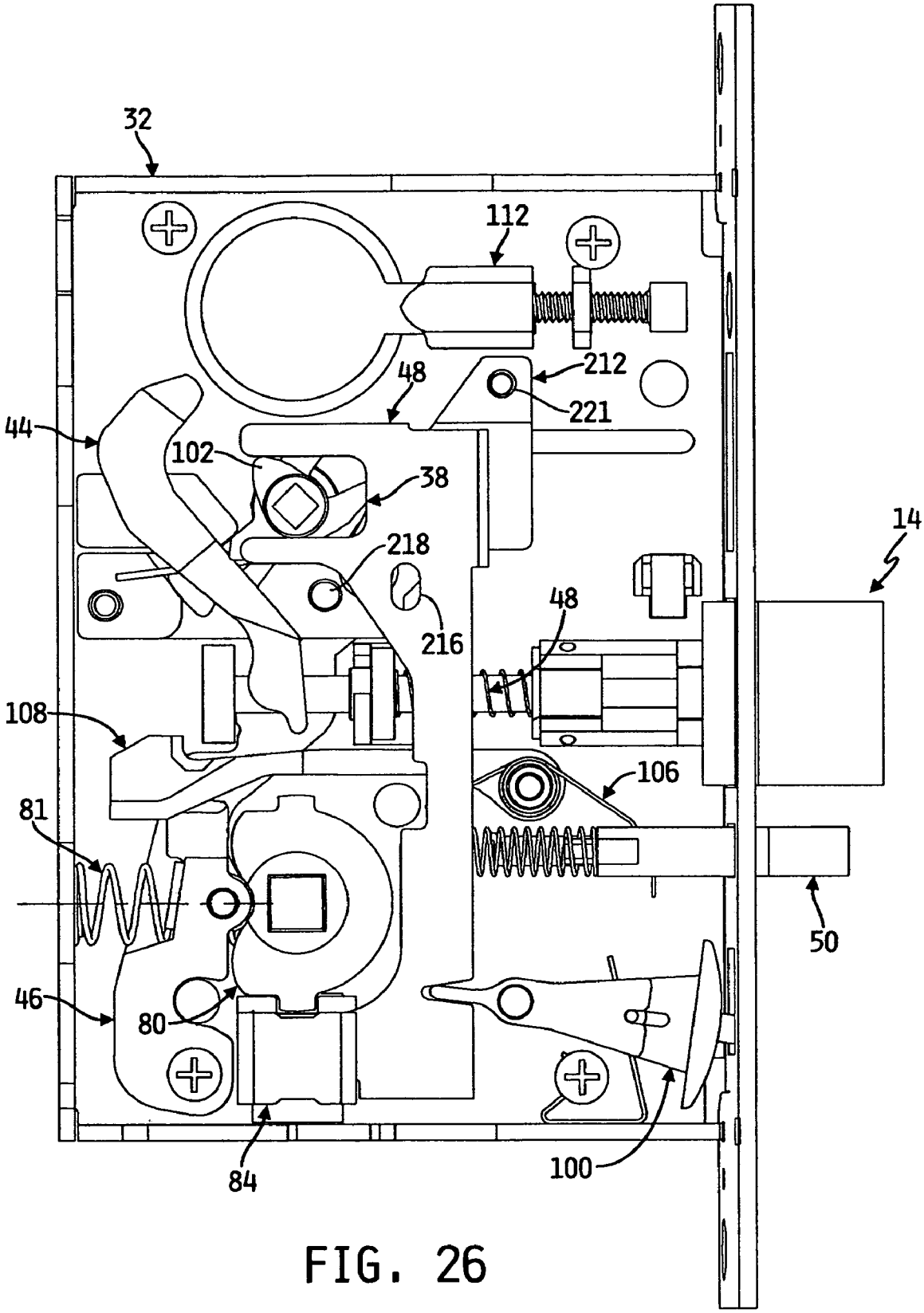
FIG. 26 is an end view of the lock of FIG. 19.

When in the fourth configuration to provide the office function, screw 214 is placed in aperture 218 of shuttle 212 through third apertures 215, 225 in chassis 12 (see FIGS. 2 and 27*b*) that are aligned with aperture 218 when shuttle 212 is in the middle position shown in FIG. 25. Screw 214 is threaded through aperture 218 by inserting it through third aperture 215 in case 32 until the bottom end of screw 214 extending though third aperture 225 in cover 34 as shown in FIG. 2. Screw 214 also extends through an elongated aperture 216 in locking lever 48. When in this position, screw 214 blocks shuttle 212 from sliding in case body 32 and holds turn knob hub 38 in an intermediate position so that cam 102 does not contact locking lever 48. Toggle lever 100 is then used to move locking lever 48 up and down to engage and disengage toggles 84, 86 with lugs 90 to enable and disable handles 24. A key and core assembly 18 may be provided on the outside of door 11 to permit unlatching of latch bolt 14 with a key.

Figure 31:
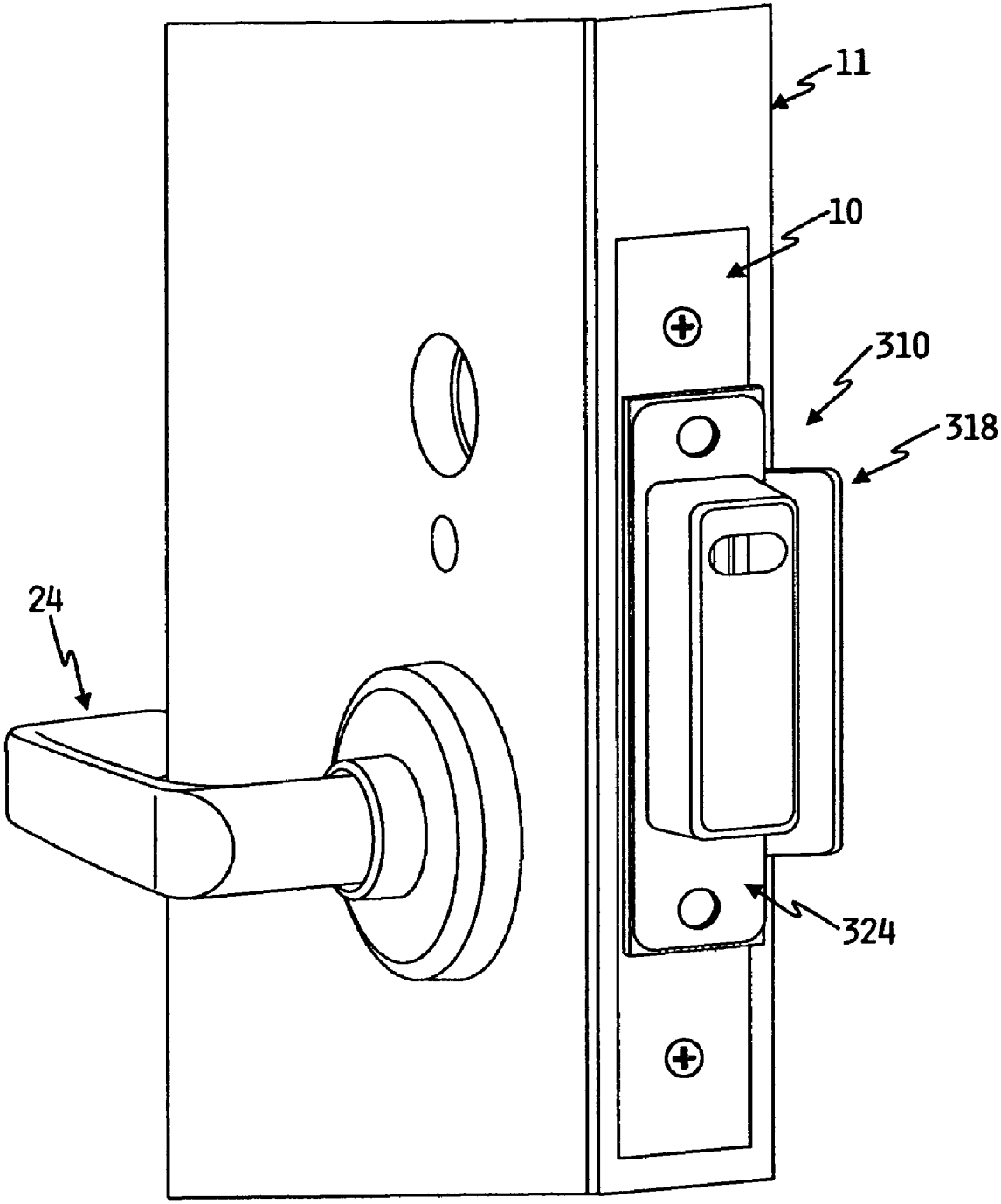
FIG. 31 is a perspective view of a portion of a left hand door, mortise lock of FIG. 1 positioned in the door, a handle coupled to the mortise lock, a strike box, and a strike plate positioned between the strike box and the mortise lock.
Figure 32:
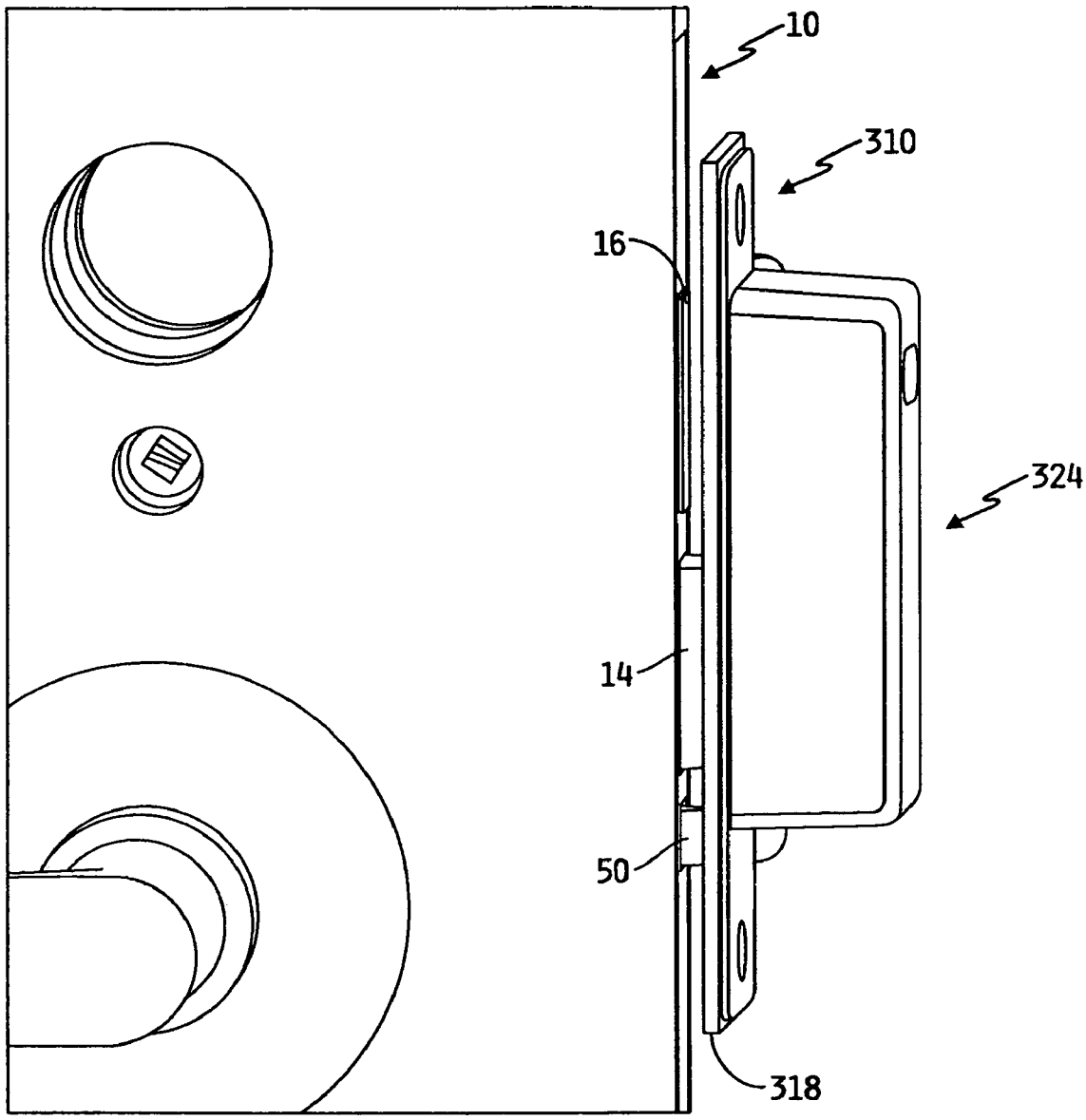
FIG. 32 is a perspective view of a portion of the mortise lock, handle, strike plate, and strike box of FIG. 31 showing the lock including a case, a deadbolt retracted into the case, a latch bolt extending from the case into the strike plate and box, and an auxiliary bolt partially extending from the case.
Figure 33:
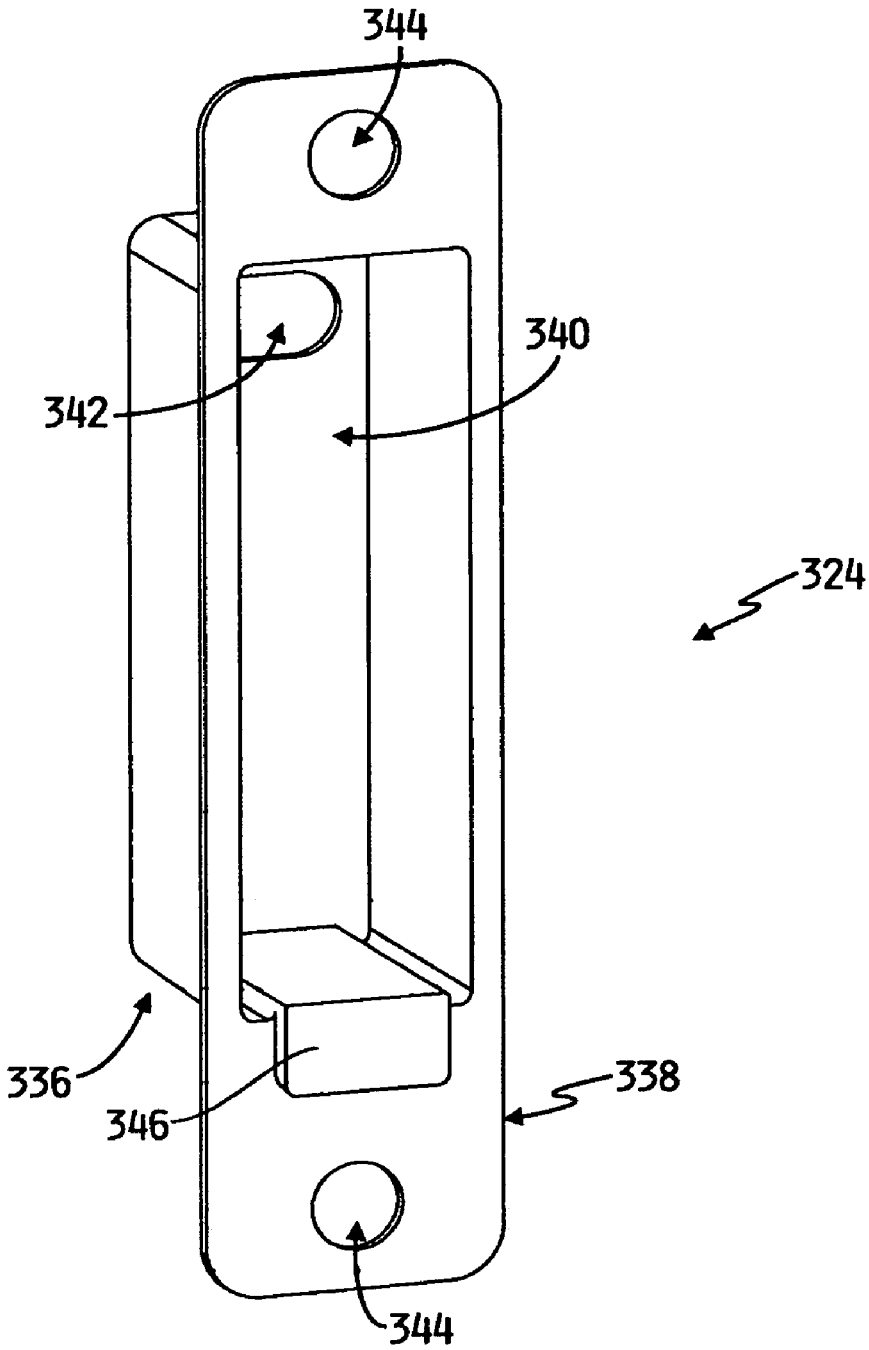
FIG. 33 is a perspective view of the strike box of FIG. 31.
Figure 34:
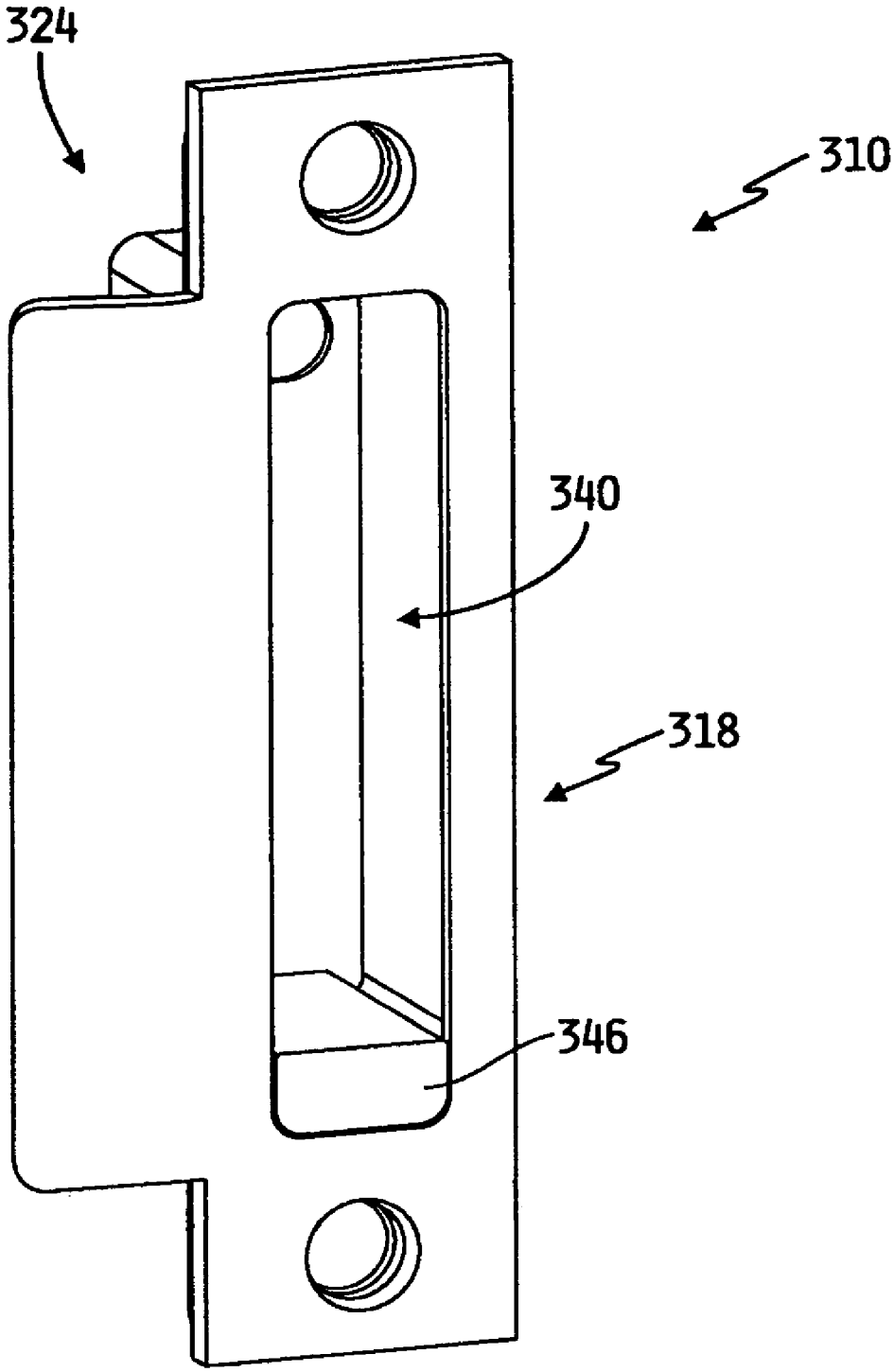
FIG. 34 is a perspective view of the strike plate and box of FIG. 31 showing the strike plate positioned over the strike box for use in a left hand door.
Figure 35:
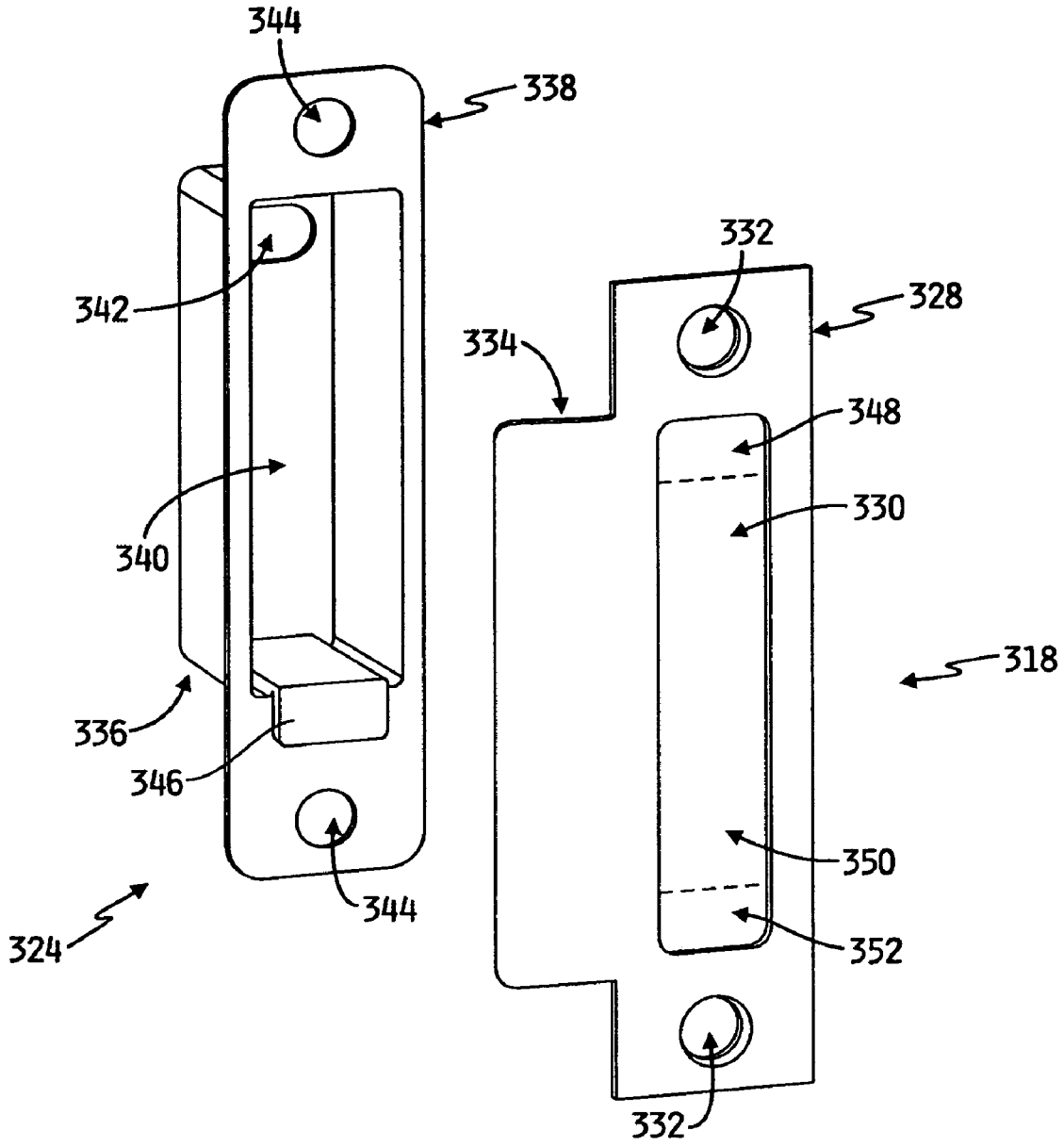
FIG. 35 is an assembly view of the strike plate and box of FIG. 31 showing the strike plate positioned for use in a left hand door.
Figure 36:
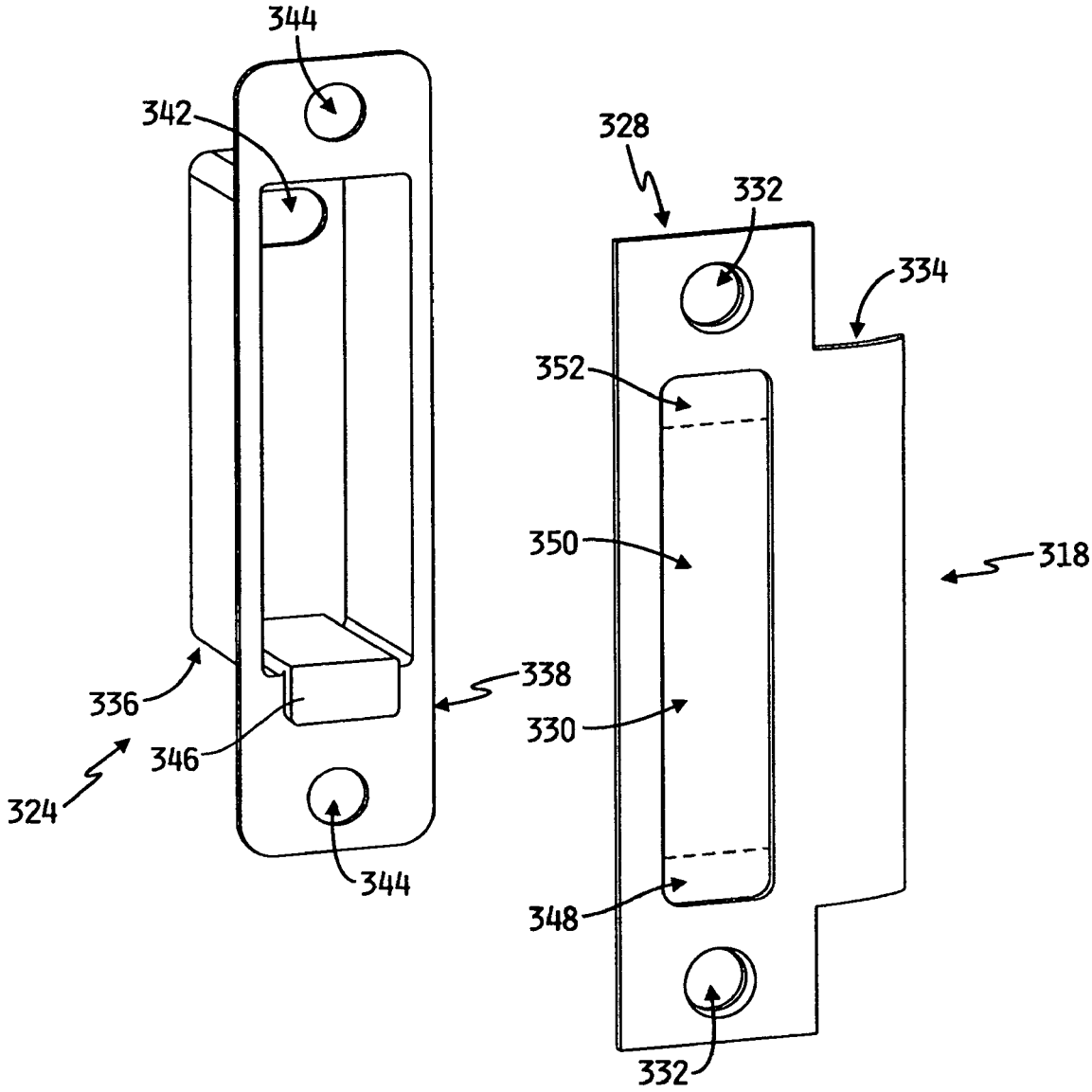
FIG. 36 is a view similar to FIG. 35 showing the strike plate positioned for use in a right hand door.
Figure 37:
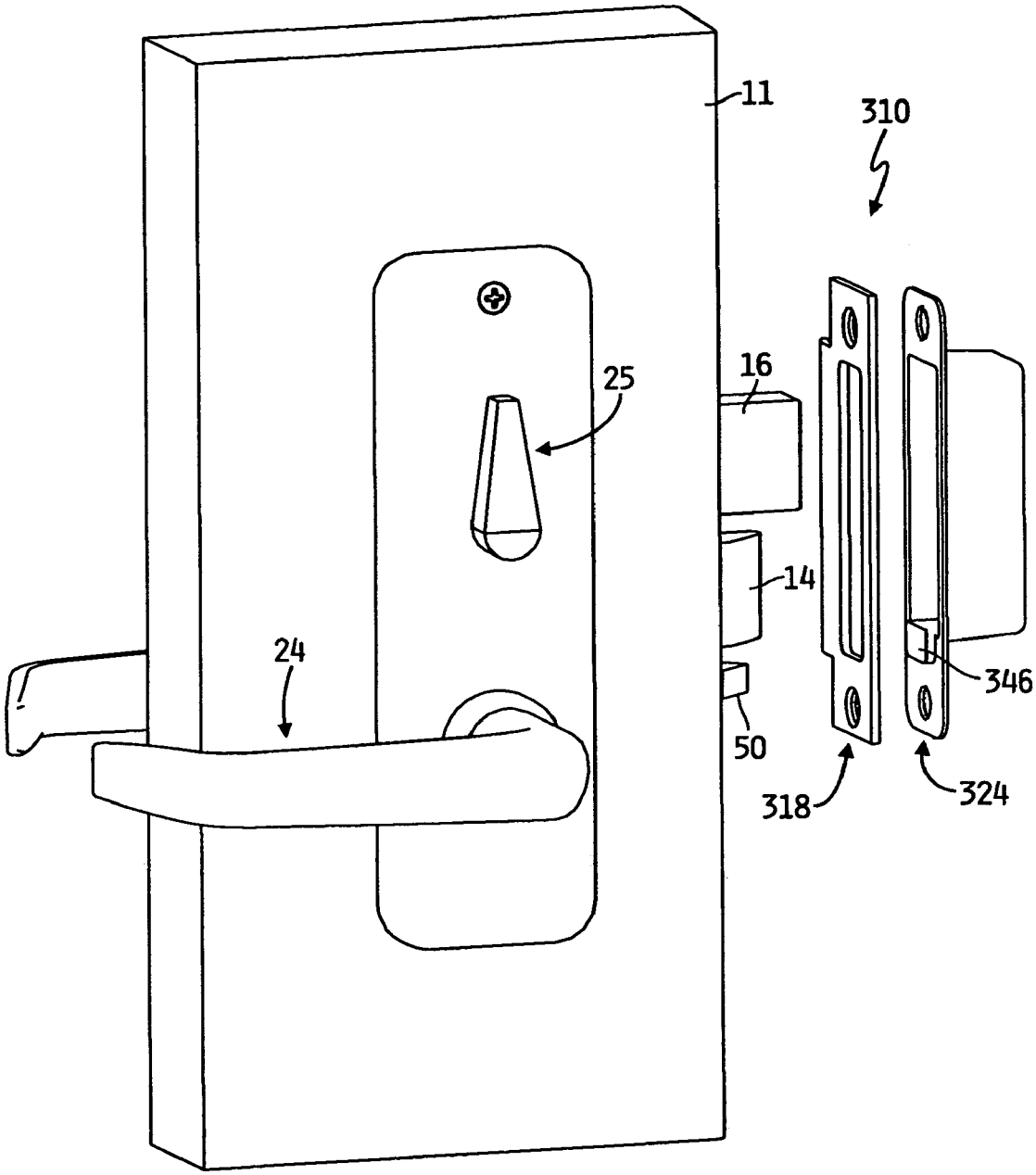
FIG. 37 is a view showing the lock of FIG. 31 aligned with a strike including a strike plate and a strike box including a plug portion positioned to fill a portion of an aperture formed in the strike plate.

According to another aspect of the present disclosure, a strike 310 shown in FIGS. 31, 32, and 37 is provided that interacts with mortise locks 10, 210 and the other mortise locks disclosed herein. According to one embodiment of the present disclosure, strike 310 includes a strike plate 318 and a strike box 324 as shown in FIGS. 35 and 36. Latch bolt 14 extends from chassis 12 to interact with strike plate 318 mounted to door frame 13. Deadbolt 16 also extends from chassis 12 to interact with strike plate 318 and an auxiliary bolt 50 extends from chassis 12. When door 11 is fully closed, latch bolt 14 and deadbolt 16, if thrown, extend into strike box 324 positioned in door frame 13. Auxiliary bolt 50 partially extends from chassis 12, but does not extend into strike plate 318 or strike box 324. As described above, when auxiliary bolt 50 is only partially extended, latch bolt 14 cannot be forced in by pushing on latch bolt 14. Handles 24 are also provided on each side of door 11 to retract latch bolt 14 into chassis 12. Key and core assembly 18 is provided to retract deadbolt 16 into chassis 12 to permit door 11 to be opened by a user. Additional details of lock 10 are provided herein. Additional details of other locks suitable for use with strike 310 are also provided herein expressly or by incorporation by reference.

Figure 48:
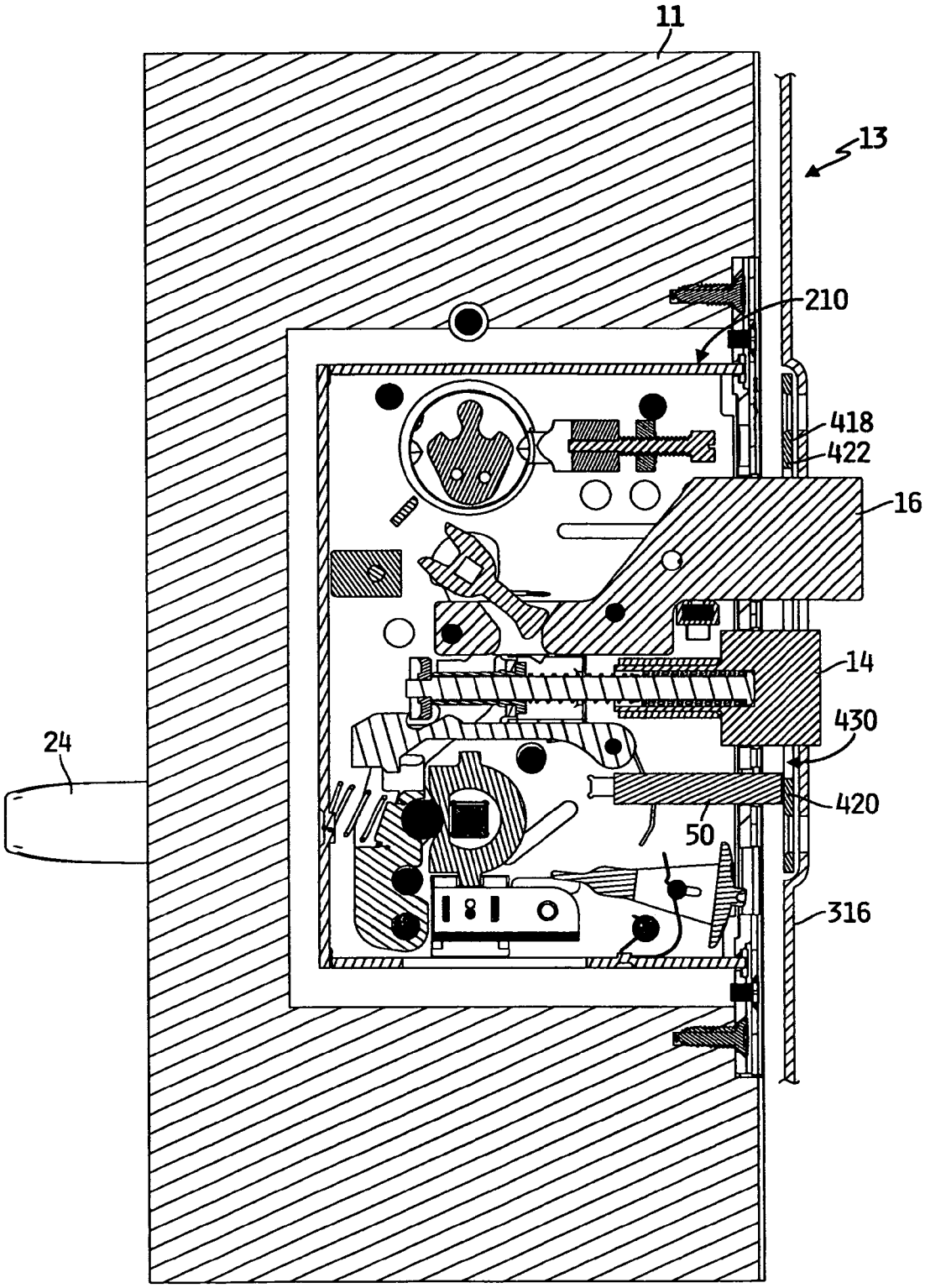
FIG. 48 is a view similar to FIG. 39 showing with an alternative strike plate receiving the deadbolt and latch bolt and the auxiliary bolt contacting the strike plate.

Strike plate 318 is positioned within a recess 316 preformed in door frame 13 to interact with lock 10 and block movement of door 11. As shown in FIGS. 35 and 36, strike plate 318 includes a body or planar portion 328 including a bolt-receiving aperture 330 and a pair of fastener-receiving apertures 332. Strike plate 318 further includes a bent or curved lip 334 coupled to body 328. Strike plate 318 is preferably made of a metal such as steel or brass alloy, or other material known to those of ordinary skill in the art. Typically, door frame 13 is made of steel or other metal and preformed with standard recess 316 and fastener receiving apertures 317 as shown in FIGS. 39 and 48.

During closing of door 11, latch bolt 14 and auxiliary bolt 50 strike curved lip 334 and are at least partially pushed into chassis 12. When door 11 is fully closed, latch bolt 14 clears strike plate 318 and extends into bolt-receiving aperture 330 and strike box 324 as shown in FIG. 37. But, strike box 324 blocks auxiliary bolt 50 from extending into bolt-receiving aperture 330.

During installation strike box 324 is positioned in door frame 13 to block access to the interior of door frame 13 and to provide a finished appearance behind strike plate 318. Strike box 324 includes a recess member 325 including a housing or body 336 and a lip 338 coupled to body 336. Body 336 defines an interior region or recess 340 that receives latch bolt 14 and deadbolt 16, if it is thrown. Interior region 340 is wide enough and deep enough to receive latch bolt 14 and deadbolt 16 when they are fully extended from chassis 12. Body 336 also defines a fastener-receiving aperture 342. An optional fastener (not shown), such as a screw, may be provided to extend through aperture 342 and hold strike box 324 in door frame 13. Lip 338 of strike box 324 includes a pair of fastener-receiving apertures 344 that align with fastener-receiving apertures 332 of strike plate 318.

As mentioned above, strike box 324 blocks auxiliary bolt 50 from extending into bolt-receiving aperture 330 of strike plate 318. As shown in FIGS. 35 and 36, lip 338 of strike box 324 includes a raised portion or plug 346 that extends at least partially into bolt-receiving aperture 330. Preferably, raised portion 346 has a height approximately equal to the thickness of strike plate 318 so that when strike plate 318 is positioned over strike box 324, raised portion 346 is substantially flush with an outer surface of strike plate 318.

Door 11 may be installed so that it is a left handed (i.e. when door 11 opens toward the user, the handle is on the left side of door 11) or right handed (i.e. when door 11 opens toward the user, the handle is on the right side of door 11). To operate properly with the desired handing of door 11, strike plate 318 must be mounted to door frame 13 in the proper orientation so that latch bolt 14 and auxiliary bolt 50 ride over strike plate 318 so that door 11 fully closes.

During installation the installer must determine the handing of door 11 and position strike plate 318 on door frame 13 so latch bolt 14 and auxiliary bolt 50 contact lip 334 of strike plate 318. For example, strike plate 318 is oriented properly for a left hand door in FIG. 35 and for a right hand door in FIG. 36. As shown in FIGS. 35 and 36 the orientation of strike box 324 remains the same regardless of the handing of door 11 with raised portion 346 in a lower position. Thus regardless of the handing of a particular door, an installer can use the same strike plate 318 and strike box 324 and match the handing of door 11 by properly orienting strike plate 318 relative to strike box 324.

As shown in FIGS. 35 and 36, bolt-receiving aperture 330 of strike plate 318 includes a first end portion 348, a middle portion 350, and a second end portion 352. When door 11 is left handed, first end portion 348 and middle portion 350 receive deadbolt 16 and latch bolt 14 and raised portion 346 of strike box 324 substantially fills second end portion 352. When door 11 is right handed, second end portion 352 and middle portion 350 receive dead bolt 20 and latch bolt 14 and raised portion 346 substantially fills first end portion 348. Thus, depending on the handing of door 11, raised portion 346 substantially fills a different portion of bolt-receiving aperture 330.

According to another alternative embodiment of the present disclosure, another strike 410 shown in FIGS. 40-48 is provided that interacts with mortise locks 10, 210 and the other mortise locks disclosed herein. According to one embodiment of the present disclosure, strike 410 includes a strike plate 418 and may include a strike box (not shown). Latch bolt 14, if enabled, extends from chassis 12 to interact with strike plate 418 mounted to door frame 13. Deadbolt 16, if provided, also extends from chassis 12 to interact with strike plate 418 and an auxiliary bolt 50, if enabled, extends from chassis 12. When door 11 is fully closed, latch bolt 14 and deadbolt 16, if thrown, extend into the strike box positioned in door frame 13. Auxiliary bolt 50 partially extends from chassis 12, but does not extend into strike plate 418 or the strike box because it is blocked by a portion 420 of strike plate 418. As described above, when auxiliary bolt 50 only partially extends from chassis 12, latch bolt 14 cannot be forced in by pushing on latch bolt 14.

Figure 40:
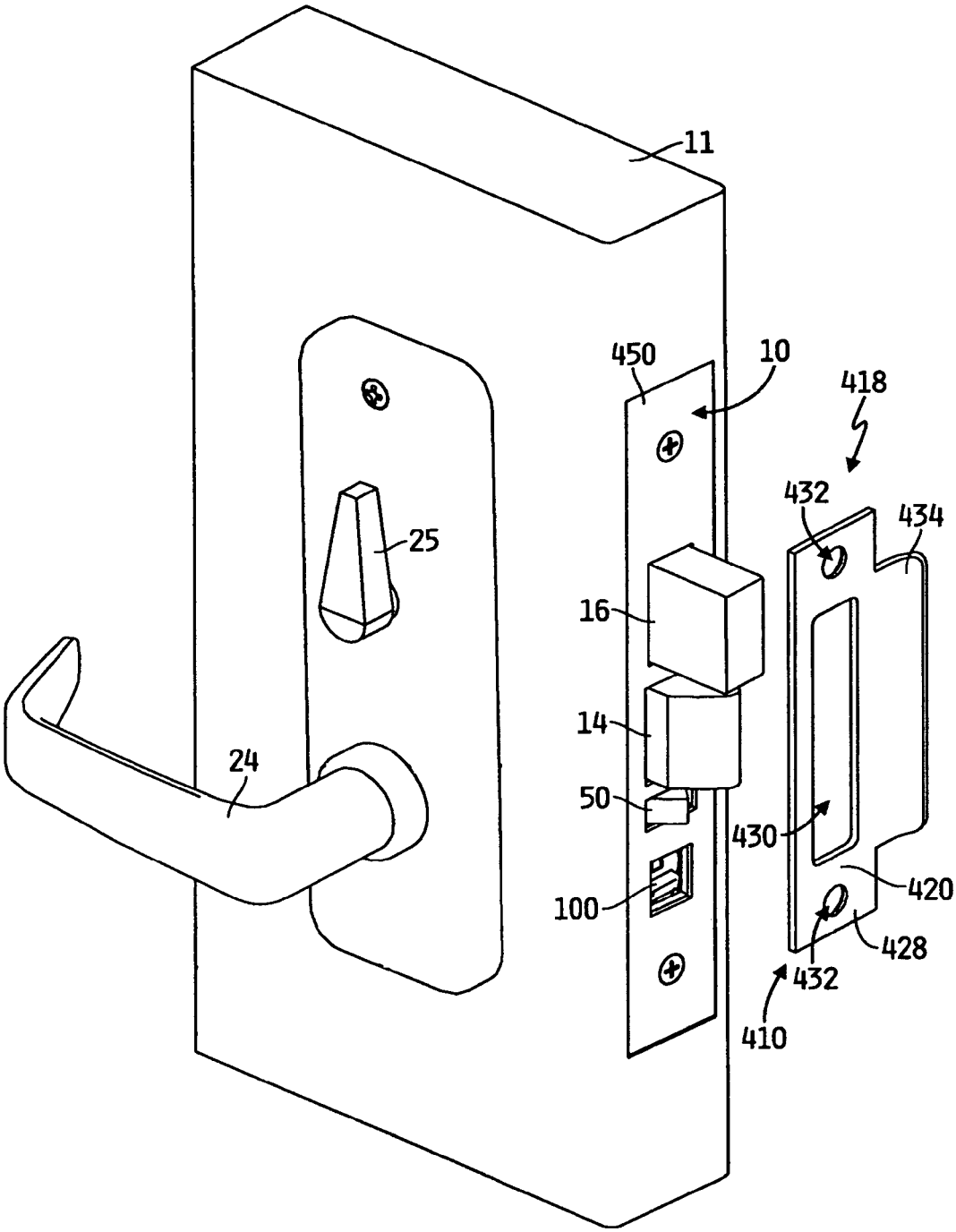
FIG. 40 is a perspective view of the lock of FIG. 1 showing the lock aligned with a strike plate and a toggle lever accessible to a user.

Strike plate 418 is positioned on door frame 13 to interact with lock 10 and block movement of door 11. As shown in FIG. 40, strike plate 418 includes a body or planar portion 428 including a bolt-receiving aperture 430 and a pair of fastener-receiving apertures 432. Strike plate 418 further includes a bent or curved lip 434 coupled to body 428. Strike plate 418 is preferably made of a metal such as steel or brass alloy, or other material known to those of ordinary skill in the art.

During closing of door 11, latch bolt 14 and auxiliary bolt 50 strike curved lip 434 and are at least partially pushed into chassis 12. When door 11 is fully closed, latch bolt 14 clears strike plate 418 and extends into bolt-receiving aperture 430 and the strike box, if provided as shown in FIG. 48. But, portion 420 blocks auxiliary bolt 50 from extending into bolt-receiving aperture 430 as shown in FIG. 48.

During installation the strike box is positioned in door frame 13 to block access to the interior of door frame 13 and to provide a finished appearance behind strike plate 418. The strike box includes a recess member including a housing or body and a lip coupled to the body. The body defines an interior region or recess that receives latch bolt 14 and deadbolt 16, if it is thrown. The interior region is wide enough and deep enough to receive latch bolt 14 and deadbolt 16 when they are fully extended from chassis 12. The body also defines a fastener-receiving aperture. An optional fastener (not shown), such as a screw, may be provided to extend through the aperture and hold the strike box in door frame 13. The lip of the strike box includes a pair of fastener-receiving apertures that align with fastener-receiving apertures 432 of strike plate 418.

Unlike strike box 324, the strike box provided with strike plate 418 is preferably not provided with a raised portion or plug 346 that extends into bolt-receiving aperture 430. Door 11 may be installed so that it is a left handed (i.e. when door 11 opens toward the user, the handle is on the left side of door 11), or right handed (i.e. when door 11 opens toward the user, the handle is on the right side of door 11). To operate properly with the desired handing of door 11, strike plate 418 must be mounted to door frame 13 in the proper orientation so that latch bolt 14 and auxiliary bolt 50 ride over strike plate 418 so that door 11 fully closes.

During installation the installer must determine the handing of door 11 and position strike plate 418 on door frame 13 so latch bolt 14 and auxiliary bolt 50 contact lip 434 of strike plate 318. Regardless of the handing of a particular door, an installer can use the same strike plate 418 and strike box, if provided, and match the handing of door 11 by properly orienting strike plate 418 relative to door frame 13.

Figure 41:
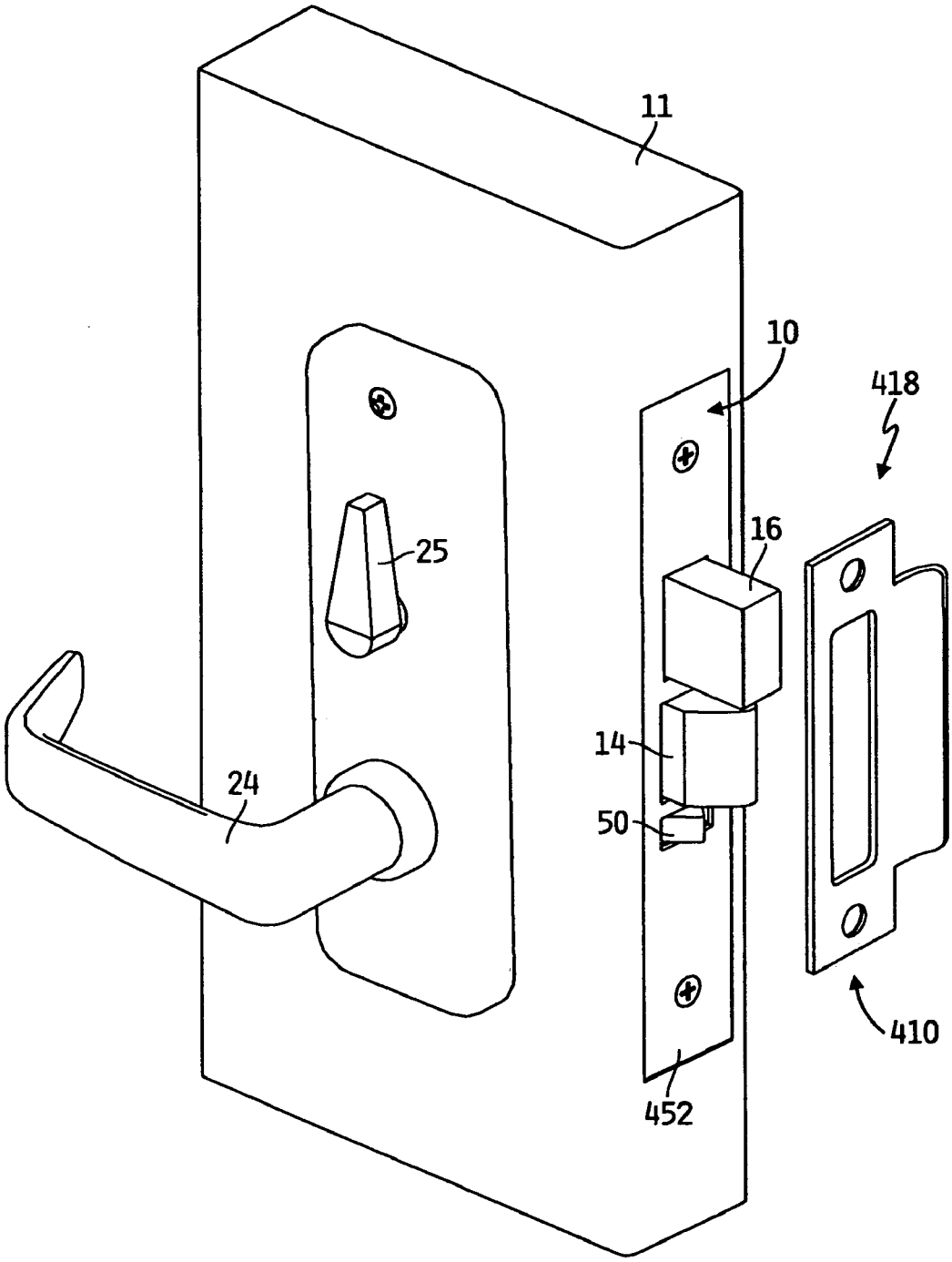
FIG. 41 is a view similar to FIG. 40, showing the toggle lever covered to be inaccessible to a user.
Figure 44:
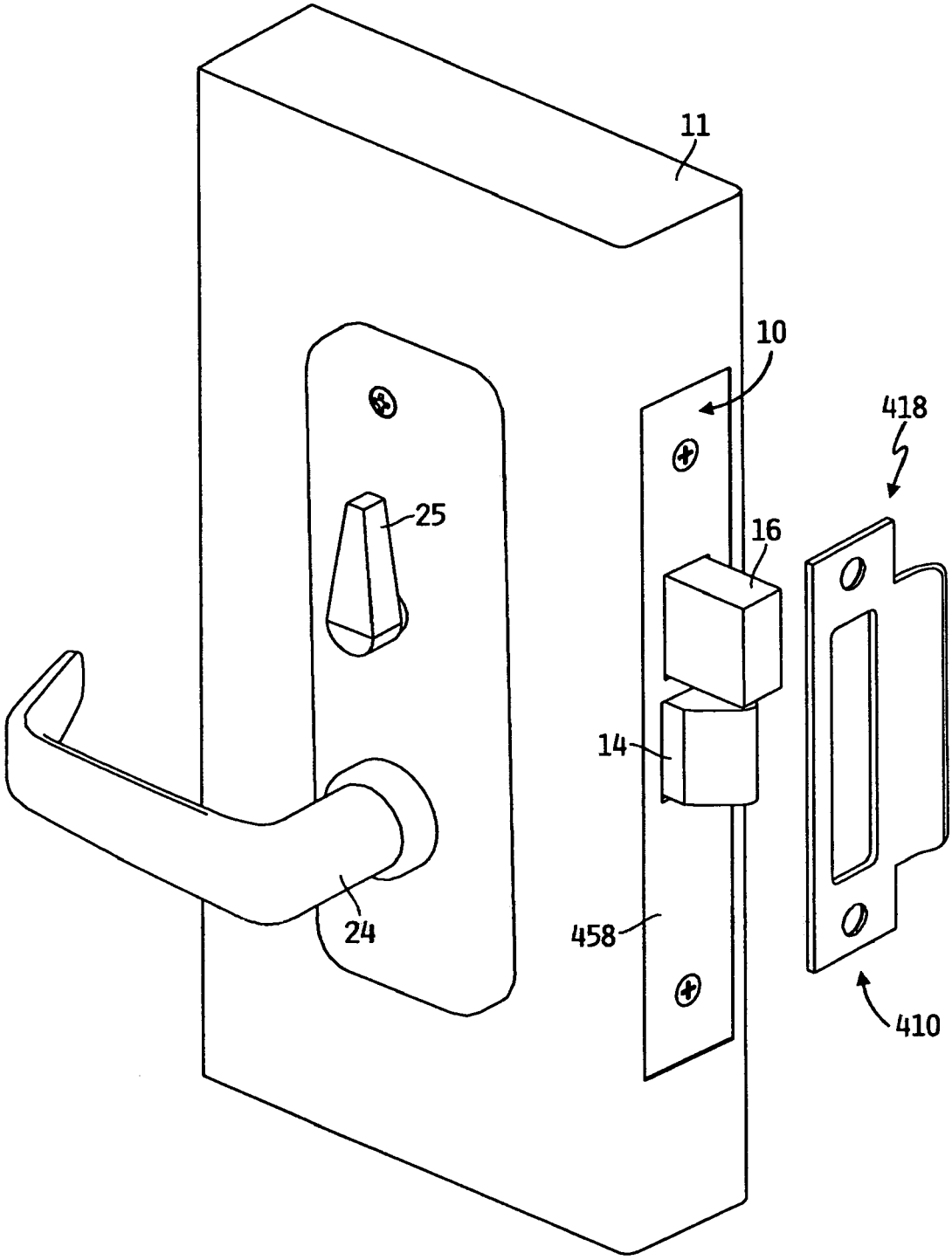
FIG. 44 is a view similar to FIG. 40 showing the toggle lever to be inaccessible to a user and the auxiliary bolt covered to be disabled.
Figure 45:
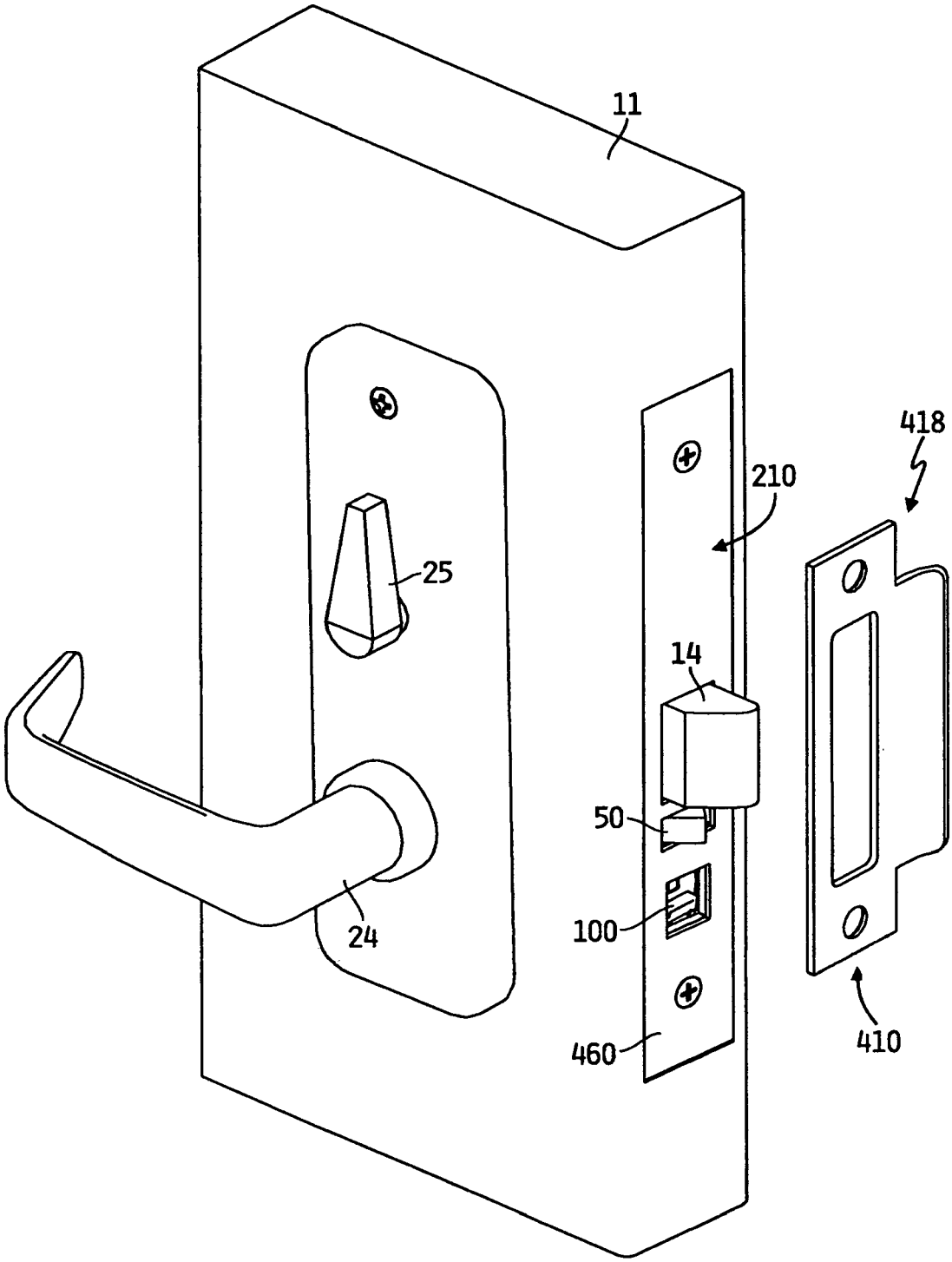
FIG. 45 is a perspective view of the lock of FIG. 19 showing the lock aligned with the strike plate and a toggle lever accessible to a user.

As shown in FIG. 48, strike plate 418 includes first portion 420 and second portion 422 both positioned adjacent to bolt-receiving aperture 430 of strike plate 418. When door 11 is left handed, first portion 420 contacts auxiliary bolt 50. When door 11 is right handed, second end portion 422 contacts auxiliary portion 422. As shown in FIGS. 40 and 41, strike 410 (and 310) can be used with various mortise lock configurations including, for example, lock 10 when deadbolt 16, latch bolt 14, and auxiliary bolt 50 are provided or enabled. As shown in FIGS. 44 and 45, strike 410 (and 310) can be used with a lock, such as locks 10, 210, with or without each of latch bolt 14, auxiliary bolt 50, or deadbolt 16 enabled or provided.

Figure 42:
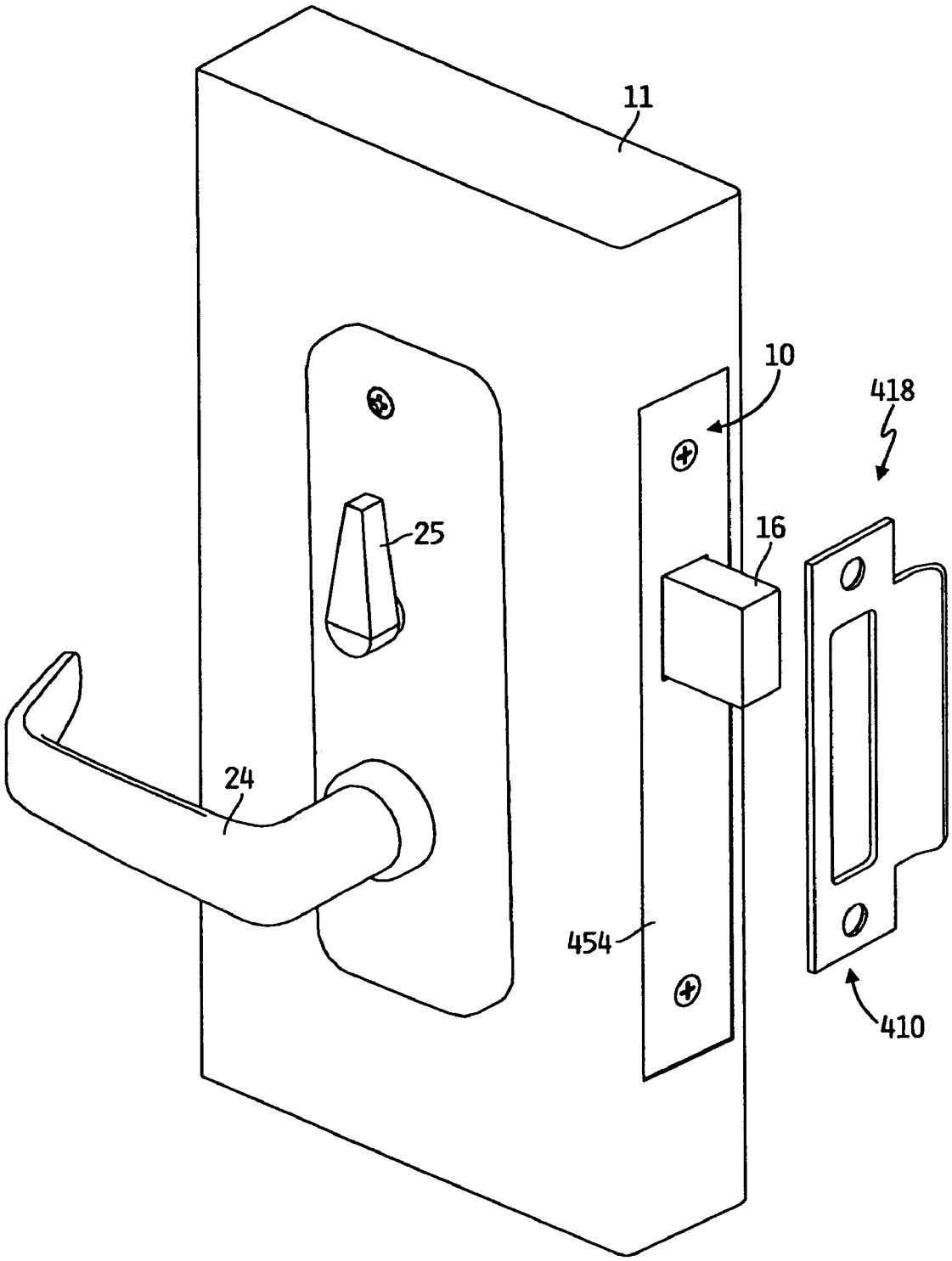
FIG. 42 is a view similar to FIG. 40 showing the toggle lever covered to be inaccessible and the latch bolt and auxiliary bolt covered to be disabled.
Figure 43:
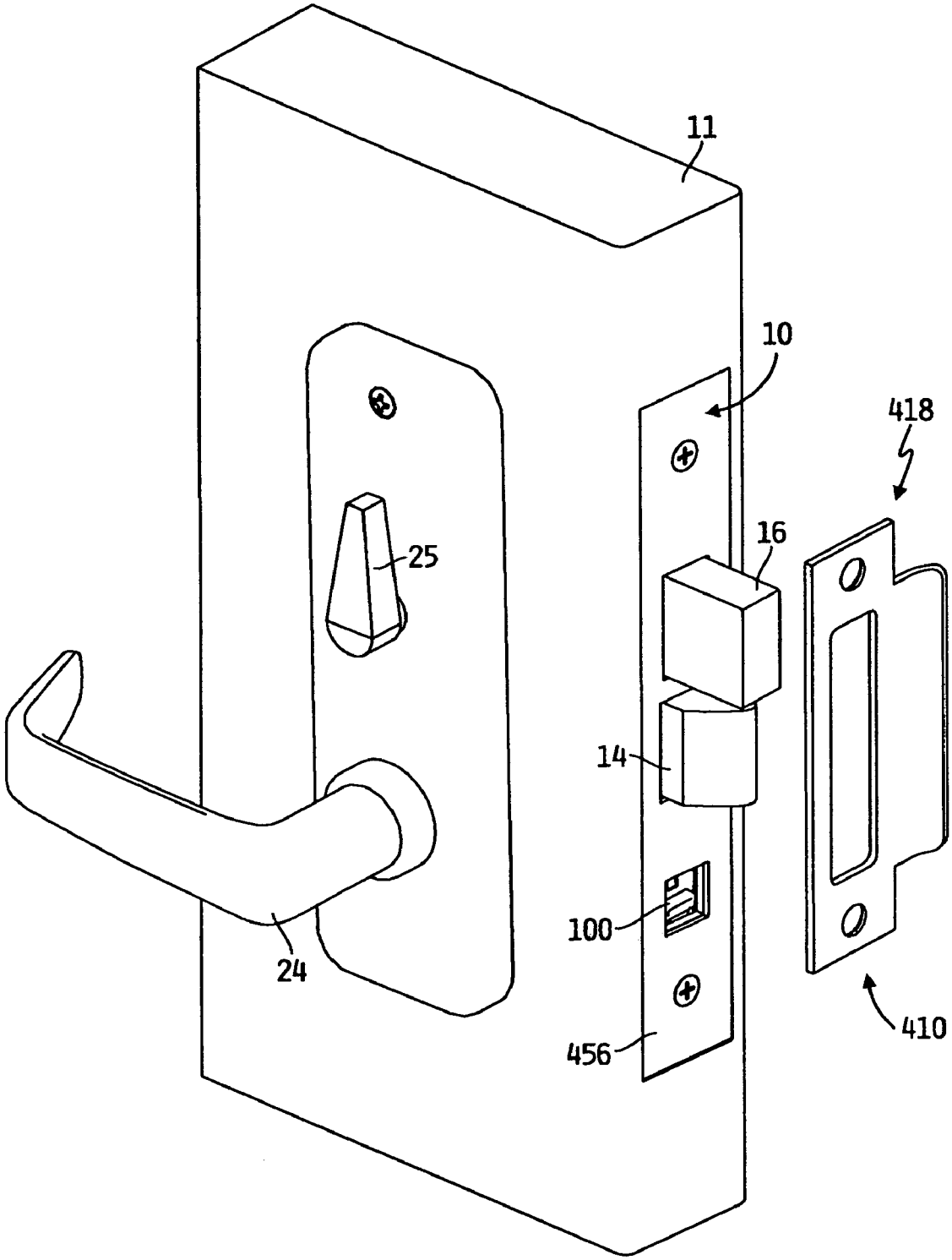
FIG. 43 is a view similar to FIG. 40 showing the toggle auxiliary bolt covered to be disabled.

As discussed above, locks 10, 210 are provided with different faceplates when installed depending on the desired functionality of lock 10, 210. Each lock 10, 210, or variations of locks 10, 210 with or without deadbolt 16, latch bolt 14, and/or auxiliary bolt 50 may be provided with either strike 310 or strike 410. As shown in exemplary FIGS. 40-47, locks 10, 210, or other locks are provided with strike plate 418 of strike 410. FIG. 40 shows lock 10 provided with a faceplate 450 including apertures allowing latch bolt 14, deadbolt 16, and auxiliary bolt 50 to extend through faceplate 450 and an aperture permitting access to toggle lever 100 to permit operation of lock 10 in another office function (ANSI F20). Another faceplate 452 is shown in FIG. 41 blocking access to toggle lever 100 to permit operation of lock 10 in an other dormitory function and a "hotel" function (ANSI F15). Another faceplate 454 with lock 10 is shown in FIG. 42 for use with lock 10 wherein latch bolt 14 and auxiliary bolt 50 are covered or disabled and access is blocked to toggle bolt 100 so that lock 10 only operates in "deadlock" functions (ANSI F17 with an outside key and core assembly 18 and inside knob 25 to operate deadbolt 16, ANSI F18 with an outside key and core assembly 18, and ANSI F16 with an inside and outside key and core assembly 18). Another faceplate 456 with lock 10 (without an auxiliary bolt 50) is shown in FIG. 43 with an aperture allowing latch bolt 14 and deadbolt 16 to extend through faceplate 456, allowing access to toggle lever 100, and blocking the auxiliary bolt opening to permit operation of lock 10 in a "dormitory" function (ANSI F12 with an interior knob 25 and exterior key and core assembly 18) or a modified storeroom function (ANSI F35 with inside and outside key and core assembly 18). Another faceplate 458 with lock 10 (without an auxiliary bolt 10) is shown in FIG. 44 permitting latch bolt 14 and deadbolt 16 to extend through faceplate 458 and blocking access to toggle lever 100 to provide another dormitory function (ANSI F13 with an outside key and core assembly 18 and an inside turn knob 25), another privacy function (ANSI F19 with an inside knob 25 and an outside emergency key and core assembly 18), a communication function (ANSI F14 with inside and outside key and core assembly 18), and an intruder function (ANSI 33 and ANSI 34 with inside and outside key and core assembly 18).

Figure 46:
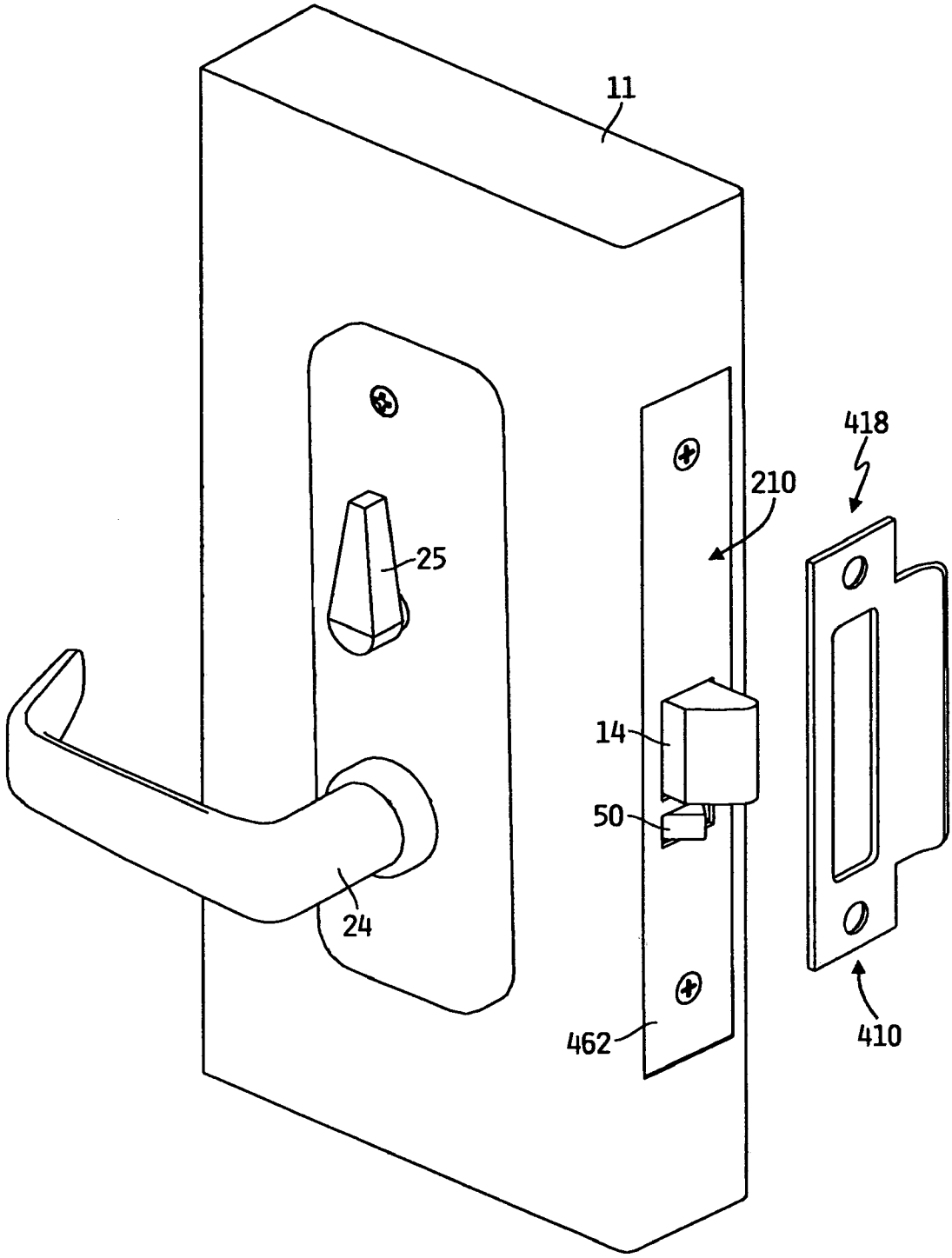
FIG. 46 is a view similar to FIG. 45 showing the toggle lever covered to be inaccessible to a user.
Figure 47:
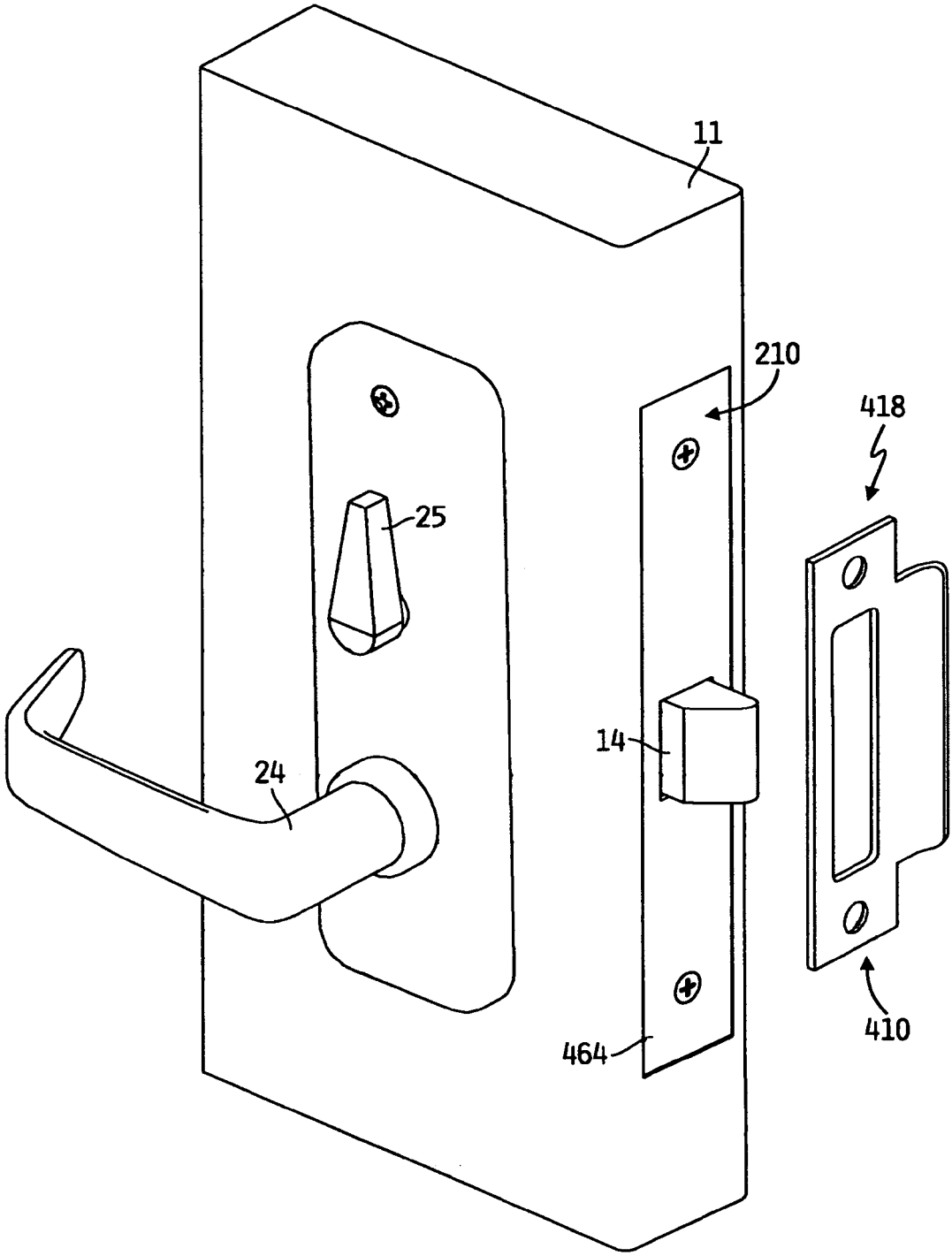
FIG. 47 is a view similar to FIG. 45 showing the toggle lever covered to be inaccessible to a user and the auxiliary bolt covered to be disabled.

Another faceplate 460 is shown in FIG. 45 for lock 210 allowing the latch bolt 14 and auxiliary bolt 50 to extend though faceplate 460 and permit access to toggle lever 100 for the office function with an inside knob 25. FIG. 46 shows another faceplate 462 for lock 210 allowing latch bolt 14 and auxiliary bolt 50 to extend through faceplate 462 and blocking access to toggle lever 100 for a modified office function, the storeroom function, the classroom function, and the passage function. Another faceplate with lock 210 (without an auxiliary bolt) 464 is shown in FIG. 47 that allows the latch bolt 14 to extend through faceplate 464, blocks access to the auxiliary bolt aperture, and blocks access to toggle lever 100.

Figure 49:
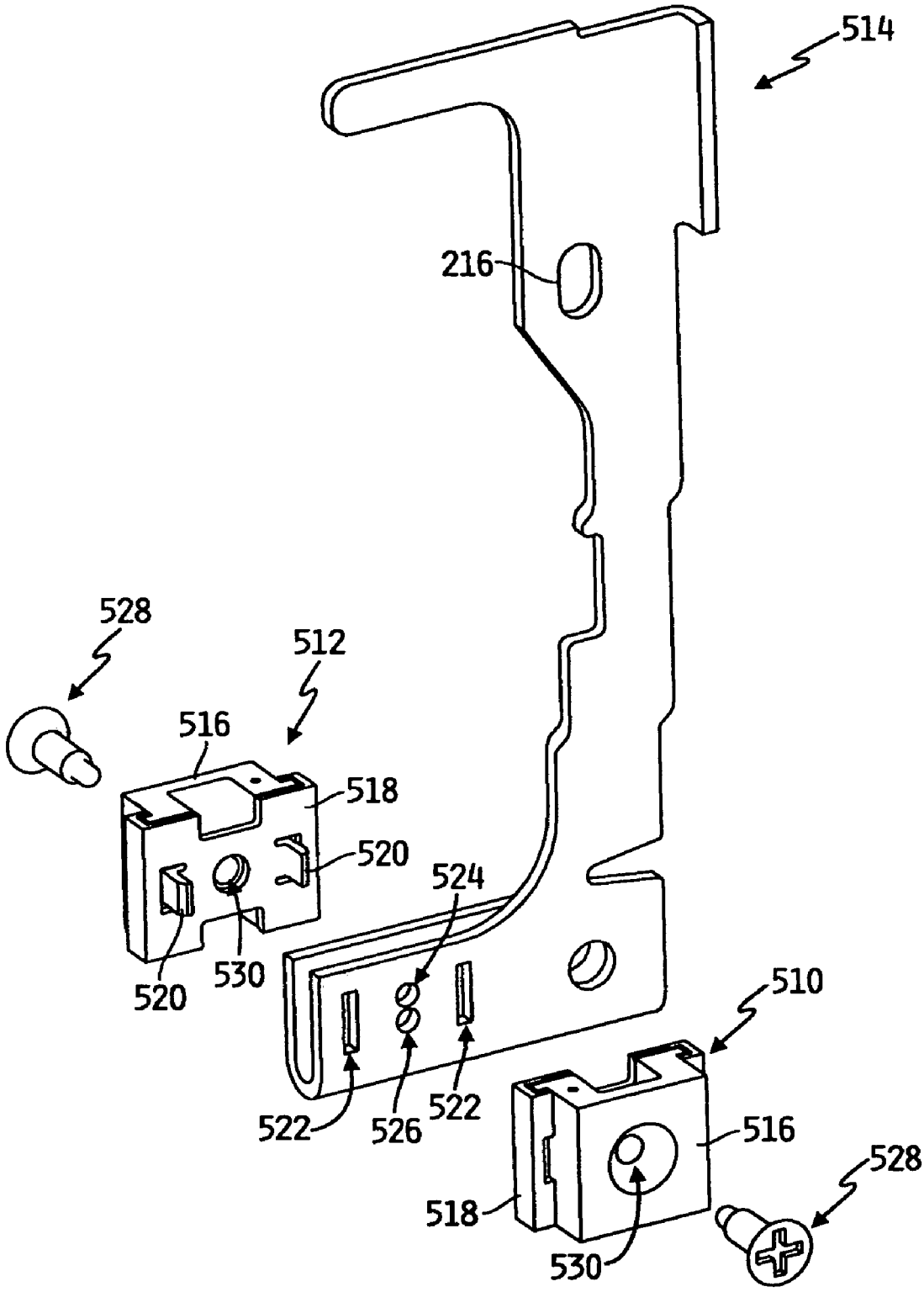
FIG. 49 is a view of an alternative embodiment handle release lever and the alternative embodiment toggles.

As shown in FIG. 49, an alternative embodiment set of interactive members or toggles 510, 512 is provided with an alternative embodiment shuttle or locking lever 514. Toggles 510, 512 and locking lever 514 may be used interchangeably with toggles 84, 86 and locking lever 48 discussed above.

Each toggle 510, 512 includes a metal base 516 and a plastic base 518 molded around a portion of metal base 516. Plastic base 518 includes a pair of lugs 520 that are slideably received in respective pairs of apertures 522 formed in locking lever 514. Only one pair of apertures 522 is shown in FIG. 49. Another pair of apertures 522 are provided in locking lever 514 that align with those shown.

Figure 53:
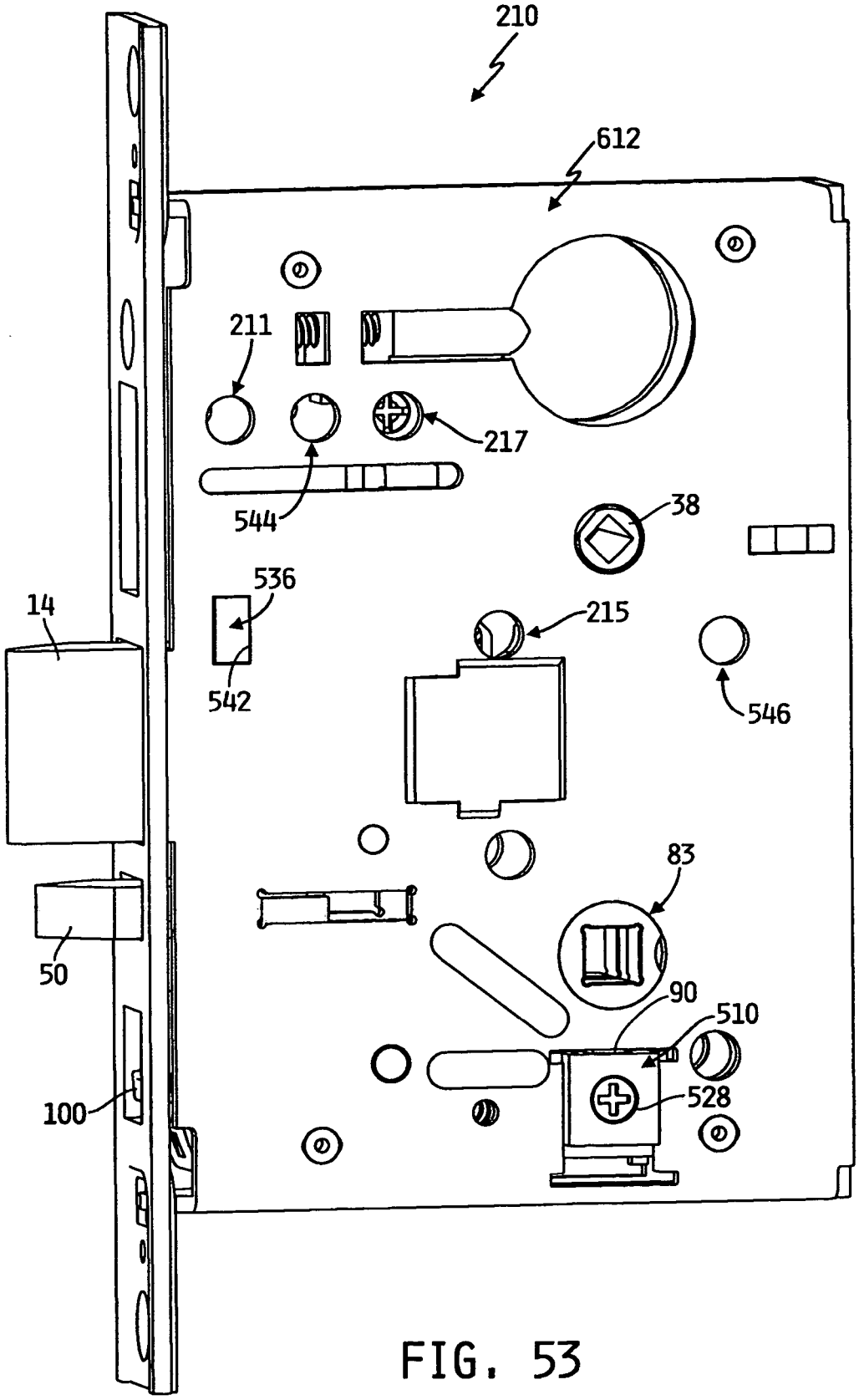
FIG. 53 is a view similar to FIG. 54.
Figure 54:
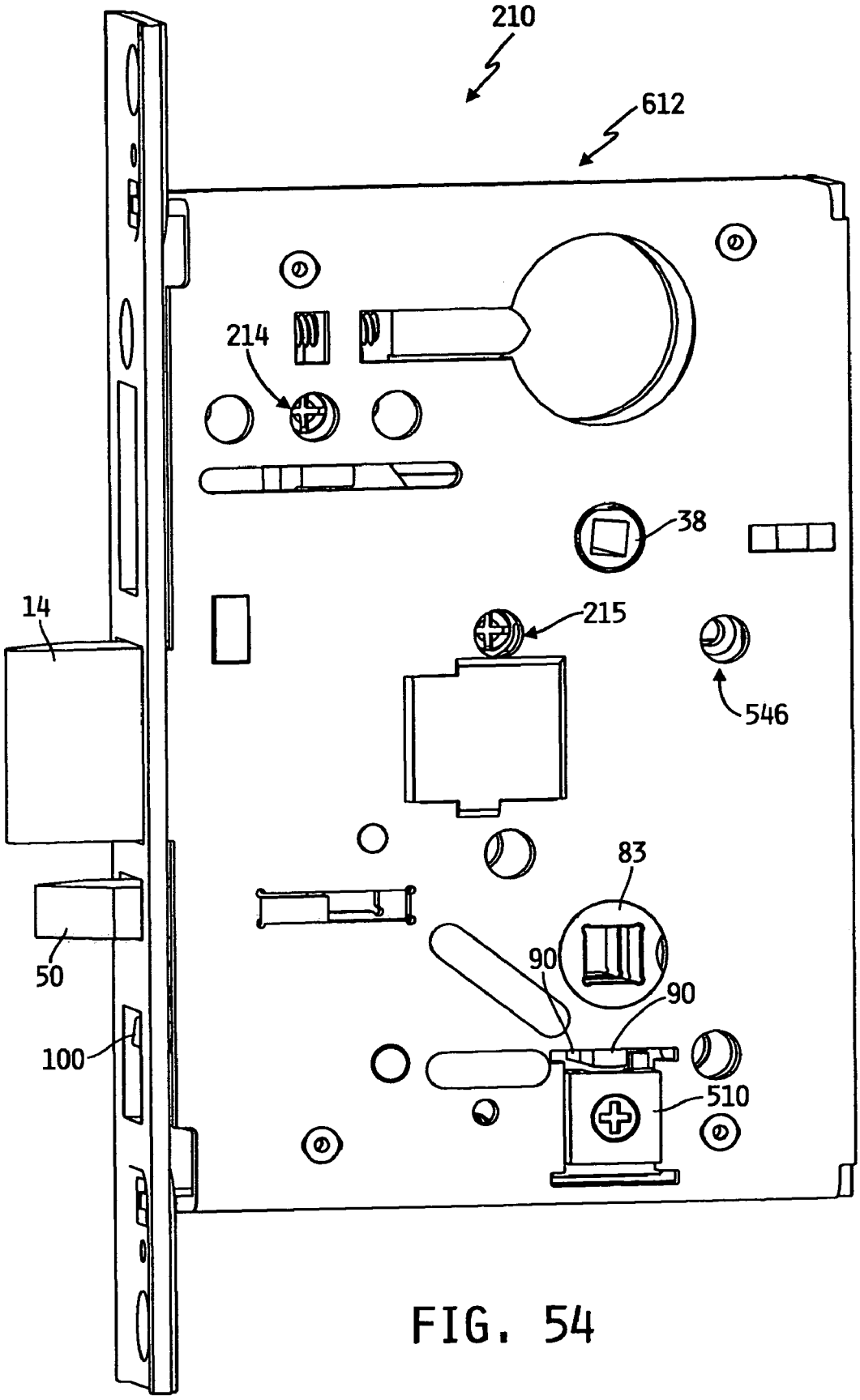
FIG. 54 is a perspective view of an alternative embodiment case and toggle for use with the locks of FIGS. 1 and 19 showing.
Figure 55:
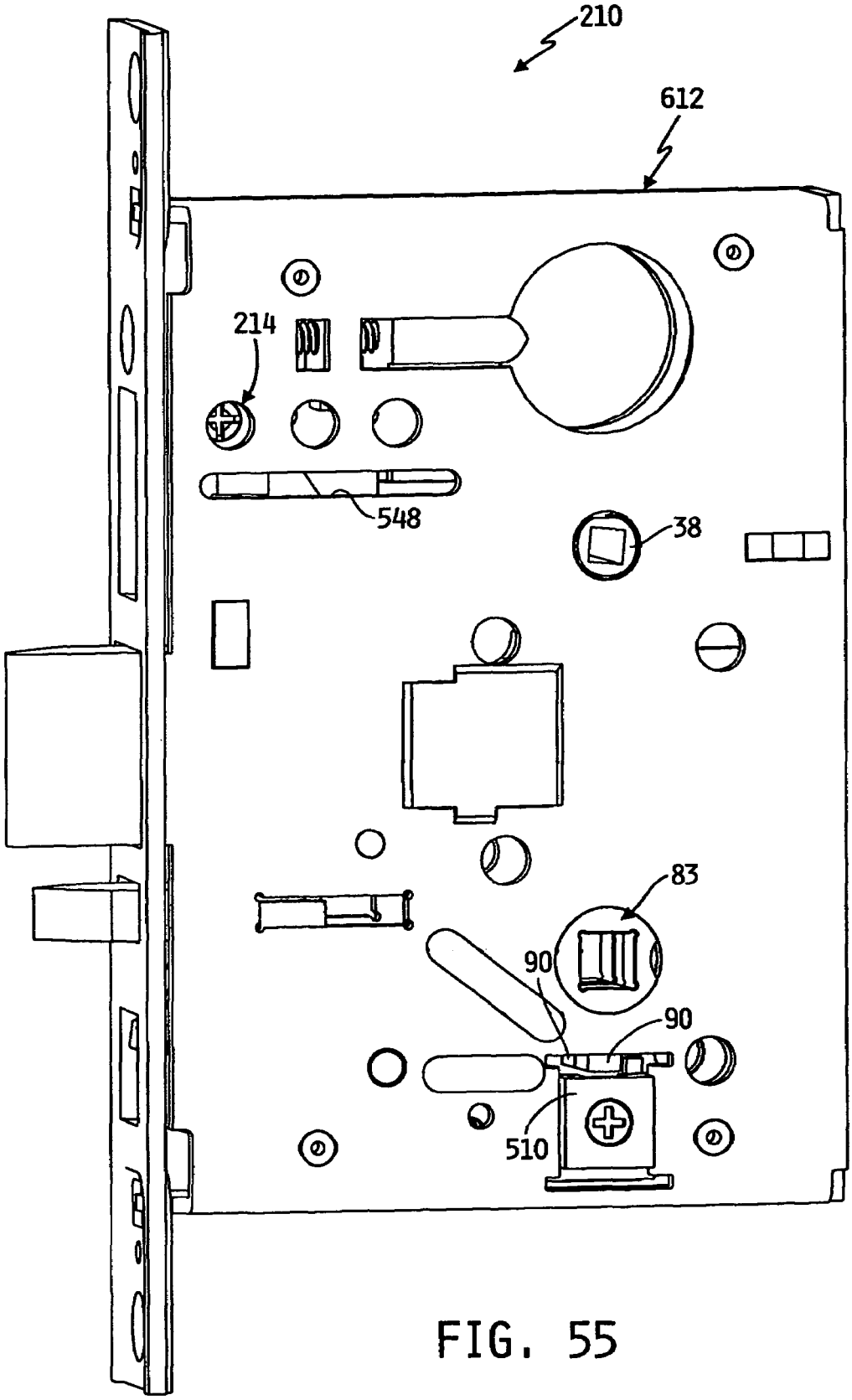
FIG. 55 is a view similar to FIG. 54.
Figure 56:
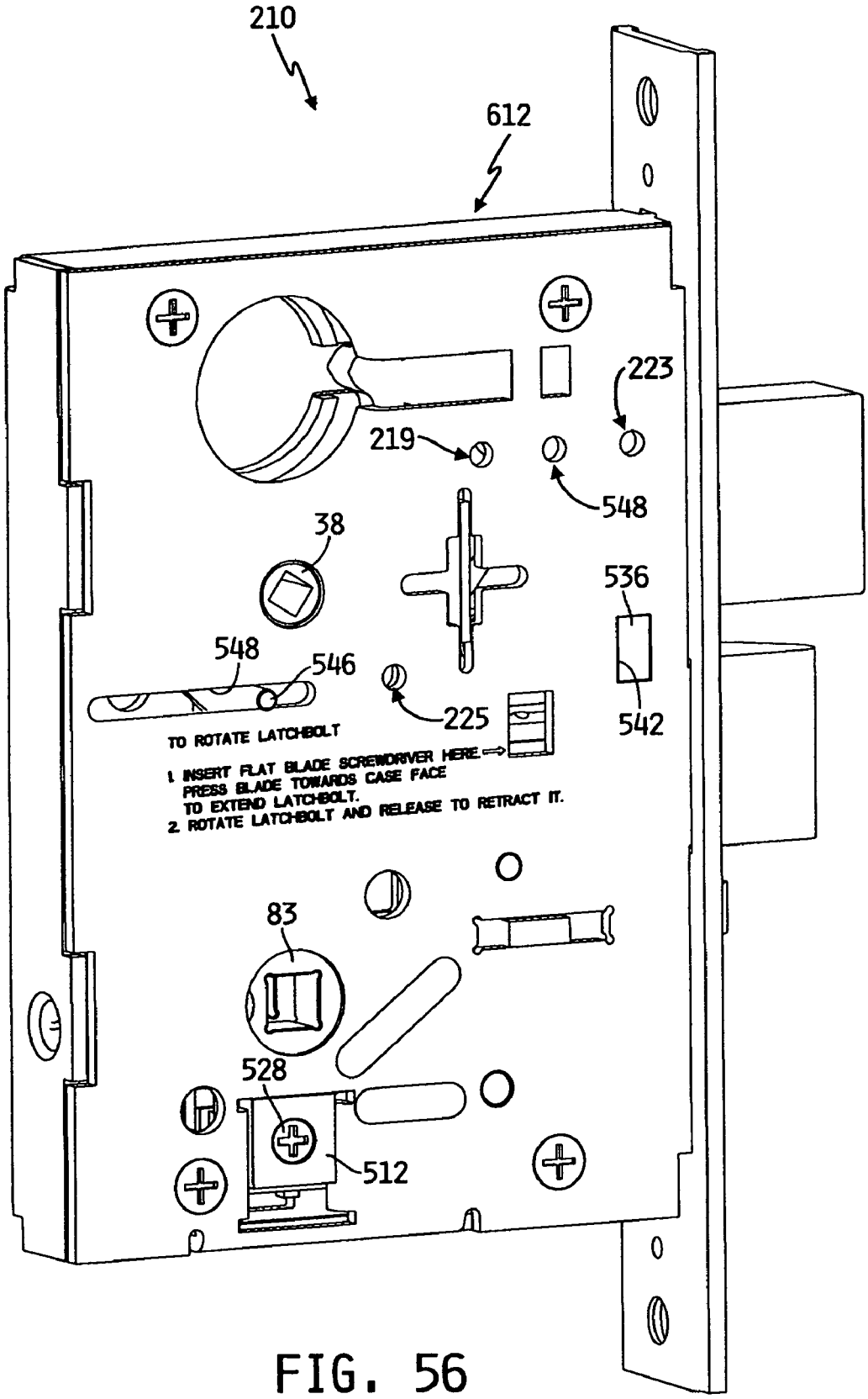
FIG. 56 is another perspective view of the opposite side of the alternative case.

As shown in FIG. 49, locking lever 514 includes a pair of threaded apertures 524, 526 that receive screws 528 extending through apertures 530 defined through toggles 510, 512. To adjust the position of toggles 510, 512 so that they engage lugs 90 of hubs 80, 82, as shown in FIG. 53, screws 528 are positioned in upper apertures 524 so that toggles 510, 512 block input to handles 24 from retracting latch bolt 14. To adjust the position of toggles 510, 512 so they do not engage lugs 90 of hubs 80, 82, screws 528 are positioned in lower apertures 524 so that toggles 510, 512 permit inputs to handles 24 to retract latch bolt 14. As shown in FIGS. 53 and 56, screws 528 and toggles 510, 512 are accessible from the exterior of an alternative embodiment chassis 612 (or chassis 12) to permit adjustment of the position of toggles 510, 512 without the need to open chassis 612 (or chassis 12).

Figure 50:
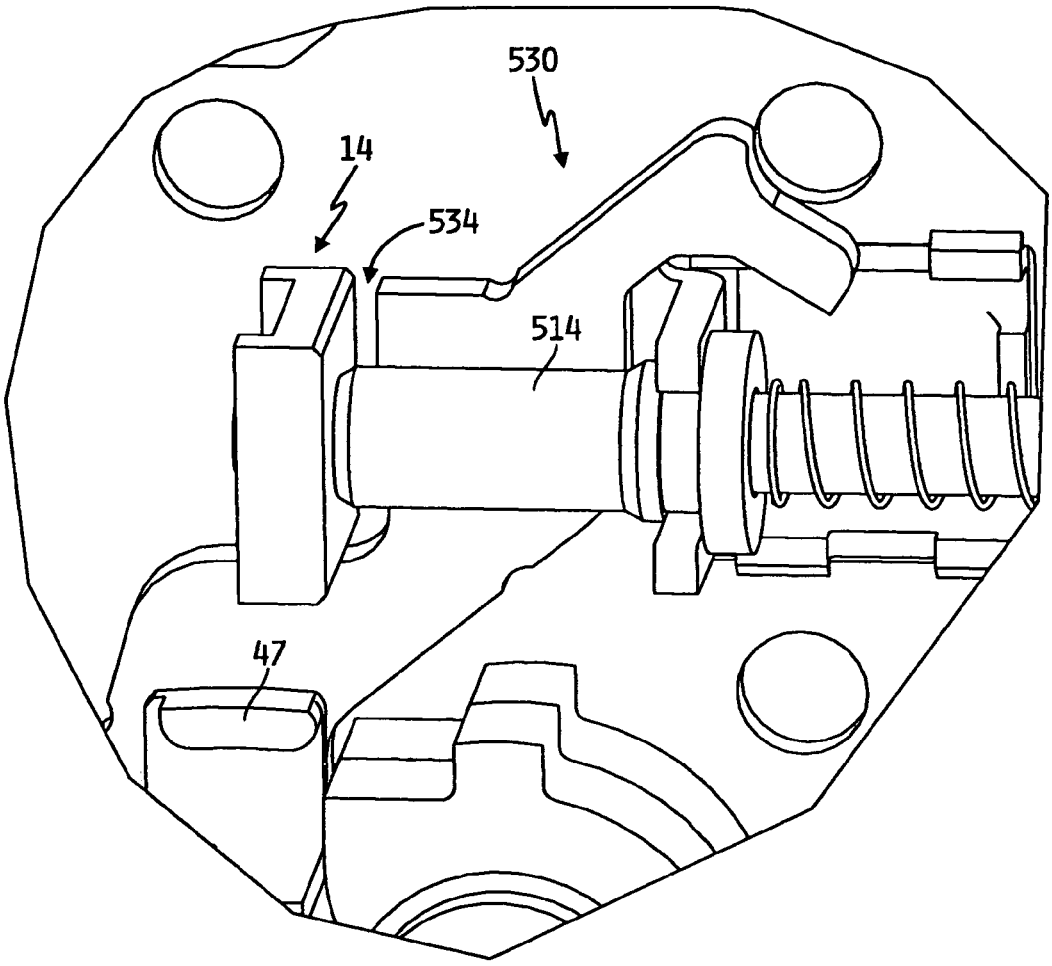
FIG. 50 is an enlarged perspective view of a portion of FIG. 51 showing the handle release lever spaced apart from the latch bolt.
Figure 51:
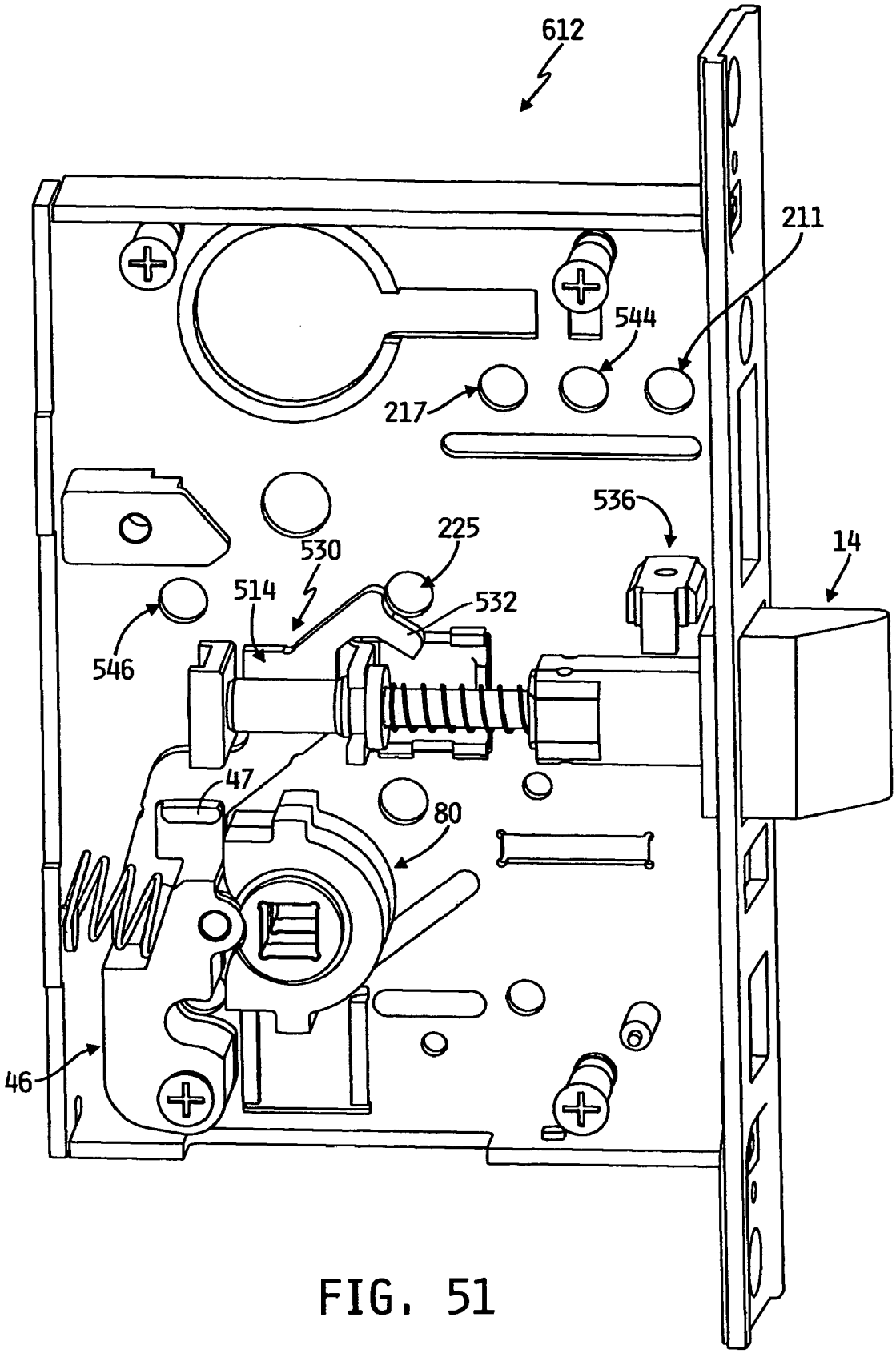
FIG. 51 is a perspective view of a the alternative embodiment link showing the alternative embodiment handle release lever and fusible link.

An alternative embodiment handle release lever or link 530 is shown in FIGS. 50 and 51 along with an alternative embodiment latch bolt collar 514. Handle release lever 530 is similar to handle release lever 46 discussed above for locks 10 and 210. Handle release lever 530 includes an extension 532 positioned between chassis 612 (or chassis 12) and deadbolt 16 when provided on lock 10 and positioned between chassis 612 (or chassis 12) and shuttle 212 when provided on lock 210. As shown in FIG. 50, when hubs 80, 82 are positioned in their normal position without being acted upon by handles 24, handle release lever 530 is spaced apart from latch bolt 14 with a gap 534 provided therebetween. By providing gap 534, handles 24, hubs 80, 82, and handle release lever 530 must travel a certain distance before latch bolt 14 will begin to retract. Thus, if either or both of handles 24 are locked by toggles 510, 512 (or toggles 84, 86), they will not move latch bolt 14 even if handles 24 are suddenly impacted or rapped. Any travel due to the impact is taken up by gap 534. Thus, gap 534 provides a degree of lost motion for handles 24, hubs 80, 82, and release lever 520 before handle release lever 530 will act upon latch bolt 14 to unlatch door 11.

Figure 52:
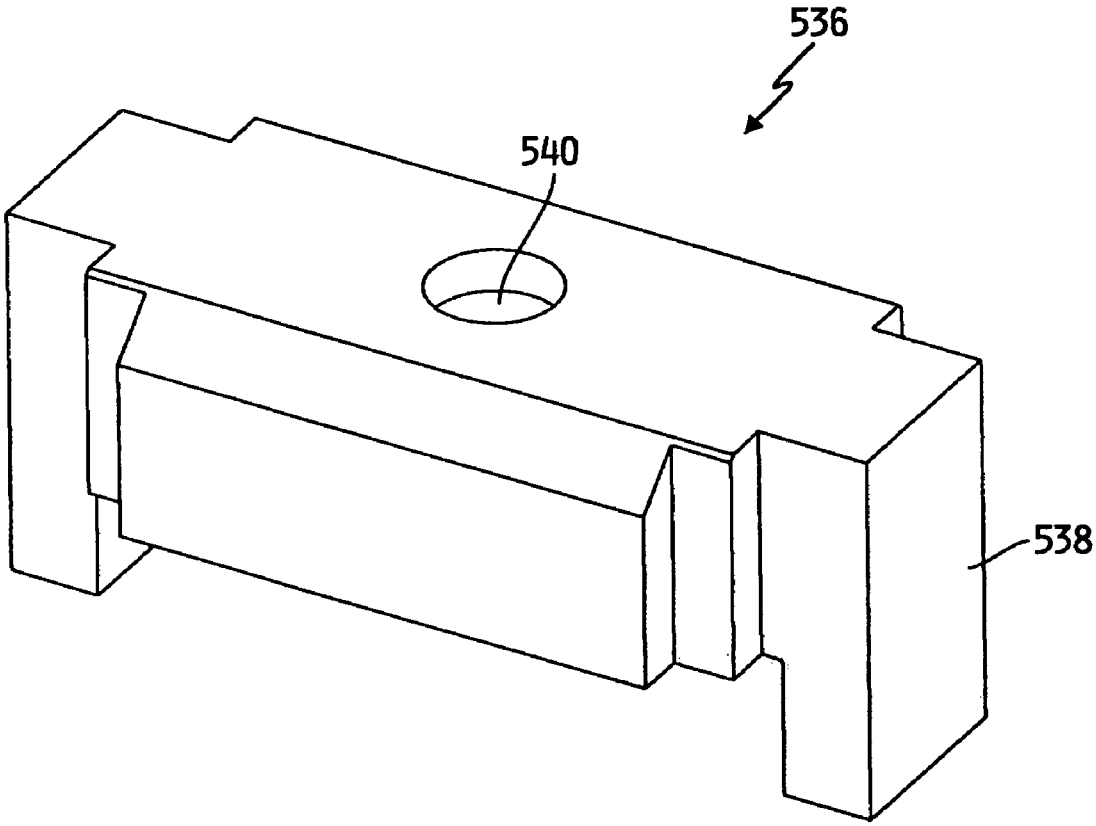
FIG. 52 is a perspective view of a fusible link for use with the alternative embodiment case.

As shown in FIG. 51, a fusible link 536 is provided for use with lock 10 or lock 210 when using alternative chassis 612, chassis 12, or any other suitable case. As shown in FIG. 52, fusible link includes a plastic outer shell 538 and a steel inner bar 540, as shown in FIG. 39. Steel inner bar 540 extends across chassis 612 and through apertures 542 provided in chassis 612. As shown in FIG. 39, plastic outer shell 538 supports inner bar 540 at a position above latch bolt 14 so that inner bar 540 does not normally interfere with retraction of latch bolt 14. However, after a being exposed to enough heat for a predetermined time, plastic outer shell 538 will melt away and steel inner bar 540 will drop down apertures 542 to a position behind latch bolt 14 preventing latch bolt 14 from being retracted.

Figure 57:
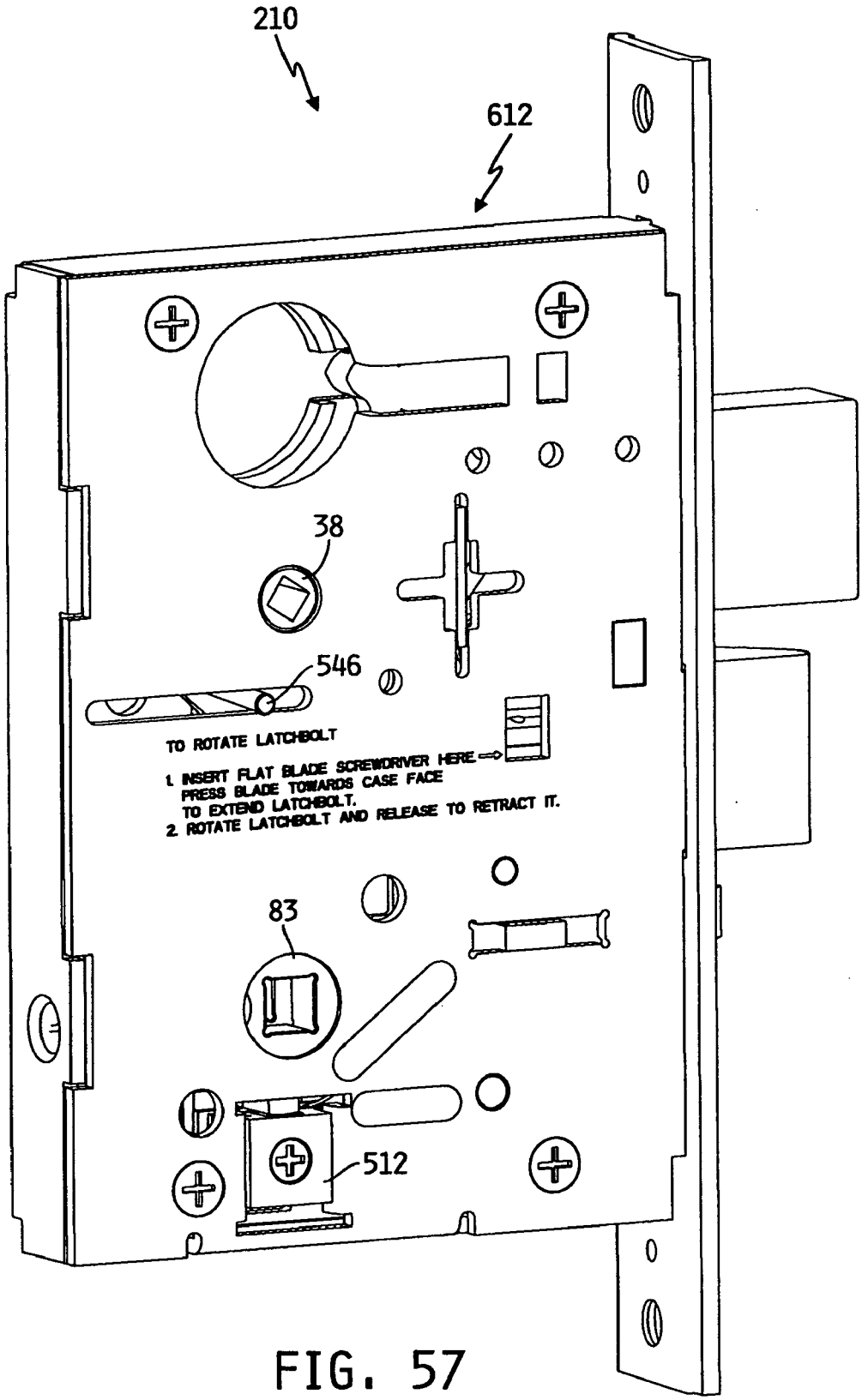
FIG. 57 is a view similar to FIG. 56.

As shown in FIGS. 51 and 57, alternative embodiment chassis 612 is provided for use with lock 10 and lock 212 as described above with the various possible combinations of alternative components described herein. Chassis 612 is similar to chassis 12 and includes first apertures 217, 219, second apertures 211, 223, and third apertures 215, 225.

According to an alternative method of changing or reconfiguring lock 210 to the fourth configuration described above, screw 214 is placed in aperture 221 of shuttle 212 through a fourth aperture 544 in cover plate 34 that is aligned with aperture 221 in shuttle 212 when shuttle 212 is in the middle position shown in FIG. 25. Screw 214 also extends through an aperture 548 on the opposite side of chassis 612 as shown in FIG. 56. When using chassis 612, pin 213 (shown in FIG. 19 and described above) in shuttle 212 that slides along slots 548 in chassis 12 is replaced with a screw 548 that also slides along slots 548 provided in chassis 12, 612. When reconfiguring lock 210 to the fourth configuration, screw 548 is removed from shuttle 212 through fifth aperture 546 and positioned into aperture 218 of shuttle 212 through third aperture 215 when shuttle 212 is in the intermediate position. Screw 548 extends through chassis 612 into aperture 225.

When in this position, screw 214 blocks shuttle 212 from sliding in chassis 612 and holds turn knob hub 38 in an intermediate position so that cam 102 does not contact locking lever 48. Toggle lever 100 is then used to move locking lever 48 up and down to engage and disengage toggles 84, 86 (or the other toggles disclosed herein) with lugs 90 to enable and disable handles 24.

Unless otherwise stated herein, the figures are proportional. Although the present invention has been described in detail with reference to preferred embodiments, variations and modifications exist within the scope and spirit of the present invention.

The invention claimed is:

1. A mortise lock for a door including a chassis, a latch bolt supported by the chassis to move relative to the chassis between a latched position and an unlatched position, a first door handle, a first hub coupled to the first door handle, a second door handle, a second hub coupled to the second door handle, a shuttle supported by the chassis to move between an enabled position and a disabled position, a first toggle mounted on the shuttle, the first toggle being moveable relative to the shuttle between a first position engaging the first hub to block an input from the first door handle from moving the latch bolt to the unlatched position and a second position permitting the input to the first door handle to move the latch bolt to the unlatched position, a second toggle mounted on the shuttle, the second toggle being moveable relative to the shuttle between a first position engaging the second hub to block an input from the second door handle from moving the latch bolt to the unlatched position and a second position permitting the input to the second door handle to move the latch bolt to the unlatched position, the first and second toggles being spaced apart from the first and second hubs when in the first position and the shuttle is in the disabled position, a control member supported by the chassis and moveable between a first position in direct contact with the shuttle holding the shuttle in the disabled position, a second position in contact with the shuttle holding the shuttle in the enabled position, and a third position, and a shuttle toggle supported by the chassis and moveable relative to the chassis when the control member is in the third position, the shuttle toggle moveable between a first position in contact with the shuttle holding the shuttle in the enabled position and a second position holding the shuttle in the disabled position.

2. A mortise lock for a door including a chassis having a front end accessible through an end of the door when the mortise lock is installed on the door, a latch bolt supported by the chassis to move relative to the chassis between a latched position and an unlatched position, a first door handle, a second door handle, and means for changing the state of the mortise lock between at least two states selected from a plurality of states including a first state in which at least one of the first and second door handles are locked and unlocked by an input through the front or back of the door, a second state in which at least one of the first and second door handles are locked and unlocked through the front end of the chassis, a third state in which at least one of the first and second door handles are always locked after the lock is installed, and a fourth state in which the first and second door handles are always unlocked after the lock is installed.

3. The mortise lock of claim 2, wherein the at least two selected states includes the first state and the fourth state.

4. The mortise lock of claim 2, wherein the at least two selected states includes each of the first, second, third, and fourth states.

5. The mortise lock of claim 2, wherein the latch bolt is reversible.

6. A mortise lock for a door including a chassis having a front end accessible through an end of the door when the mortise lock is installed on the door, a latch bolt supported by the chassis to move relative to the chassis between a latched position and an unlatched position, a first door handle, a second door handle, and means for configuring the lock between at least two functions selected from a plurality of functions including an office function, a storeroom function, a classroom function, a passage function, a privacy function, and an exit function.

7. The mortise lock of claim 6, wherein the at least two selected states includes the office function and the passage function.

8. The mortise lock of claim 6, wherein the at least two selected states includes each of the office function, the storeroom function, the classroom function, and the passage function.

9. The mortise lock of claim 6, wherein the latch bolt is reversible.

10. A mortise lock for a door including a chassis having a face accessible through the door when the mortise lock is installed on the door, a latch bolt supported by the chassis to move relative to the chassis between a latched position and an unlatched position, a first door handle a first hub coupled to the first door handle, a second door handle a second hub coupled to the second door handle, a shuttle moveable relative to the chassis to move between a shuttle block state and a shuttle unblock state, and a shuttle toggle supported by the chassis and moveable relative to the chassis, and an interactive member mounted on and moveable relative to the shuttle between an interactive member block state and an interactive member unblock state, the interactive member block state blocking an input to the first door handle from moving the latch bolt to the unlatched position, the interactive member unblock state permitting the input to the first door handle to move the latch bolt to the unlatched position, the door being prevented from being opened through the input to the first door handle dependent upon the interactive member being in the interactive member block state and the shuttle being in the shuttle block state, the door being able to be opened through an input to both the first and second door handles when the shuttle is in the shuttle block state and further including another interactive member mounted on and moveable relative to the shuttle between an interactive member block state an input to the second door handle from moving the latch bolt to the unlatched position and an interactive member unblock state permitting the input to the second door handle to move the latch bolt to the unlatched position, the shuttle being moveable relative to the chassis to move the interactive members between the interactive members block state and the interactive member unblock state.

11. The mortise lock of claim 10, wherein the interactive member translates on the shuttle between the block state and the unblock state.

12. The mortise lock of claim 10, wherein the chassis includes a front end accessible when the mortise lock is installed, the position of the at least one shuttle being adjustable through the front end of the chassis.

13. The mortise lock of claim 10, wherein the chassis includes first and second sides substantially parallel to the front of the door when installed, the position of the shuttle being adjustable through at least one of the first and second sides.

14. The mortise lock of claim 10, wherein the mortise lock is devoid of a dead bolt.

15. The mortise lock of claim 10, wherein the latch bolt is reversible.

16. The mortise lock of claim 1, wherein the first toggle is free from direct contact with the control member.

17. The mortise lock of claim 1, wherein the first toggle is spaced apart from the control member.

18. The mortise lock of claim 1, wherein the shuttle toggle is moveable between the first and second positions independently of movement of the control member.

19. The mortise lock of claim 10, wherein the door is able to be opened through an input to both the first and second door handles when the shuttle is in the shuttle block state and the interactive member is in the interactive member unblock state.

20. The mortise lock of claim 1, wherein movement of the first toggle relative to the shuttle is independent of movement of the second toggle relative to the shuttle.

21. The mortise lock of claim 1, wherein the shuttle moves along a linear path relative to the chassis during movement between the enabled and disabled positions.

22. The mortise lock of claim 1, wherein the chassis includes a first side, a second side opposite the first side, and a front end extending between the first and second sides and accessible when the mortise lock is installed, the front end has an aperture receiving at least a portion of the shuttle toggle, the first side has an aperture receiving at least a portion of the first toggle, and the second side has an aperture receiving at least a portion of the second toggle.

23. The mortise lock of claim 10, wherein the interactive members are supported by the shuttle and move independent of one another relative to the shuttle.

* * * * *